US006554368B2

(12) United States Patent
Drake et al.

(10) Patent No.: US 6,554,368 B2
(45) Date of Patent: Apr. 29, 2003

(54) METHOD AND SYSTEM FOR MINING HYDROCARBON-CONTAINING MATERIALS

(75) Inventors: Ronald D. Drake, Lake Arrowhead, CA (US); Michael Helmut Kobler, San Francisco, CA (US); John David Watson, Evergreen, CO (US)

(73) Assignee: Oil Sands Underground Mining, Inc., Evergreen, CO (US)

( * ) Notice: Subject to any disclaimer, the term of this patent is extended or adjusted under 35 U.S.C. 154(b) by 0 days.

(21) Appl. No.: 09/797,886

(22) Filed: Mar. 5, 2001

(65) Prior Publication Data

US 2002/0030398 A1 Mar. 14, 2002

Related U.S. Application Data

(60) Provisional application No. 60/243,531, filed on Oct. 25, 2000, provisional application No. 60/241,957, filed on Oct. 20, 2000, provisional application No. 60/203,841, filed on May 12, 2000, provisional application No. 60/189,608, filed on Mar. 15, 2000, and provisional application No. 60/188, 792, filed on Mar. 13, 2000.

(51) Int. Cl.[7] ..... E21B 41/24; E21D 11/00

(52) U.S. Cl. ..... 299/8; 299/19; 299/18; 299/56; 299/1.3; 405/146

(58) Field of Search ..... 299/7.8, 11, 19, 299/56, 55, 18, 1.3, 1.9; 405/146

(56) References Cited

U.S. PATENT DOCUMENTS

| | | | | |
|---|---|---|---|---|
| 3,034,773 A | | 5/1962 | Legatski | 262/2 |
| 3,678,694 A | | 7/1972 | Haspert | 61/84 |
| 3,778,107 A | | 12/1973 | Haspert | 299/11 |
| 3,784,257 A | | 1/1974 | Lauber et al. | 299/31 |
| 3,888,543 A | * | 6/1975 | Johns | 299/11 |
| 3,941,423 A | | 3/1976 | Garte | 299/8 |
| 3,960,408 A | | 6/1976 | Johns | 299/19 |

(List continued on next page.)

FOREIGN PATENT DOCUMENTS

| | | |
|---|---|---|
| CA | 986146 | 3/1976 |
| CA | 986544 | 3/1976 |

OTHER PUBLICATIONS

Lovat Inc. Company Brochure.

Sunburst Excavation—IN FOCUS; Nov. 1993, 18–19, 22–23.

Young et al.; "Full–scale Testing of the PCF Rock Excavation Method"; *VIII Australian Tunnelling Conference*; Aug. 1993. pp. 259–264.

Hignett et al.; "Tunnelling Trials in Chalk: Rock Cutting Experiments"; *TRRL Laboratory Report 796*; 1977.

"Canadian coal given the TBM treatment at Cape Breton"; Reprinted from *Tunnels & Tunnelling*, May 1985; 4 pp.

(List continued on next page.)

*Primary Examiner*—David Bagnell
*Assistant Examiner*—John Kreck
(74) *Attorney, Agent, or Firm*—Sheridan Ross P.C.

(57) ABSTRACT

The present invention is directed, inter alia, to devices and methods for excavating valuable materials, particularly soft ores such as oil sands, oil shales, and the like, that use one or more of a number of features, including backfilling for ground support, a small trailing access tunnel, processing of the valuable material in the excavation with the tailings optionally being used as backfill and the valuable material being transported to the surface, a plurality of movable shields for ground support, and/or a movable tail shield to provide interim support to the backfill while additional liner sections are installed and/or formed.

79 Claims, 43 Drawing Sheets

U.S. PATENT DOCUMENTS

| | | | | | |
|---|---|---|---|---|---|
| 4,067,616 | A | | 1/1978 | Smith et al. | 299/7 |
| 4,072,018 | A | * | 2/1978 | Alvarez-Calderon | 264/32 |
| 4,152,027 | A | | 5/1979 | Fujimoto et al. | 299/1 |
| 4,167,290 | A | | 9/1979 | Yamazaki et al. | 299/1 |
| 4,203,626 | A | | 5/1980 | Hamburger | 299/33 |
| 4,209,268 | A | | 6/1980 | Fujiwara et al. | 405/147 |
| 4,440,449 | A | * | 4/1984 | Sweeney | 299/11 |
| 4,445,723 | A | * | 5/1984 | McQuade | 299/11 |
| 4,458,947 | A | * | 7/1984 | Hopley et al. | 299/11 |
| 4,486,050 | A | | 12/1984 | Snyder | 299/18 |
| 4,494,799 | A | | 1/1985 | Snyder | 299/31 |
| 4,505,516 | A | | 3/1985 | Shelton | 299/2 |
| 4,603,909 | A | | 8/1986 | LeJeune | 299/7 |
| 4,607,889 | A | | 8/1986 | Hagimoto et al. | 299/33 |
| 4,774,470 | A | * | 9/1988 | Takigawa et al. | 175/50 |
| 4,793,736 | A | | 12/1988 | Thompson et al. | 405/146 |
| 4,808,030 | A | | 2/1989 | Takegawa | 405/146 |
| 4,856,936 | A | | 8/1989 | Hentschel et al. | 405/145 |
| 5,125,719 | A | | 6/1992 | Snyder | 299/31 |
| 5,205,613 | A | | 4/1993 | Brown, Jr. | 299/31 |
| 5,211,510 | A | | 5/1993 | Kimura et al. | 405/184 |
| 5,330,292 | A | * | 7/1994 | Sakanishi et al. | 299/1.05 |
| 5,697,676 | A | | 12/1997 | Kashima et al. | 299/60 |
| 5,831,934 | A | | 11/1998 | Gill et al. | 367/25 |
| 5,852,262 | A | | 12/1998 | Gill et al. | 181/106 |
| 5,879,057 | A | | 3/1999 | Schwoebel et al. | 299/17 |
| 5,890,771 | A | | 4/1999 | Cass | 299/31 |
| 6,017,095 | A | | 1/2000 | DiMillo | 299/56 |
| 6,027,175 | A | | 2/2000 | Seear et al. | 299/18 |
| 6,206,478 | B1 | | 3/2001 | Uehara et al. | 299/33 |

OTHER PUBLICATIONS

Marsh et al.; "Design, Excavation, Support of a Large Diameter Coal Mine Access Decline Using a Tunnel Boring Machine"; Chapter 11; *RETC Proceedings*, vol. 1; pp. 155–176.

Peer; "Giant rock TBM to drive access tunnels under ocean"; reprinted from *Heavy Construction News*; Sep. 19, 1983; 2 pgs.

Hunter et al.; "Design, development, and verification of a Lovat 7.6–metre full–face tunnel–boring machine"; *CIM Coal Developments*; 8 pages.

Stokes et al.; "Cutting head ventilation of a full face tunnel boring machine"; Cape Breton Coal Research Laboratory, CANMET, Sydney, Canada; pp. 305–311.

Ozdemir et al.; "Development of a Water Jet Assisted Drag Bit cutting Head for Coal Measure Rock" Chapter 41; *RETC Proceedings*, vol. 2; 1983; pp. 701–718.

Wang et al.; "High Pressure Water Jet Assisted Tunnelling" Chapter 34; 1976 *RETC Proceedings*; pp. 649–676.

Ounanian et al.; "Development of an Extruded Tunnel Lining System" Chapter 81; 1981 *RETC Proceedings* vol. 2; pp. 1333–1351.

McCormick et al.; Analysis of TBM Performance at the Record Setting River Mountains Tunnel #2; Chapter 8; 1997 *RETC Proceedings*; pp. 135–149.

Maciejewski; "Hydrotransport—An Enabling Technology for Future Oil Sands Development"; Syncrude Canada Ltd.; pp. 67–79.

Paine et al.; "Understanding hydrotransport: The key to Syncrude's success"; *CIM Bulletin*; vol. 92; 1999; pp. 105–108.

Mikula et al.; "Oil Sands Conditioning, Bitumen Release Mechanisms, and New Process Development"; Alberta Oil Sands Information Services; 1993; 8 pgs.

Mikula et al.; "Commercial Implementation of a Dry Landscape Oil Sands Tailings Reclamation Option: Consolidated Tailings"; Alberta Oil Sands Information Services; No. 1998.096; pp. 907–921.

Friesen et al.; "Monitoring of Oil Sand Slurries by On–line NIR Spectroscopy"; Petroleum Society of CIM & Aostra; paper No. 94.10; 9 pages.

Liu et al.; "Volume reduction of oil sands fine tails utilizing nonsegregating tailings"; *Tailings and Mine Waste* '96; pp. 73–81.

Matthews et al.; "Development of composite tailings technology at Syncrude Canada"; Syncrude EDM Research; 2000; pp. 455–463.

Harris et al.; "FeasibilityStudy of Underground Mining of Oil Sand"; AOSTRA Seminar on Underground excavation in Oil Sands; May 19, 1978; 33 pages.

Yoshidawa et al.; "A Study of Shield Tunnelling Machine (Part 1)—Soil Condition for Pressurized Slurry Shield to be Adapted–"; Translation Copy of Hitachi Zosen Technical Review; vol. 42; No. 1–4; 1981; 38 pages.

Mitsubishi Shield Machine Article; by Mitsubishi Heavy Industries, Ltd.; 33 pages.

Press Release; Slurries.wpd; Jan Czarnecki; 3 pages.

CHOA Conference—Dec. 6, 2000—Program.

* cited by examiner

FIG. 2A
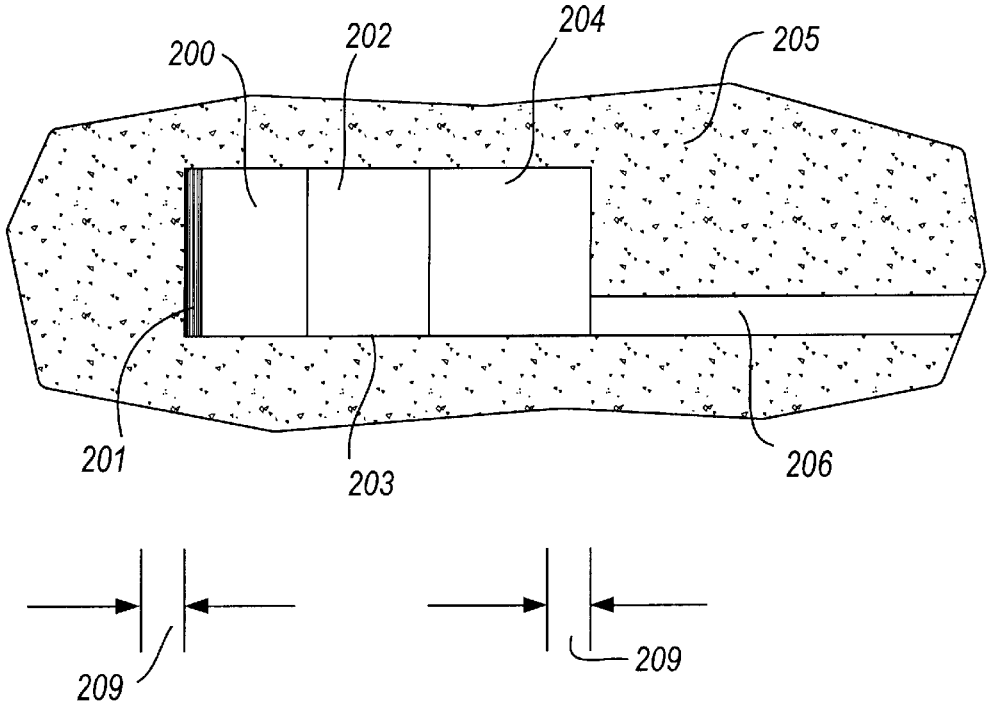
FIG. 2B
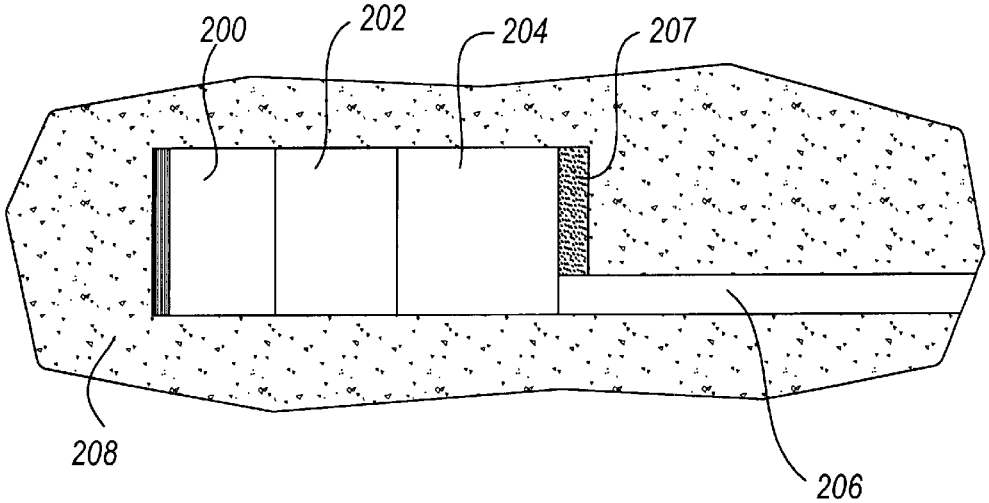
FIG. 2

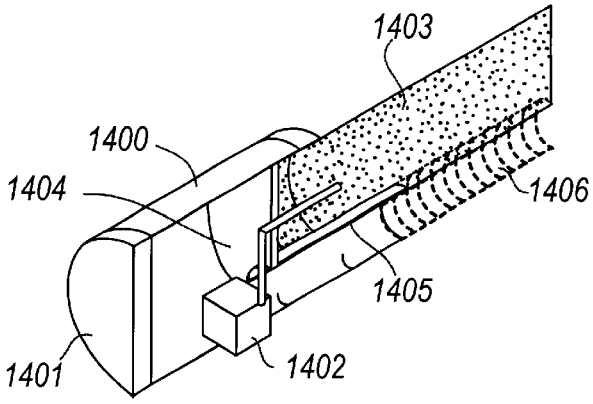
FIG. 14A
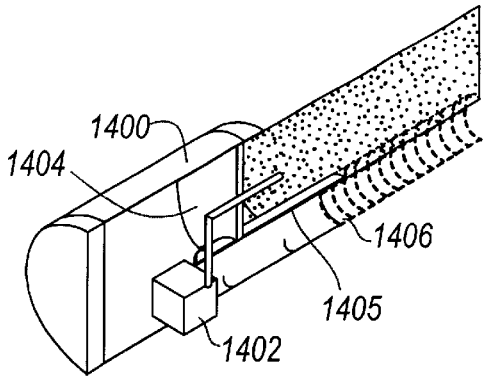
FIG. 14B
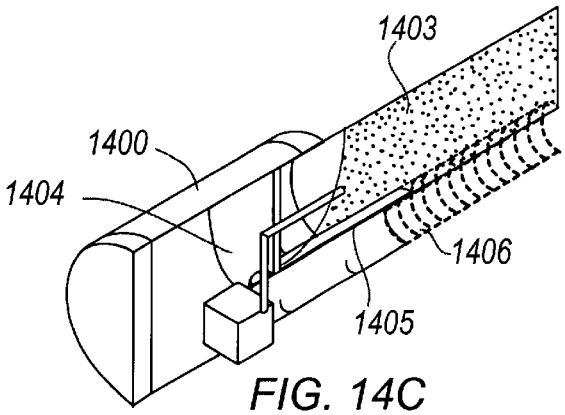
FIG. 14C
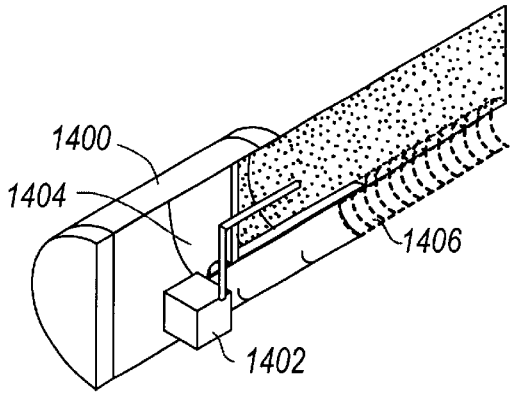
FIG. 14D
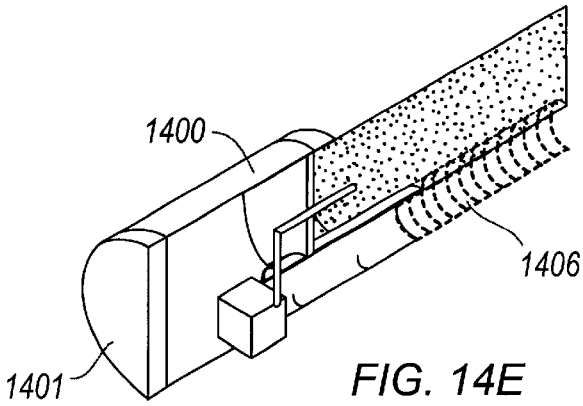
FIG. 14E
FIG. 14

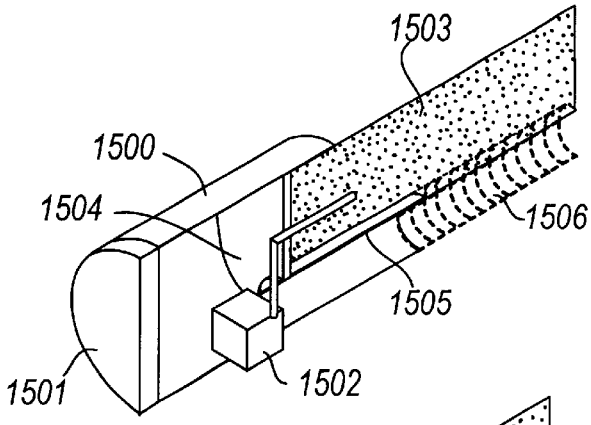
FIG. 15A
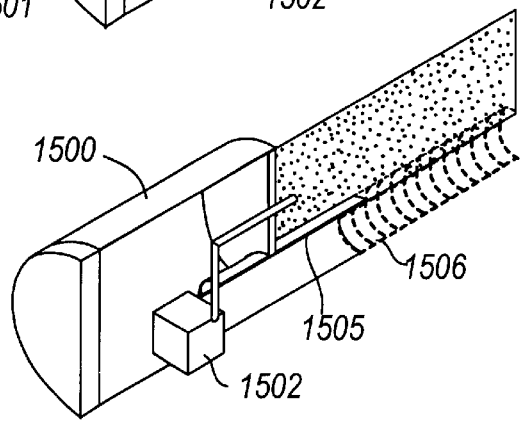
FIG. 15B
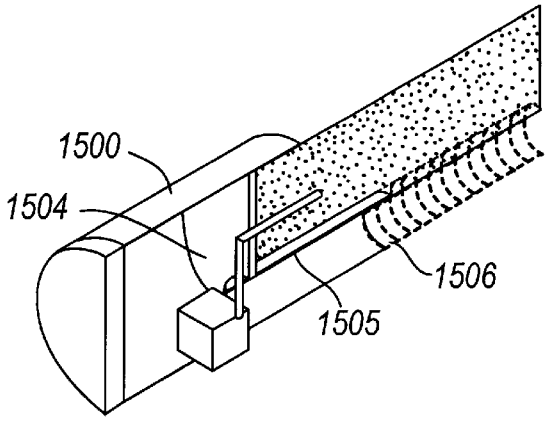
FIG. 15C
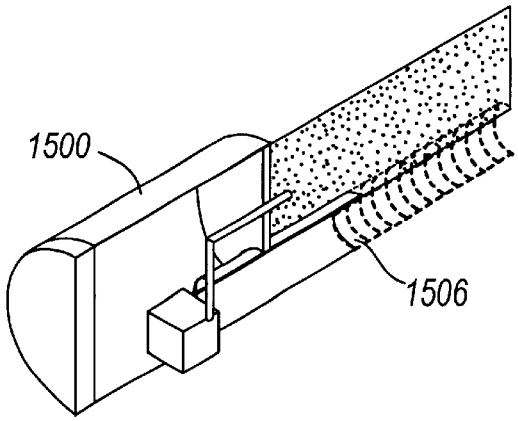
FIG. 15D
FIG. 15

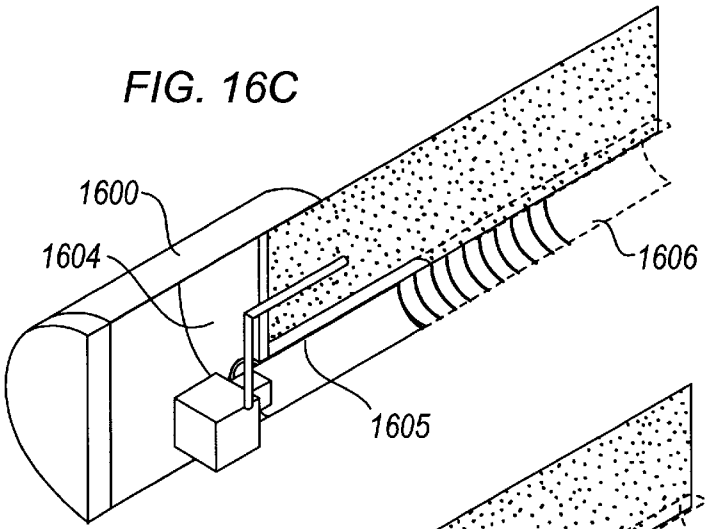
FIG. 16C
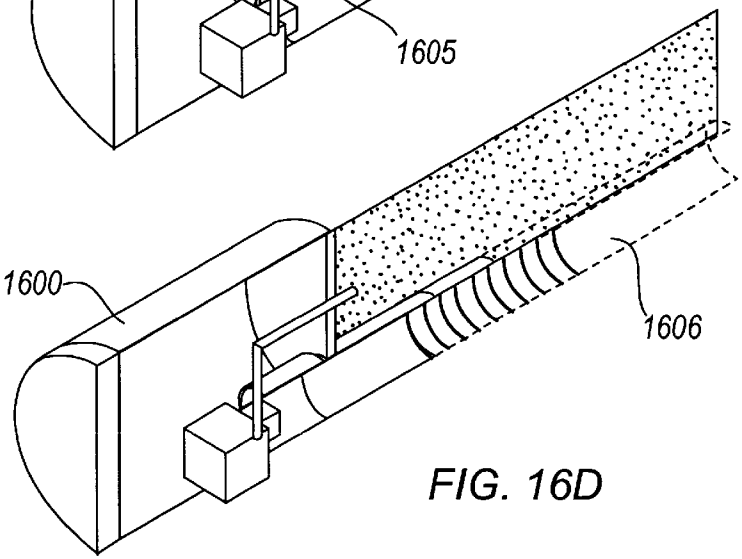
FIG. 16D
FIG. 16
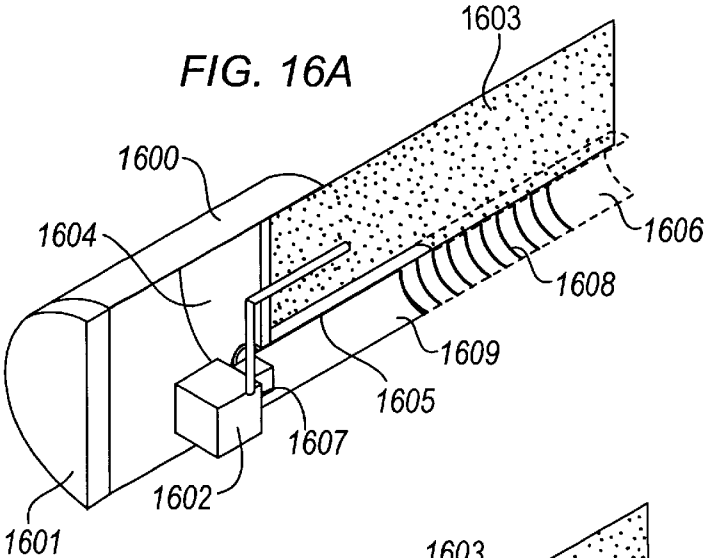
FIG. 16A
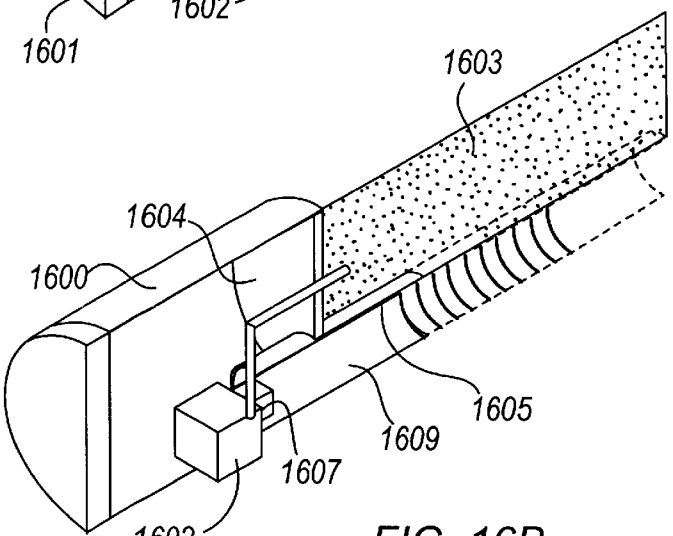
FIG. 16B FIG. 17B
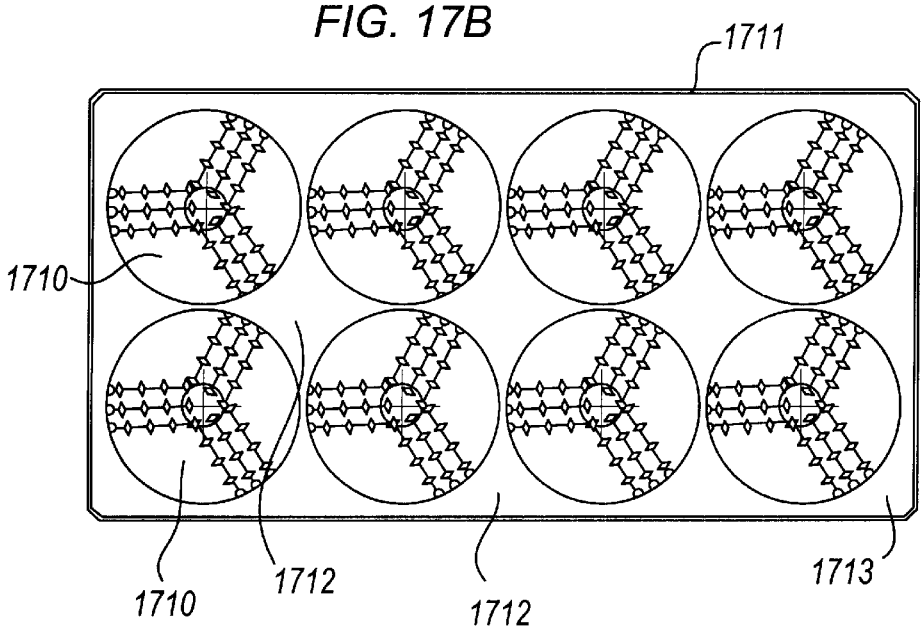
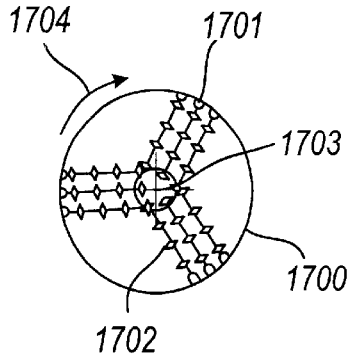
FIG.17A
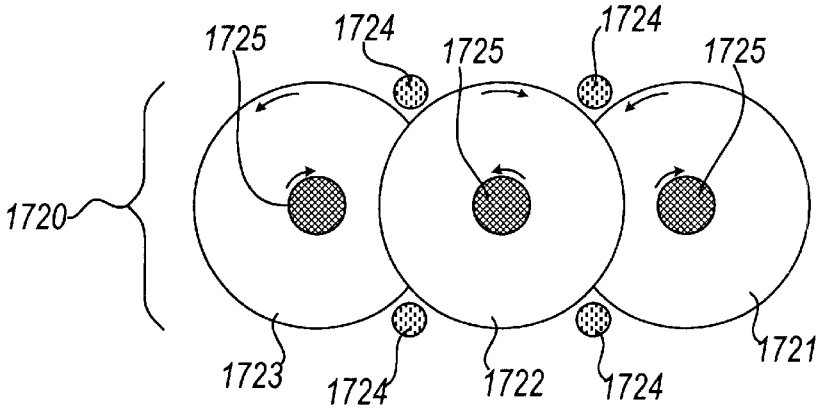
FIG.17C
FIG. 17

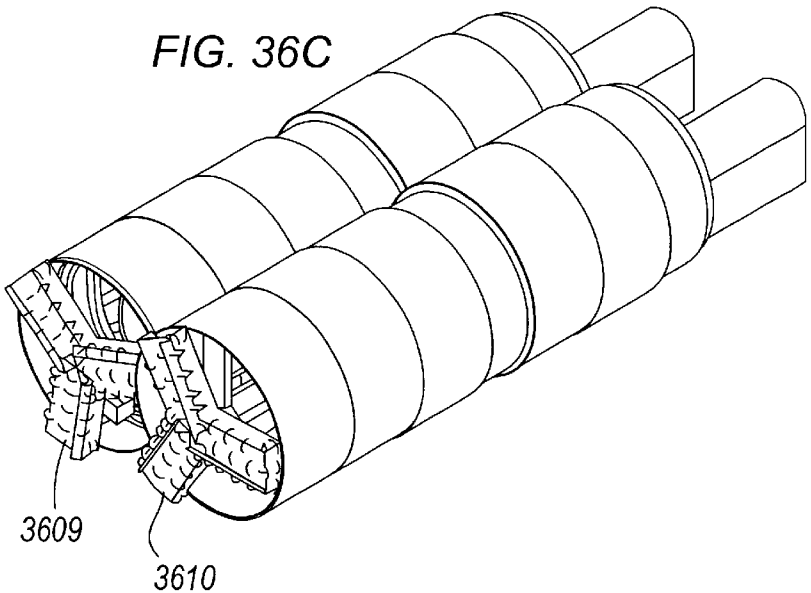
FIG. 36C
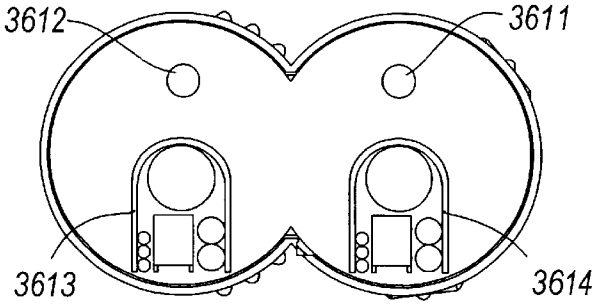
FIG. 36D
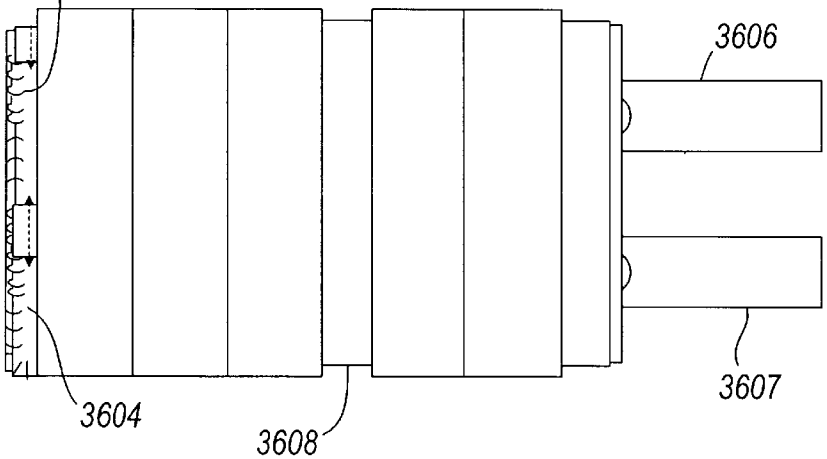
FIG. 36B
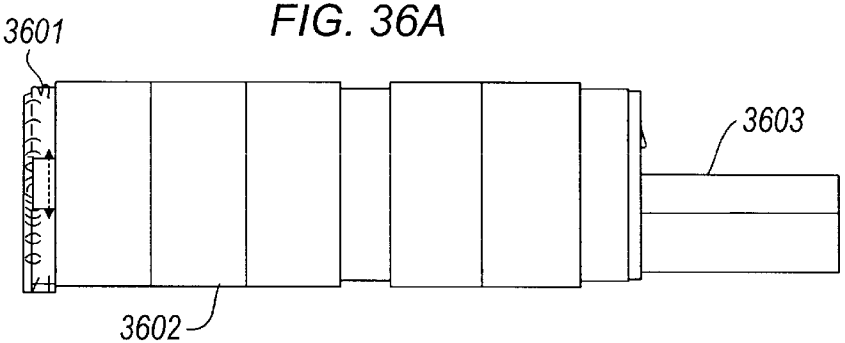
FIG. 36A
FIG. 36

FIG. 38B
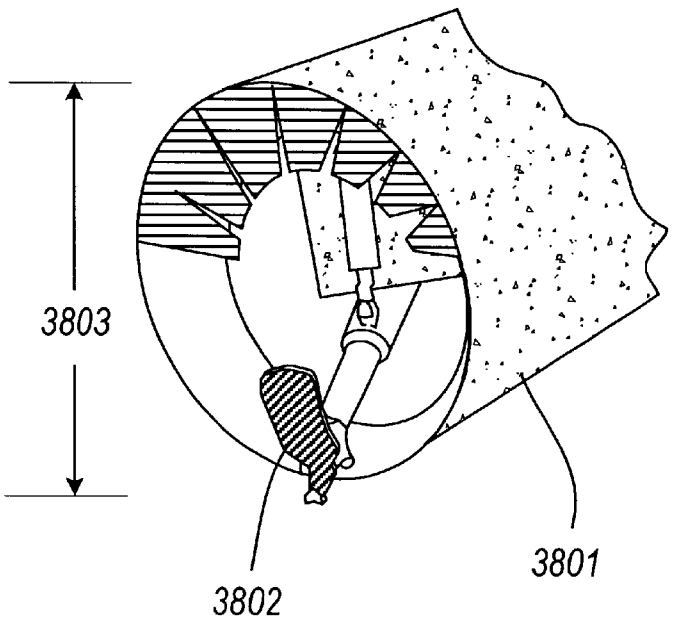
FIG. 38A
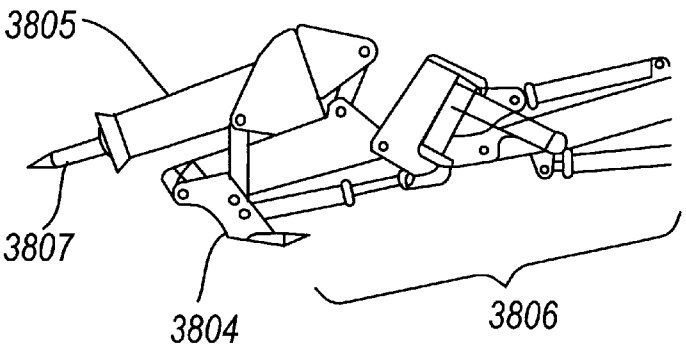
FIG. 38

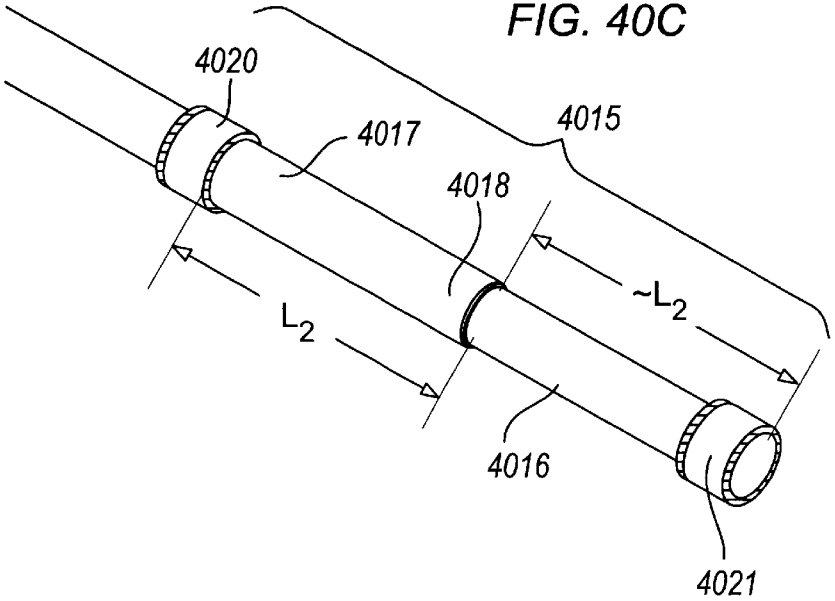
FIG. 40C
FIG. 40
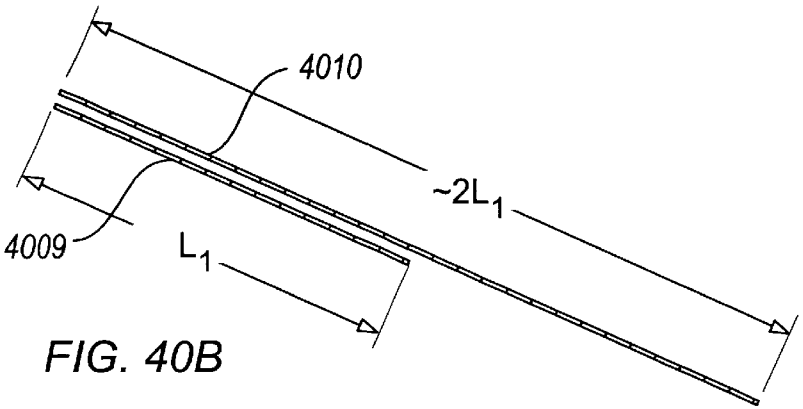
FIG. 40B
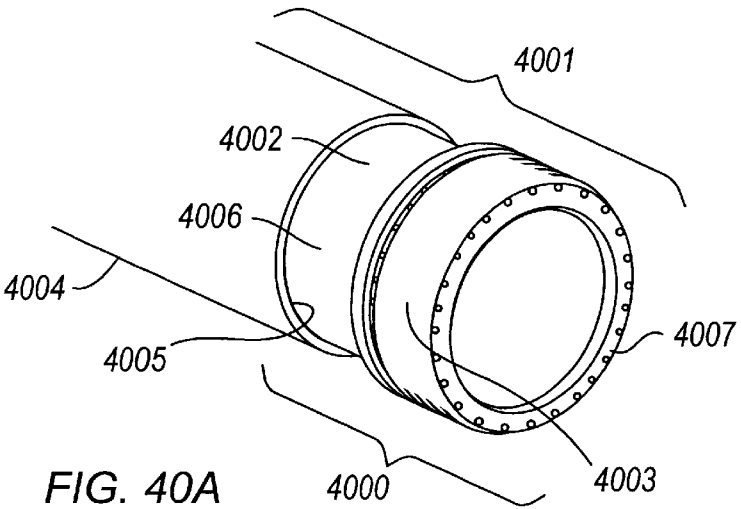
FIG. 40A

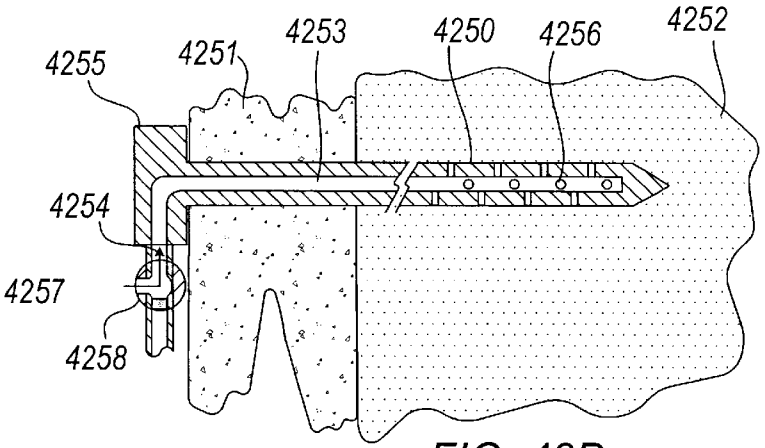
FIG. 42B
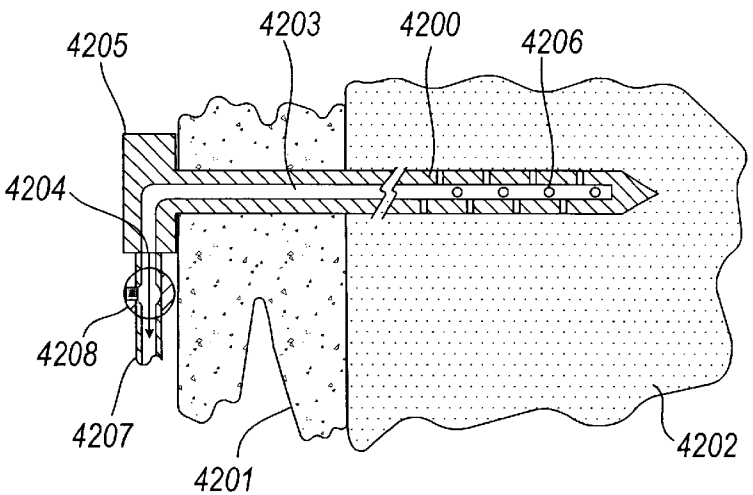
FIG. 42A
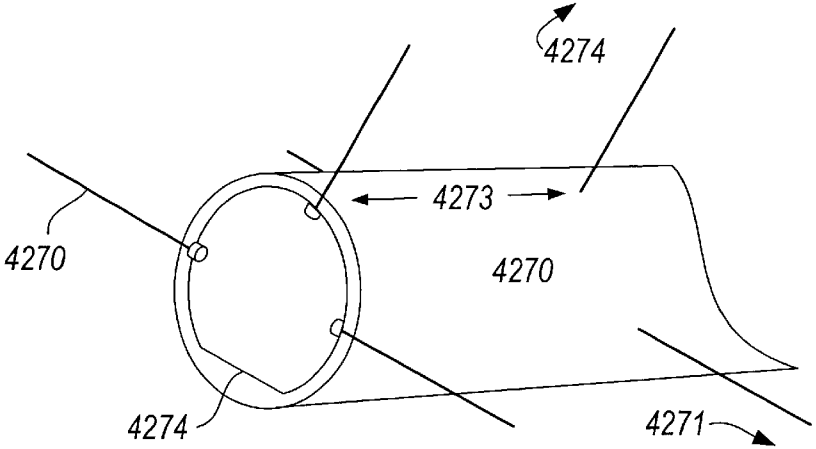
FIG. 42C
FIG. 42

METHOD AND SYSTEM FOR MINING HYDROCARBON-CONTAINING MATERIALS

CROSS REFERENCE TO RELATED APPLICATIONS

The present application claims the benefits under 35 U.S.C. §119(e) from U.S. Provisional Application Ser. No. 60/188,792, filed Mar. 13, 2000, to Drake, et al.; No. 60/189,608, filed Mar. 15, 2000, to Drake, et al.; No. 60/203,841, filed May 12, 2000, to Drake, et al.; No. 60/241,957, filed Oct. 20, 2000, to Drake, et al.; and No. 60/243,531, filed Oct. 25, 2000, which are incorporated herein by reference in their entireties.

FIELD OF THE INVENTION

The present invention is related to the mining and/or processing of soft-ore deposits generally and to the mining and/or processing of bitumen-containing materials, such as oil sands, specifically.

BACKGROUND OF THE INVENTION

Oil is a nonrenewable natural resource having great importance to the industrialized world. Over the last century, the consumption of oil has increased dramatically and has become a strategic commodity, leading to the development of alternative sources of crude oil such as oil sands and oil shales. As used herein, oil sands are a granular or particulate material, such as an interlocked skeleton of sand, with pore spaces occupied by bitumen (an amorphous solid hydrocarbon material totally soluble in carbon disulfide), and oil shale is a rock containing kerogen (a carbonaceous material that which gives rise to crude oil on distillation). The vast majority of the world's oil sands deposits are found in Canada and Venezuela. Collectively, oil sands deposits contain an estimated 10 trillion barrels of in-place oil. Oil shales are found worldwide with large deposits in the U.S. Collectively, oil shale deposits contain an estimated 30 trillion barrels or more of in-place oil. It is to be understood that a reference to oil sands is intended to include oil shales and vice versa.

Bitumen is typically an asphalt-like substance having an API gravity commonly ranging from about 5° to about 10° and is contained within the pore space of the oil sands. Bitumen cannot be recovered by traditional oil well technology because it will not flow at ambient reservoir temperatures. To overcome this limitation, near surface oil sand deposits are excavated by surface mining methods, while bitumen in deeper deposits is recovered by in situ techniques, which rely on steam or diluents to mobilize the bitumen so that it can be pumped out by conventional oil recovery methods. The bitumen is recovered from the surface excavated oil sands by known separation methods, and the bitumen, whether derived from surface mining or in situ processes, sent to upgrading facilities where it is converted into crude oil and other petroleum products. Underground mining techniques have been largely unsuccessful in mining deeper oil sands due to high mining costs and unstable overburden conditions.

Existing methods for recovering oil from oil sands have numerous drawbacks. Surface mining techniques are typically only economical for shallow oil sands deposits. It is common for oil sands deposits to dip and a significant part of the ore body may be located at depths that are too deep to recover by surface mining methods. As a result, most of the oil sands deposits are unprofitable to mine. Surface mining requires large areas to be stripped of overburden which then must be moved to other areas for storage. The tailings from the bitumen separation process typically require large tailings ponds complexes in which the tailings are treated before the mined land can be reclaimed. The costs of stripping overburden, building and maintaining tailings ponds and eventual land reclamation costs can be high, particularly for deeper oil sands deposits. Because of the large scale of these operations, the short and long term environmental impact and associated costs of surface mining can be substantial. In situ techniques are disadvantaged in that a relatively large amount of energy is consumed per unit energy recovered in the bitumen.

A significant portion of oil sands deposits lie too deep for economical recovery by surface mining and are too shallow for effective in-situ recovery. Other oil sands deposits, though located at shallow depths, are located under surface features that preclude the use of surface mining. For example, oil sands deposits can be located under lakes, swamps, protected animal habitats and surface mine facilities such as tailings ponds. Estimates for economical grade bitumen in these in-between and inaccessible areas range from 30 to 100 billion barrels.

SUMMARY OF THE INVENTION

These and other needs are addressed by one or more of the various inventions discussed herein. Certain of the inventions relate to excavating materials, particularly soft-ore or sedimentary materials, by underground mining techniques. The material excavated by these methods can be any valuable material, particularly in-situ or in-place hydrocarbon-containing materials, such as found in oil sands, oil shales, conventional oil reservoirs, coal deposits and the like, as well as other valuable minerals such as bauxite, potash, trona and the like.

In a first embodiment, the present invention provides an underground mining method in which the material is excavated, continuously, semi-continuously, or episodically, by an underground mining method such as a continuous mining machine, drill-and-blast, longwall mining, hydraulic mining, mechanical excavation whether by backhoes, hydraulic hammers and the like, or by tunnel boring machines ("TBMs") or any other appropriate underground mining practice. A movable shield may be used to provide ground support over the mining apparatus and personnel during excavating. In one configuration, a substantially smaller tunnel liner is formed within the excavation shield and left in place behind the moveable excavation shield as it advances. A backfill material is placed in the excavated volume behind the excavation machine and around the access tunnel liner. Preferably, the backfill at least substantially fills the unsupported volume and itself is supported by the tunnel liner and, in part, by the excavation shield and/or a bulkhead. Typically, the backfill (i.e., the solid particulates and associated interstitial or interparticle spaces) fills at least about 65%, more typically at least about 75% and even more typically from about 85 to about 100% by volume of the space defined by the access tunnel liner, the mining machine bulkhead, the bulkhead (or backfill retaining member) at the excavation entry, and the surrounding excavation. The excavation shield, bulkhead, backfill material and/or tunnel liner all act to support the unexcavated ground behind the excavation face. This combination provides ground support for the mining operation and a small trailing tunnel or passage for ingress and egress from the working face. The backfill material can be tailings from material processing operations, previously mined material, currently mined material, or any other material having acceptable density and strength characteristics.

The backfill operation can be accomplished by numerous techniques. For example, a prefabricated liner having a smaller outer boundary than the surface of the excavation can be set in place anywhere behind a rear section of the movable shield, and, before, during, or after advancement of the shield, the backfill material is injected or otherwise placed in the gap or space between the liner, the machine bulkhead, previously backfilled material, and the surrounding excavated opening. The trailing tunnel is defined by and extends through the liner.

In another configuration, the liner is formed beneath the shield such as using a suitable form, and the lining material placed in or on the form and allowed to set or become self-supporting while the overlying shield is in position. The liner can be formed from any suitable, preferably consolidated, material, such as concrete, grout, asphalt, or a combination thereof. The lining material could include previously excavated material, whether or not processed for bitumen recovery. When the liner is formed, the backfill material can be placed in the gap by suitable techniques. Before injection into the open space above the liner, the excavated backfill material could be combined with a suitable binder, such as flyash, gypsum, sulphur, slag, and the like, which will consolidate or strengthen the backfill material after injection into the open space.

In another configuration, the access tunnel is formed without a liner by combining the backfill material with a binder, such as those described above, placing the backfill material in place above a tail shield and/or form, permitting the backfill material to consolidate and become self-supporting while the tail shield and/or form is in position, and thereafter moving the tail shield, removing the form. Alternatively, the form could be left in position to further support the consolidated backfill.

The trailing tunnel in the backfilled portion of the excavation is preferably substantially smaller in cross-sectional area than the same portion of the excavation before backfilling. Preferably, the cross-section area of the trailing tunnel (in a plane normal to the direction or bearing or longitudinal axis of the tunnel) is no more than about 30%, more preferably no more than about 20%, even more preferably no more than about 10% and most preferably ranges from about 5 to about 10% of the cross-section area (in the same plane) of the excavated portion of the mined volume.

The backfilling of the excavation to define a trailing access tunnel can have numerous advantages. For example, the trailing access tunnel can have a cross-sectional area normal to the long axis of the trailing tunnel that is small enough to reduce significantly the likelihood of caving of the excavation during excavation, thereby providing enhanced safety for personnel, or of surface subsidence after the excavation is completed. This is particularly advantageous in weak overburden conditions, which are typically encountered in oil sand excavation. Backfilling can be significantly less expensive and more effective than conventional ground support techniques. Backfilling can provide a convenient way of disposing of waste materials, such as potentially toxic tailings (e.g., clean sands with a high concentration of clay and shale, etc.) or country rock (i.e., excavated material containing unprofitable levels of bitumen or devoid of bitumen), that are generated during excavation and/or material processing. Large surface facilities are not required for tailings or overburden storage. Reclamation costs, as well as short and long term environmental impacts, can thus be greatly reduced. The per-tonne costs of mining using any of the methods disclosed herein can be the same as, or even less, than the per-tonne mining cost of surface mining techniques on shallow deposits. Due to the high level of long-term ground stability associated with backfilling, the mining techniques disclosed herein can provide economical access to valuable materials in formerly unaccessible areas, such as under industrial facilities or protected or otherwise reserved areas, lakes, swamps, muskeg., etc. The methods disclosed herein can not only recover bitumen in oil sands deposits previously not economically recoverable by surface mining or in situ techniques but also can recover bitumen in oil sands deposits previously recoverable only by in situ techniques. The methods are often preferable to in situ techniques (such as thermal in-situ or chemical in-situ recovery processes) due to substantially less energy expenditure per unit of recovered bitumen. The methods can recover a substantially higher portion of the economically viable oil sands resource (generally regarded as those oil sands containing at least 5% to 6% by mass of bitumen) even in the presence of complex and variable mud and shale layers within the payzone.

In yet another embodiment of the present invention, a number of possible mine plans are provided that are particularly applicable to the variety and diversity of oil sands deposits. In one configuration, a series of "U"-shaped or concentric circular drives or other pattern of drives (in plan view) are formed through the material to be excavated. These are typical patterns that may be used when mining from a single high wall face, as would be the case when operating at the boundary of an open-pit or surface mine. The "U"-shaped excavations typically overlap one another on the turns. The concentric circular drives, for example, do not overlap. However, this type of pattern will leave some deposits in the center of the pattern that cannot be mined. The "U"-shaped, concentric circular drives and other pattern of drives can be used in various combinations to optimize ore recovery in the particular deposit being mined. The various mining drives can be started from either end, and can be carried out in any order either spatially or temporally as dictated by the layout of the ore body and the time it takes for backfill to become consolidated. If backfill strength is insufficient, then a pillar of unmined ore may be left in place between adjacent drives. If the backfill is fully consolidated then adjacent drives may be made as close as possible or even overlap to some extent. In another configuration, where the area to be mined is under a surface obstruction such as a hill, a muskeg swamp, a tailings pond or a large mining facility the mining drives can be a series of straight runs where the mining machine enters and exits on either side of the obstruction, thereby avoiding underground turns. If the mining machine is smaller in height than the depth of the ore body, then the above mining patterns can be repeated on various levels.

The same or other mining patterns may be applied to deeper deposits where access would be established by excavating access tunnels or shafts and creating a large underground cavern for initiating and ending mining drives. The mining machines could be assembled and serviced in these caverns. Alternately, access tunnels or shafts and large underground caverns can be installed on both sides of a large deposit so that the back and forth mining pattern discussed above for mining under a surface obstructions can be applied to deeper deposits.

The foregoing summary is neither complete nor exhaustive. As will be appreciated, the above mining patterns may be varied to suit the local conditions and can be combined or used in other configurations or embodiments that may be different from those set forth above. These mine layouts can be used with any mining method including a continuous mining machine, drill-and-blast techniques, a TBM and the like.

In another embodiment, the excavated material is fully or partially processed in the underground excavation to recover the valuable components of the material. The material can be excavated using any mining process, including those described above. In one configuration, the excavated material is further comminuted in the excavation, such as by a crusher and/or grinder, formed into a slurry, and hydrotransported out of the excavation for further processing. The waste material, or tailings, can be formed into a second slurry at an external location and hydrotransported back into the excavation for use in backfilling. Alternatively, the backfill slurry can be formed from a high proportion of mature fine tailings ("MFTs") from previous surface mining operations and thereby provide for environmentally safe disposal of these wastes. The tailings from the excavated oil sands are processed to remove sand (which is a relatively valuable commodity and/or may be disposed of readily) and the sands replaced in the second slurry formed from MFTs and other less valuable tailings components, such as from both the present and previous mining operations. Surge tanks can be used to handle fluctuations in the slurry volume.

In yet another embodiment, a tunnel boring machine is provided that is particularly suited for use in unstable overburden conditions. As used herein, a "tunnel boring machine" or TBM refers to an excavation machine including one or more movable shields for ground support. Typically, the TBM will be a rotary excavator including a shield, an excavating or cutting wheel and some wheel-driving apparatus. In one configuration, the hood of the forward portion of the movable shield(s) controls overburden and protects the excavation area, the body of the shield(s) houses the working mechanisms and one or more tail shields furnish ground support during the tunnel lining installation. In the typical TBM design, the cutting wheel is designed to perform three main functions: excavating, spoil removal and face support. The TBM can have one or more mining devices at its forward end. Such mining devices can be any suitable ground removal device, such as a rotary cutting head, a hydraulic jet, a shovel, a backhoe, a ripper or any combination of these devices. In the case of a rotary cutting head, an array of drag bits, an array of picks, an array of disc cutters and the like or any combination of cutting tools arrayed on the cutting head may be used. In another configuration, a tunneling machine can also be fully enclosed (a closed face machine) and capable of applying a pressurized slurry at the cutting face to provide, for example, stability to the excavation face. These machines are often referred to as slurry or slime machines or as earth pressure balance machines or as earth pressure balance systems.

In one configuration, the tunneling machine includes two or more shields of different sizes may be used to provide ground support. In one configuration, a large shield (in cross-sectional area) may be located at the front of, over, and/or behind the machine to support the ground over the excavation and backfill operations. A small shield (in circumference) may be located behind the large shield and used to support the ground above the trailing access tunnel until the access tunnel becomes self-supporting or assembled.

In one configuration, the machine includes two or more (typically overlapping) tail shields or tail shrouds, each providing ground support. For example, a backfill tail shield, having substantially the same circumference as the main excavation surface (in the same plane), can extend behind the primary excavation shield to protect the backfill injection apparatus and the backfill volume from loose and falling ground from the unexcavated material. A typically substantially smaller tail shield (in circumference determined in the same plane) can extend behind the primary excavation shield and/or machine bulkhead to provide protect liner fabrication personnel and machinery from loose or falling ground or from previously backfilled material, until the liner has achieved sufficient strength to provide such protection. A binocular tunneling machine may have two large backfill shields and one or more smaller (in cross-section) access tunnel tail shields.

In one configuration, the body member has a plurality of interconnected segments that movably engage one another. In one design, the adjacent segments are interconnected by a plurality of hydraulic jacks or cylinders. The hydraulic cylinders on the trailing section can push against the liner or backfill material to advance the trailing section, thereby more effectively engaging adjacent liner sections and/or compacting the backfill material. In one design, the adjacent segments telescopically engage one another. The machine can have any number of segments including only one, though two or more segments are preferred. The segmentation allows the machine to change direction efficiently and allows the machine to follow the meandering oil sands deposits. In one embodiment, the segmentation also permits the machine to advance, one segment at a time, by the moving segment thrusting against the combined static friction of the stationary segments.

In one configuration, the segmented machine is propelled forward by a combination of soft-ground grippers and thrusting off the backfill material. The grippers can be of any suitable design, as will be appreciated by those of ordinary skill in the art. Soft-ground grippers are typically hydraulically actuated pads that can be thrust out against the sides of the excavation. The pads may be large so as to contact a large area of a soft-ground ore body. Each section or segment of the tunneling machine can further include one or more such grippers for displacing and maneuvering the machine and providing thrust for the mining device(s) at the forward end of the machine. The rear segment of the machine can thrust off the backfill since the cross-sectional area or outer periphery of backfill is approximately the same as the cross-sectional area or outer periphery of the excavation. This form of propulsion also has the advantage of helping to compact and consolidate the backfill.

In segmented designs, the segmented tunneling machine typically advances in an inch worm fashion through the material to be excavated leaving behind a tunnel of suitable shape. For a tunneling machine having at least three segments, the typical steps for advancing the machine are, for example, as follows:

(a) advancing a first section of the tunneling machine forward, wherein the first section is advanced by pushing against an adjacent second section of the tunneling machine;

(b) when the first section is advanced relative to the second section a selected distance, pulling, with the first section, the second section forward and/or pushing, with at least one trailing section, adjacent to the second section, the second section forward; and (c) when the second section is advanced relative to a trailing section the selected distance, pulling with the first and second sections and/or pushing off the backfill material behind the tunneling machine to move at least one trailing section forward.

As will be appreciated, machines have one or two segments can advance using fewer steps than those set forth above.

In one configuration, the TBM includes a global positioning system and/or fibre optic surveying line to continuously determine the position of the machine.

In one configuration, the TBM includes one or more sensing devices for detecting the presence of hydrocarbons or other valuable components or barren ground or shale and calcite lenses and the like or another characteristic in the in-situ material to be excavated, and/or the presence or hydrocarbons or other valuable components material that has been excavated. The sensing devices can use sonar and/or ground-penetrating radar or other short range underground detection technologies to sense the features ahead of the mining machine.

In one configuration, the TBM machine has features permitting the TBM to change direction or steer. Such machines can steer by any number of means or combination of means. For example, a segmented machine can steer by extending and retracting its connecting hydraulic propulsion cylinders by different lengths of extension or retraction around the circumference of the machine. A TBM machine may change direction by differentially extending, retracting and reorienting the cutter tools on its rotary cutting head to assist in steering. The TBM may also steer by articulating its cutting head. The TBM may also deploy large flaps or grippers to create increased drag on the side of the machine so as to cause the machine to steer in that direction. Such maneuverability permits the TBM to mine patterns such as described herein as well as mine around barren ground or around obstacles. As will be appreciated, the above methods of steering may be varied to suit the local conditions and can be combined or used in other configurations or embodiments that may be different from those set forth above.

In one configuration, the tunneling machine has an excavation head configured to form an approximately rectangular excavation cross-section which may be more suited to some ore bodies. A rectangular excavation can be formed by rotary cutting head assemblies in a number of ways which include assembling an array of circular cutter heads, tilting a circular head and using one or more triangular heads that rotate eccentrically by the use of offset planetary gear drives for example. The preferred embodiment for excavating a rectangular opening would incorporate two or more conventional tunnel boring machine heads in a binocular or even trinocular TBM configuration. Such machines have been built and used in various civil tunneling applications.

In one configuration, the tunneling machine is configured to excavate the in situ material by slurry techniques so that the mined material is immediately formed into a format that is compatible with slurry pipeline or hydrotransport methods. In this configuration, the mined material is typically not handled as a solid and thus tends to be less abrasive and cause less wear on any of the materials handling apparatuses.

In one configuration, the tunneling machine includes a hydrocarbon extraction unit, such as a bitumen separation apparatus. The apparatus extracts the hydrocarbons and the extracted hydrocarbons are transported to a surface facility for further processing. In this manner, less material can be transported to the surface, thereby decreasing haulage costs. The waste material, which is still in the excavation area can be used for backfilling as noted previously.

In one configuration, the tunneling machine includes a heat exchange system for absorbing heat from any heat sources in the tunneling machine, such as the propulsion motors and hydraulic cylinders used to move the machine segments, and transferring the absorbed heat to the material in a slurry formed at or near the cutting head, the bitumen processing chamber, personnel compartment, lining material formation units, and/or the hydrotransport system. The heat exchanger can be of any design, as will be appreciated by those of ordinary skill in the art.

In one configuration, the tunneling machine includes a pressurized chamber having a pressure greater than the formation pressure of the unexcavated material to inhibit formation gases such as methane from entering personnel areas. The method can require only a small fraction, typically less than 5% to 10%, of the output crude oil energy, to power the excavation and bitumen recovery process.

In one configuration, the mining machine further includes device(s) for forming tunnel lining sections. Such devices can be forms, lifting devices such as cranes to manipulate the forms or prefabricated liners, injecting assembly for injecting or spraying the backfill material around the liner, asphalt formation machine(s) for forming a lining material, concrete mixing machine(s), machines for extruding cast-in-place liners and the like.

In a further embodiment, a system is provided for collecting formation gases from or injecting waste gases into a formation. The system includes the following:

- a rock bolt assembly, the rock bolt assembly including an internal passageway connected to one or more outlet ports that communicate with an underground formation;
- a gas handling system for transporting gases from or to the rock bolt assembly; and
- a valve assembly engaging the head of the rock bolt assembly and being in communication with the gas handling system, whereby gases are withdrawn from or injected into the underground formation. When the tunneling machine excavates hydrocarbon deposits, it can encounter gas either in the form of free gas contained in structural pockets or in the form of a bound gas dissolved in the formation water and hydrocarbon material. When the excavated volume is exposed to significantly lower pressure such as atmospheric pressure, the dissolved gas will come out of solution and flow towards the excavation. The flow rate will be limited by the local permeability. The rock bolt assembly can be inserted through a tunnel liner and used as conduits for draining formation gas to reduce the pressure on the tunnel liner.

In yet another embodiment, a method for disposing of gases in abandoned excavations is provided. The gases are transported into an underground excavation, such as using the gas handling system described above, and injected into an underground formation accessible through the underground excavation. An extension of the present invention is to use the network of trailing access tunnels as repositories for greenhouse and other noxious gases after they have been abandoned as part of the mining process. In this embodiment, the tunnel liner(s) is/are perforated and the tunnel entrances (both entrance and exit portals) as well as any connections between active tunnels are closed off. The tunnel liners can be perforated in any number of ways. For example, shaped charges can be affixed to the tunnel walls and initiated remotely to perforate the walls. Alternatively, the injecting can be done with a number of properly dispersed rock bolt assemblies. Then, the desired gases can be pumped into the access tunnels under sufficient pressure such at the gases would be slowly injected into the surrounding formation via the tunnel liner perforations.

The foregoing summary is neither complete nor exhaustive. As will be appreciated, the above features can be combined or used in other configurations or embodiments that may be different from those set forth above. For example, one or more of the features can be used in mining processes that do not use the backfill feature. Such other configurations and embodiments are considered to be part of the present invention.

BRIEF DESCRIPTION OF THE DRAWINGS

FIG. 2 shows a schematic side view that illustrates the basic mining process of the present invention.

FIG. 14 shows a sequence of cross-sectional side views of the mining process in which the access liner is formed by adding liner segments and the backfill is added at different intervals.

FIG. 15 shows a sequence of cross-sectional side views of the mining process in which the access liner is formed by adding liner segments and the backfill is continuously deposited so as to leave no empty volume behind the machine.

FIG. 16 shows a sequence of cross-sectional side views of the mining process in which the access liner is formed by continuously forming an extruded liner and the backfill is continuously deposited so as to leave empty volume behind the machine.

FIG. 17 shows front views of various ways in which arrays of rotary cutter heads can be arranged to excavate circular or rectangular openings.

FIG. 36 shows several views a binocular type TBM with dual trailing access tunnels.

FIG. 38 shows an isometric view of the front-end of boring machine that uses a hydraulically actuated shovel/scoop for excavating in relatively soft rock or soil and a combination backhoe/hydraulic hammer attachment that can be used in harder ground.

FIG. 40 shows isometric schematic views of a telescoping slurry pipe apparatus.

FIG. 42 shows a side schematic view of a special rock bolt that penetrates an access tunnel wall and can be used to tap gas from or inject gas into a surrounding formation and an isometric schematic illustrating how such rock bolts can be positioned around an access tunnel.

DETAILED DESCRIPTION OF THE DRAWINGS

The foregoing discussion of the invention has been presented for purposes of illustration and description, the foregoing is not intended to limit the invention to the form or forms disclosed herein. Although the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

Overview of the Method

The method described in the present invention can be adapted to underground mining of deposits that are relatively easy to excavate by known technologies but require ground support behind the advancing machine to avoid cave-ins, surface subsidence or ground heaving. This invention involves, in part, substantially reducing the cross-section of the trailing tunnel with respect to the cross-section of the ground excavated and therefore removes the requirement for expensive ground support while eliminating any significant ground movement of the unexcavated ground. The invention reduces the economics of underground recovery to approximately those of currently practiced open-pit mining operations and possibly less since it eliminates the need to remove overburden and can reduce the size of tailings ponds required.

Figure 1:
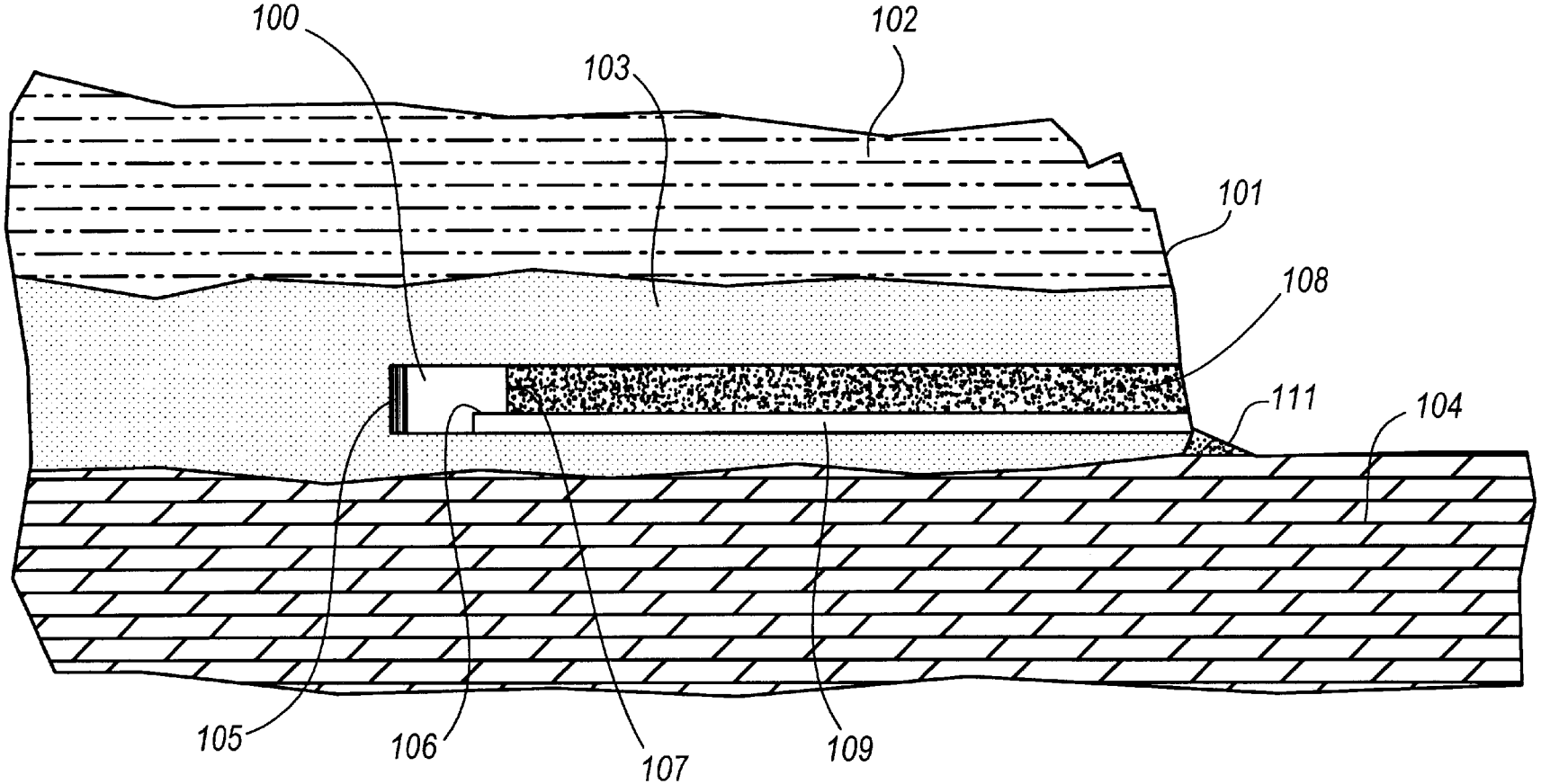
FIG. 1 shows a cross-sectional a view of a mining machine of the present invention excavating a soft ore deposit entering from a prepared face.

FIG. 1 shows a cross-sectional a view of a tunneling machine 100 mining into an oil sand deposit 103 from a prepared face 101 which has been formed by removing overburden material 102 to expose the oil sand deposit 103. The oil sand deposit 103 typically lies on top of a basement rock 104 and under the overburden 102. The mining machine 100 advances and mines into the oil sand 103 by excavating oil sand material 103 through the front end 105 which may be, for example, a rotary cutter head. As the mining machine 100 advances, an access tunnel liner 106 is formed inside the machine 100. As the machine 100 advances, the liner 106 remains in place and is left behind the advancing machine 100. Also as the machine 100 advances, material is deposited as backfill 108 behind the machine 100 through one or more openings 107 in the rear of the machine 100. The backfill 108 surrounds the liner 106 leaving an access tunnel 109. The machine 100, the liner 106 and the backfill 108 all act to support the remaining oil sand 103 and overburden 102 such that there is insignificant motion of the ground surface 110. A ramp 111 which allows the mining machine 100 to position itself in at the entrance portal 112 for the start of its mining drive is also shown.

FIG. 2 illustrates an example of the basic mining machine steps for a three segment mining machine that advances while injecting and compacting backfill material into the volume behind the machine but outside the trailing access tunnel. Injecting backfill material into the volume behind the machine as the volume is created is most preferred because it eliminates the need for temporary ground support behind the aft-most segment as it advances. FIG. 2*a* illustrates the position of the machine at the beginning of a cycle. The forward most segment 200 contains the excavating apparatus at the head 201 of the segment 200. The middle segment 202 may have some form of gripper system (not shown) to maintain its position against the wall 203 of the excavation. The aft most segment 204 is shown in its initial position where the ground 205 behind the segment 204 is completely backfilled. The trailing access tunnel 206 has been installed and connects the surface (not shown) to the aft most segment 204. FIG. 2*b* illustrates how the froward most and aft most segments advance. As the aft most segment 204 is pulled forward by push jacks, for example, connecting it with the middle segment 202, backfill material inside the machine is injected into the volume 207 being created by the advancing aft most segment 204. This process continues until the aft most segment 204 is fully advanced. The aft most segment 204 can also use its push jacks to thrust against the injected backfill material 207 to compact it, if necessary and help propel the aft most segment. As the aft-most segment 204 advances, the access tunnel has been extended to form a new section which is left in place and covered by injected backfill material 207. At or about the same time as the aft most section 204 is advanced, the forward most section 200 advances by push jacks, for example, connecting it with the middle segment 202. As the foremost segment 200 advances, it excavates new ore material 208 using its excavating apparatus in the excavating head 201. After the forward most segment 200 and the aft most segment 204 have completed their advance, the middle segment 202 is moved forward by its hydraulic jacks until the machine assumes the configuration shown in FIG. 2*a*. As shown, the front of segment 200 has advanced a distance 209 and the rear segment 204 has also advanced a distance 209 from the positions indicated in FIG. 2*a* to the positions in FIG. 2*b*. In this way, ore has been excavated, backfill material has been placed and the access tunnel has been extended without significantly disturbing the unexcavated ground. The machine can change direction by differentially extending or retracting its hydraulic jacks in the appropriate manner during the motion of each individual segment.

Figure 3:
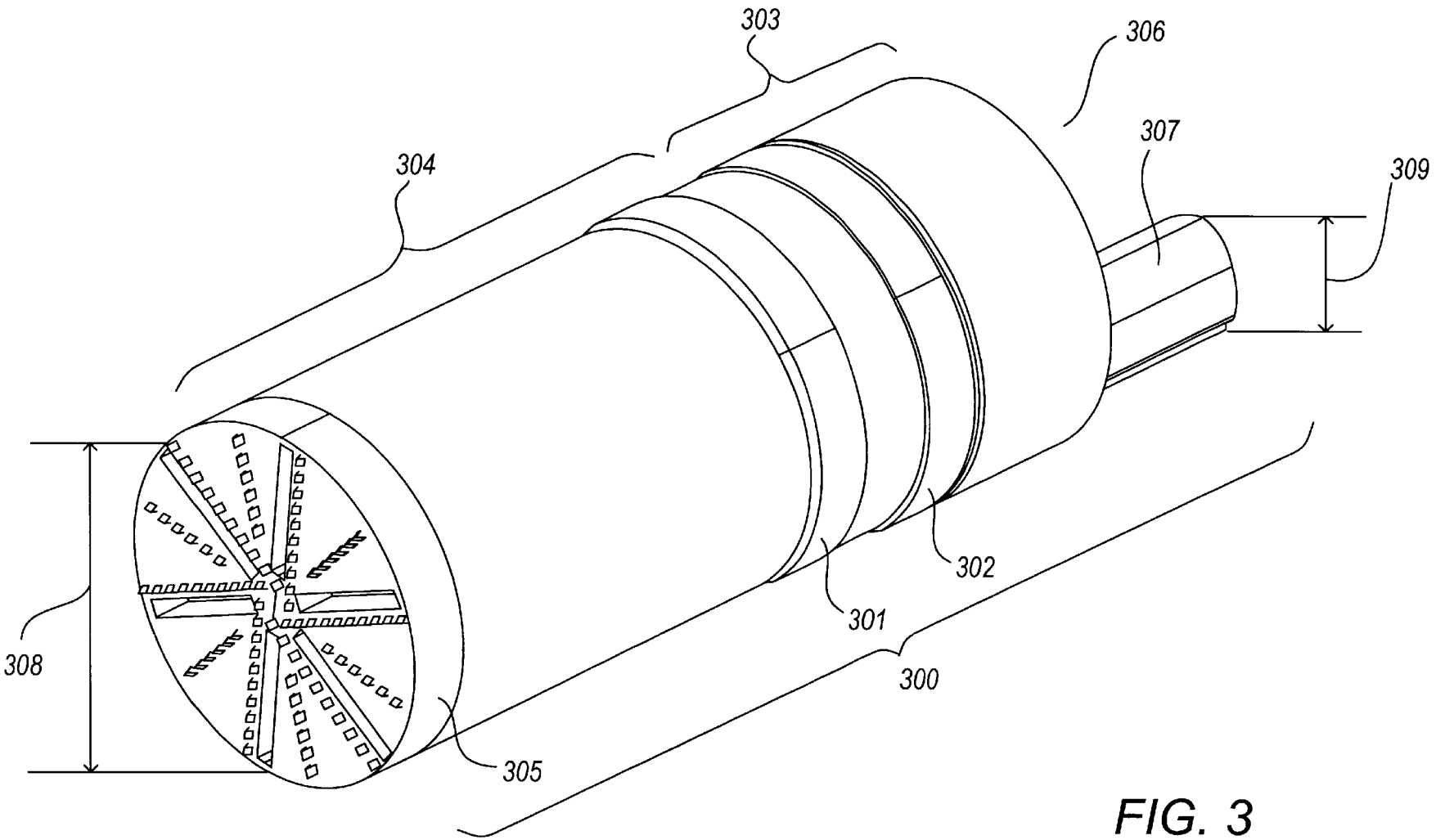
FIG. 3 shows an isometric front view of the mining machine of the present invention illustrating a typical size comparison of the excavation cross-section and the trailing access tunnel cross-section.

FIG. 3 shows an isometric front view of the mining machine of the present invention illustrating a typical size comparison of the excavation cross-section and the trailing access tunnel cross-section. In soft ground or soft rock, tunnel boring machines can be advanced by thrusting against the tunnel liner structure which has approximately the same cross-sectional geometry as the boring machine. In one embodiment of the present invention, only a small tunnel liner is left behind so the machine must be propelled forward by other means. In this configuration, the mining machine may be formed, for example, by two telescoping segments and propelled forward by conventional soft-ground grippers which thrust against the walls of the excavation and by the aft most segment thrusting against the backfill or by a combination of both means of propulsion. In the present invention, it may be necessary to use large soft-ground grippers to provide machine propulsion and cutter head thrust as (1) the only means of propulsion and thrust; or (2) as the principal means of propulsion and thrust where the machine can also thrust against the backfill when additional propulsion and thrust are required; or (3) as an auxiliary means of propulsion and thrust where the principal means of propulsion and thrust are against the backfill. This combination of propulsion and thrust techniques allows the backfill operations to be decoupled from the propulsion and cutter head thrust. This combination also allows the backfill to be compacted separately from propulsion and cutter head thrust.

FIG. 3 shows an example of a tunnel boring mining machine 300 that can be propelled by using external grippers 301 and 302. The rear section 303 of the machine is shown with full circumferential grippers 302 that grip by being pushed out against the excavation walls, usually by hydraulic rams. When the rear section 303 grippers 302 are pushed out against the excavation walls, the forward section 304 of the machine, which includes the cutter head 305, can thrust forward by pushing against the rear section 301. Once the forward section 304 is fully or almost fully extended, then the retracted grippers 301 on the forward section 304 can be pushed out against the excavation walls while the grippers 302 on the rear section 303 are retracted. Now, hydraulic cylinders inside the machine (not shown) can retract and draw the rear section 303 of the mining machine forward. This is an example of a propulsion cycle for a two segment machine. As noted previously, the rear section can also thrust off the backfill 306 behind the machine and around the trailing access tunnel tail shield 307, if necessary. The diameter 308 of the mining machine 300 is typically in the range of about 10 to about 20 meters. The trailing access tunnel tail shield 307 is much smaller in cross-sectional area having a typical dimension 309 in the range of about 2.5 to about 4 meters.

Figure 4:
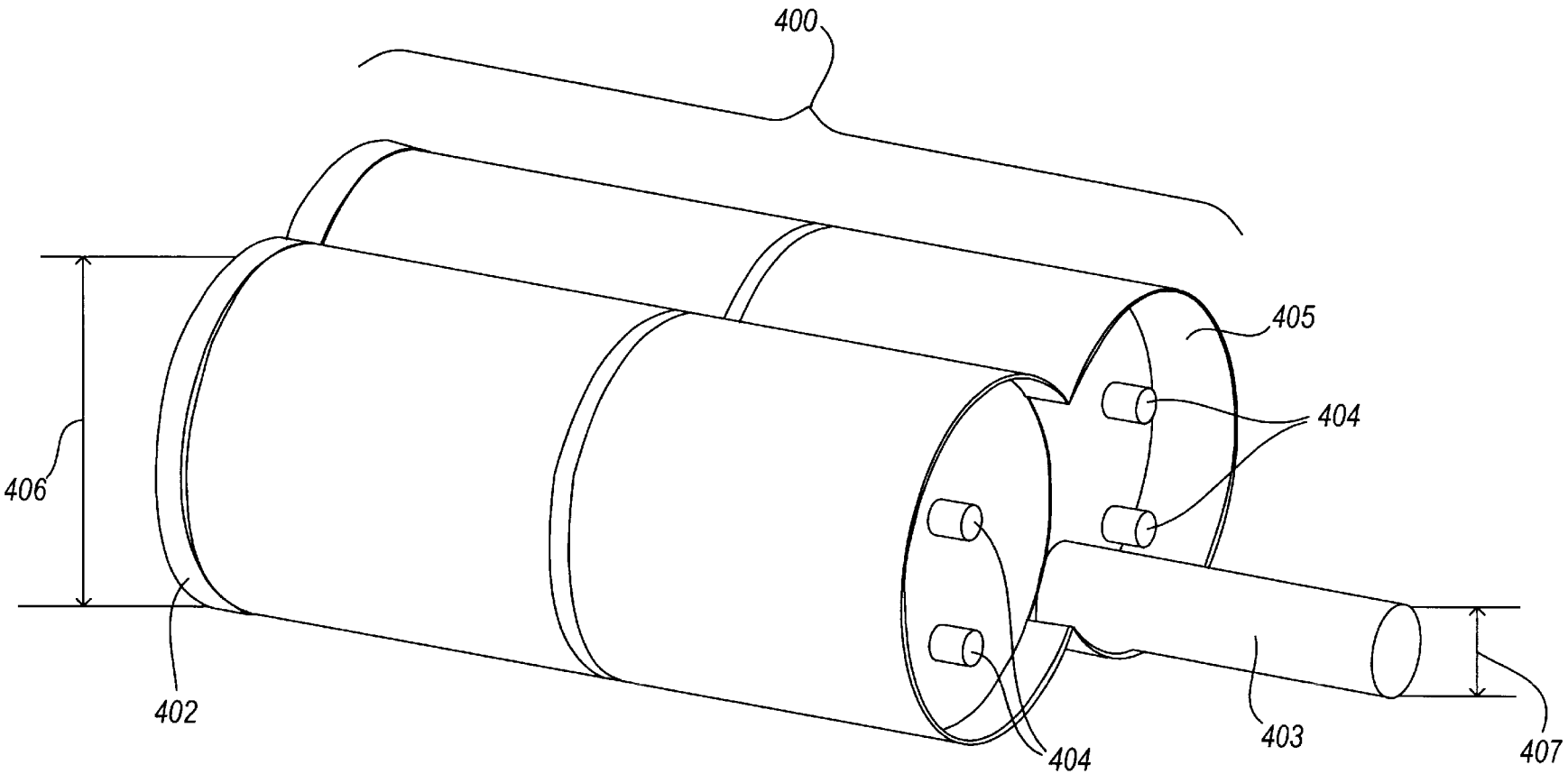
FIG. 4 shows an isometric rear view of a large excavating machine with two rotary cutter heads that can excavate a roughly rectangular excavation opening and leave a small trailing access tunnel.

FIG. 4 shows an isometric rear view of a large excavating machine 400 with two rotary cutter heads 401 and 402 that can excavate a roughly rectangular excavation opening and leave a small trailing access tunnel. The rotation of the cutter heads 401 and 402 may synchronized so that the areas excavated by each have some overlap. The cutter heads 401 and 402 may also be counter rotated to substantially reduce the tendency of the machine 400 to roll. The smaller cross-section trailing access tunnel tail shield 403 is shown extending from the rear of the advancing machine. As an example, four backfill or spoil discharge pipes 404 for injecting backfill material in the volume behind the advancing machine are shown protected from falling ground from above by a large tail shield 405. The trailing access tunnel liner is formed inside the machine 400 and protected from falling ground and backfill material by the smaller tail shield 403. The diameter 406 of one of the cutter heads of the mining machine 400 is typically in the range of about 7 to about 15 meters and the cross-sectional area excavated by the machine 400 is therefore about twice the cross-sectional area of one cutter head. The trailing access tunnel tail shield 403 is much smaller in cross-sectional area having a typical dimension 407 in the range of about 2.5 to about 4 meters.

Figure 5:
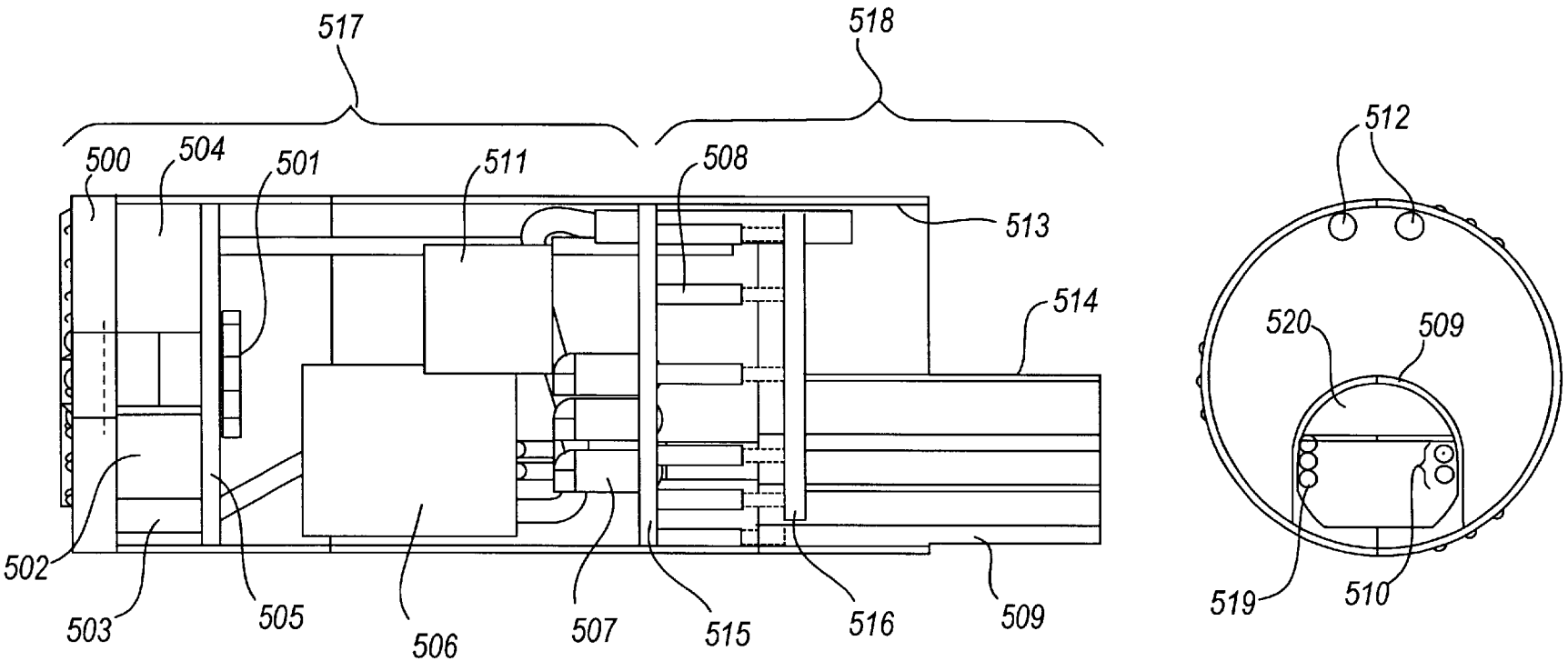
FIG. 5 shows a side view of a possible layout for the principal interior components of a TBM mining machine in which the excavated material and backfill material are isolated from the personnel in the interior of the machine.

FIG. 5 shows a possible layout for the principal interior and exterior components of a TBM mining machine of the present invention. The cutter head assembly 500 is driven by a main cutter head motor (not shown) through a main bearing 501. The cuttings are directed into a crusher 502 and then into a muck chute 503 which may be housed in a pressurized chamber 504. The muck chute 503 goes through a bulkhead 505 and into a large enclosure 506 which may be a bitumen separator or a surge tank or an apparatus for forming an oil sands slurry. Also shown are hydraulic cylinders 507 for propulsion and steering and electric motors 508 for power. The oil sand ore or bitumen is sent out of the access tunnel 509 via a slurry pipeline 510. The backfill material, whether produced in the machine by a bitumen separator apparatus or externally and hydrotransported into the machine via a slurry pipeline 510, is sent to a de-watering apparatus 511 where the de-watered backfill material is transported to discharge pipes 512 for backfilling the volume inside the large tail shield 513 and around the small tail shield 514 in which the access tunnel liner 509 may be formed. In this configuration, the hydraulic cylinders 508 can be used to push or pull the interior bulkhead 515 with respect to the rear bulkhead 515. The cylinders 508 may pull the rear bulkhead 516 forward to allow backfill material to be discharged and to advance the rear segment 518 of the mining machine. The cylinders 508 may push against the rear bulkhead 516 to compact the backfill material and to advance the forward segment 517 of the mining machine. The rear cross-sectional view also shows utility lines 519 (water, electrical, sewage for example) and a ventilation duct 520.

Mining Patterns

The foregoing has illustrated the basic soft-ore mining process of the present invention. The next series of drawings illustrate how the soft-ground mining machines of the present invention may mine ore deposits that are either accessible from the surface or may have to be accessed from an underground cavern or the like formed to allow the machines to mine deeper ore deposits.

In one embodiment, a machine or machines are provided to excavate a pattern that can mine out a volume of oil sands deposits that is approximately 1,600 meters by 1,600 meters for example. In general, the height of the excavating machine will be considerably less than the depth of the economically recoverable deposits. The machine envisioned will be capable of mining out one or more levels. By combining the patterns of excavation described below and machines that can excavate adjacent or nearly adjacent openings, the method can process from about 75% to about 95% or more of the economically viable oil sands deposits. The method is not restricted to square or rectangular areal deposits. The method can be applied to large irregular deposits by fitting a pattern of adjacent runs as long as each run is compatible with the turning radius of the mining machine. The length of an individual mining drive can be increased as the ability to extend utilities and provide maintenance services improves with time and experience.

In one configuration, a machine begins a run at an accurately known position by global positioning satellite (GPS) techniques, for example. The required positional accuracy is about 1 to 3 meters which is within currently available GPS technology. During the run, the position of the machine can be continuously updated by using a fibre optic surveying line that is maintained along the access tunnel behind the machine and by an on-board gyroscopic inertial guidance system. The machine can sense the geology ahead of its advance by using an acoustic imaging system capable of mapping the geology at a range of approximately 20 to 100 meters. The acoustic imaging system would be based on an active acoustic source, sensitive acoustic receivers, and data inversion software that translates the return pulses into a rough image of the geology. The acoustic system would operate in the frequency range of approximately 50 Hz to about 500 Hz. Accurate knowledge of the machine's position and of the local geology of ahead of the machine should allow the operator's to excavate and mine areas of economic deposits as determined by prior surface exploration. Such surface exploration using seismic surveys, core hole and acoustic imaging methods is carried out for all methods of recovery, including open-pit, and is not an activity that is specifically required by the present invention. Ground penetrating radar technology can also be used to sense the geology ahead of the advancing machine. A practical ground penetrating radar system suitable for the present invention can resolve features as small as ¼ meter in typical dimension.

Figure 6:
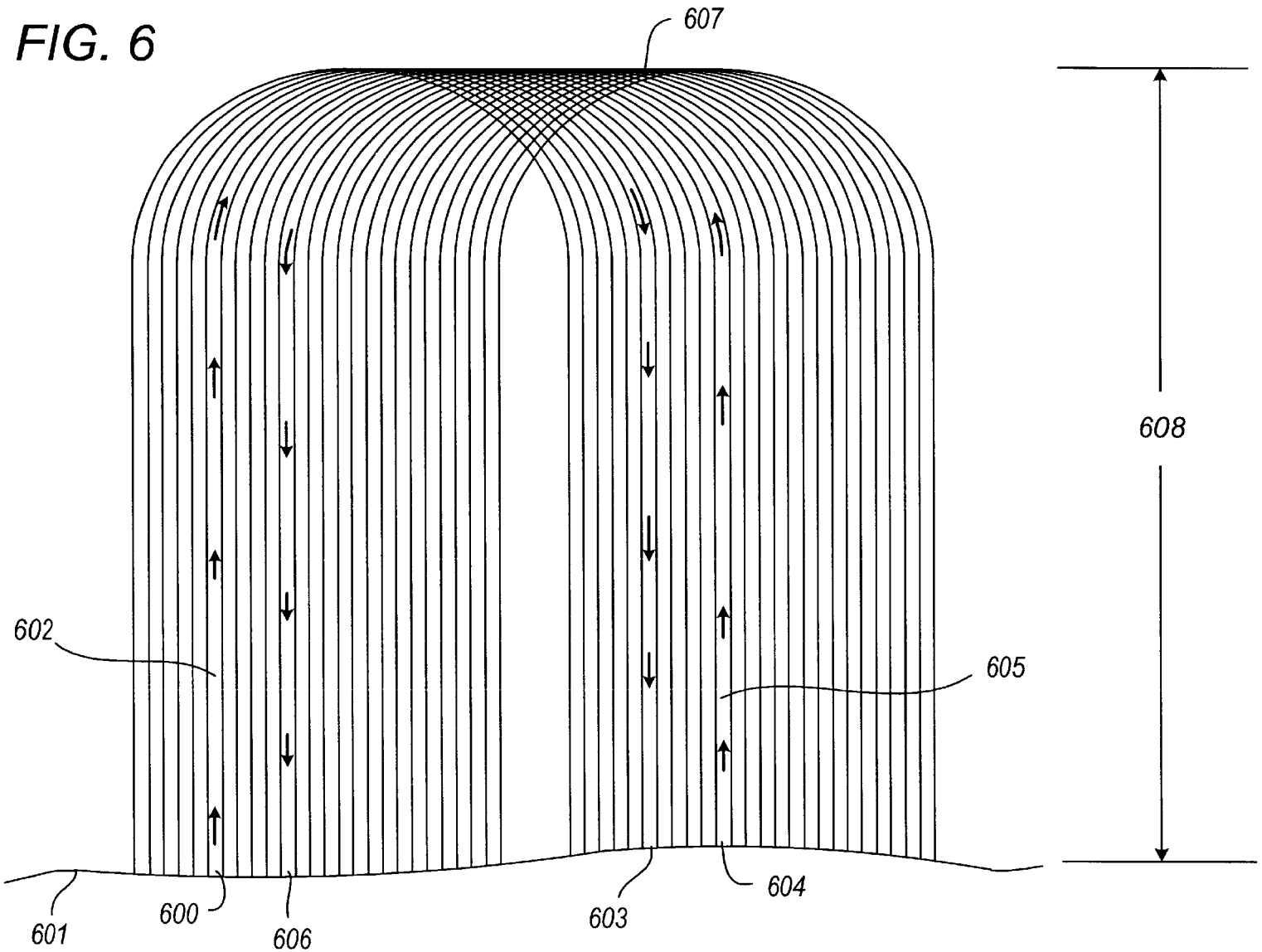
FIG. 6 shows plan view of a mining pattern applicable to a high wall entry for a large mining machine.

A proposed excavation pattern that can be applied to a large square section of oil sands deposits by a large excavating machine is illustrated in the plan views of FIG. 6. A mining drive is started from a portal 600 at an exposed face 601 and may follow an approximately U shaped or horseshoe shaped path such as 602 and exit at another portal 603. The machine can then be bought out and overhauled in preparation for the next mining drive. The next drive may begin at any desired location and in any desired direction, such as for example, at portal 604 along path 605 and exiting at portal 606. It may be preferable to do subsequent mining drives that are not adjacent so that the backfill material from a mining drive has as long a time as possible to become consolidated before an adjacent mining drive is conducted. The pattern described herein would be conducted at one level of the ore body and, as more drives are made, the mining machine would have to excavate through old access tunnels or maneuver around or over the abandoned access tunnels at the outer limit 607 of the area to be mined. The mining machines of the present invention may excavate through old access tunnels, preferably if these abandoned access tunnels are filled with old tailings or some other material that could be excavated and the tunnel liners were formed from a material such as unreinforced concrete. The advantage of this type of pattern is that most of the ore deposit can be mined. A typical dimension 608 for this pattern is in the range of approximately 500 meters to 5,000 meters.

Figure 7:
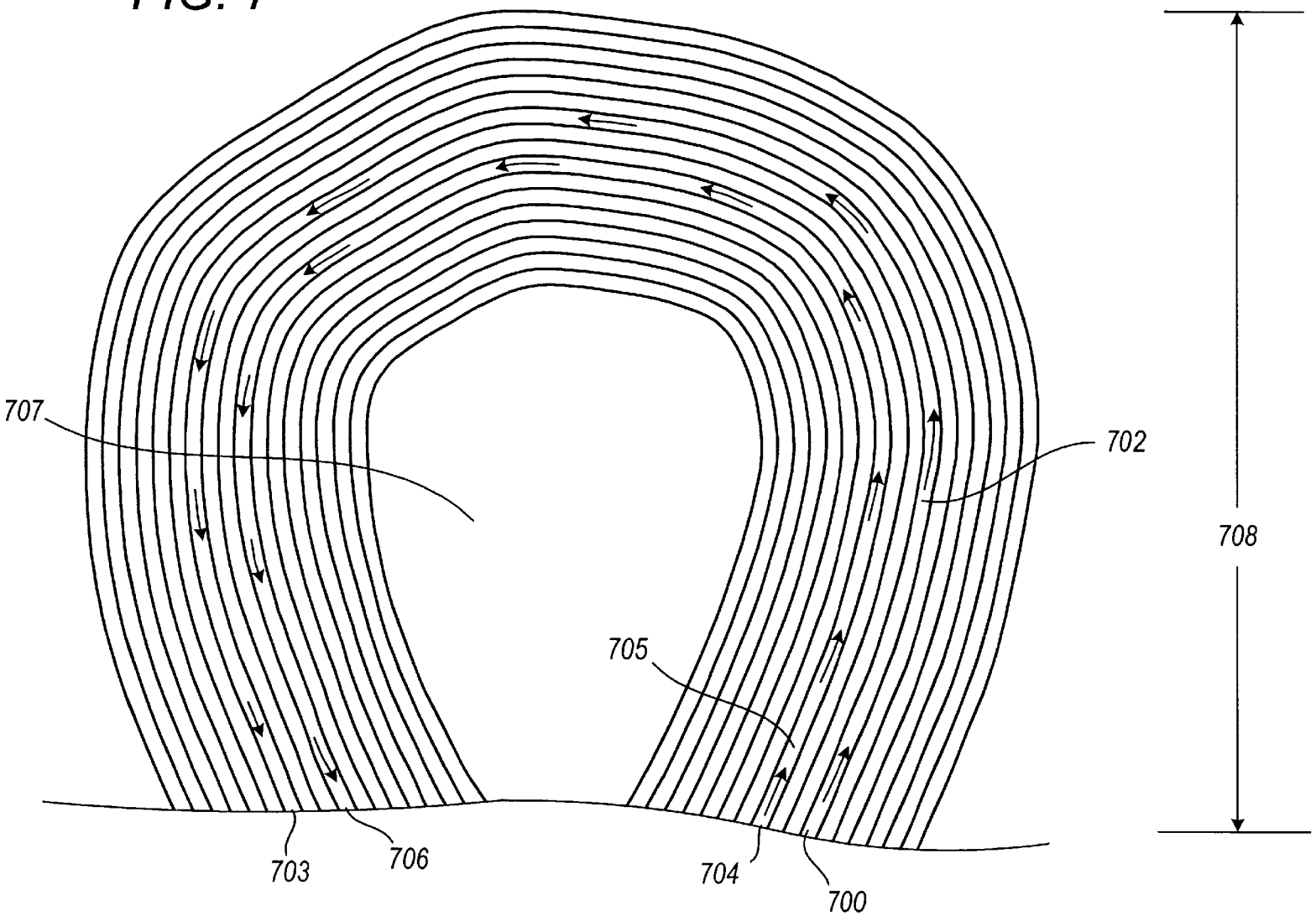
FIG. 7 shows plan view of an alternate mining pattern applicable to a high wall entry for a large mining machine.

FIG. 7 shows plan view of an alternate mining pattern applicable to a high wall entry for a large mining machine. A mining drive is started from a portal 700 at an exposed face 701 and may follow an approximately circular or oval or similarly shaped path such as 702 and exit at another portal 703. The machine can then be bought out and overhauled in preparation for the next mining drive. The next drive may begin at any desired location and in any desired direction, such as for example, at portal 704 along path 705 and exiting at portal 706. The advantage of this type of pattern is no mining drives overlap and there is no need to excavate through old abandoned access tunnels. There may be some of the ore body 707 that cannot mined by this patten because of limitations on the turning radius of the mining machine. This pattern may be used if the area 707 contains, for example, lower grade ore or barren ground or a free gas deposit or the like. A typical dimension 708 for this pattern is in the range of approximately 500 meters to 5,000 meters.

Figure 8:
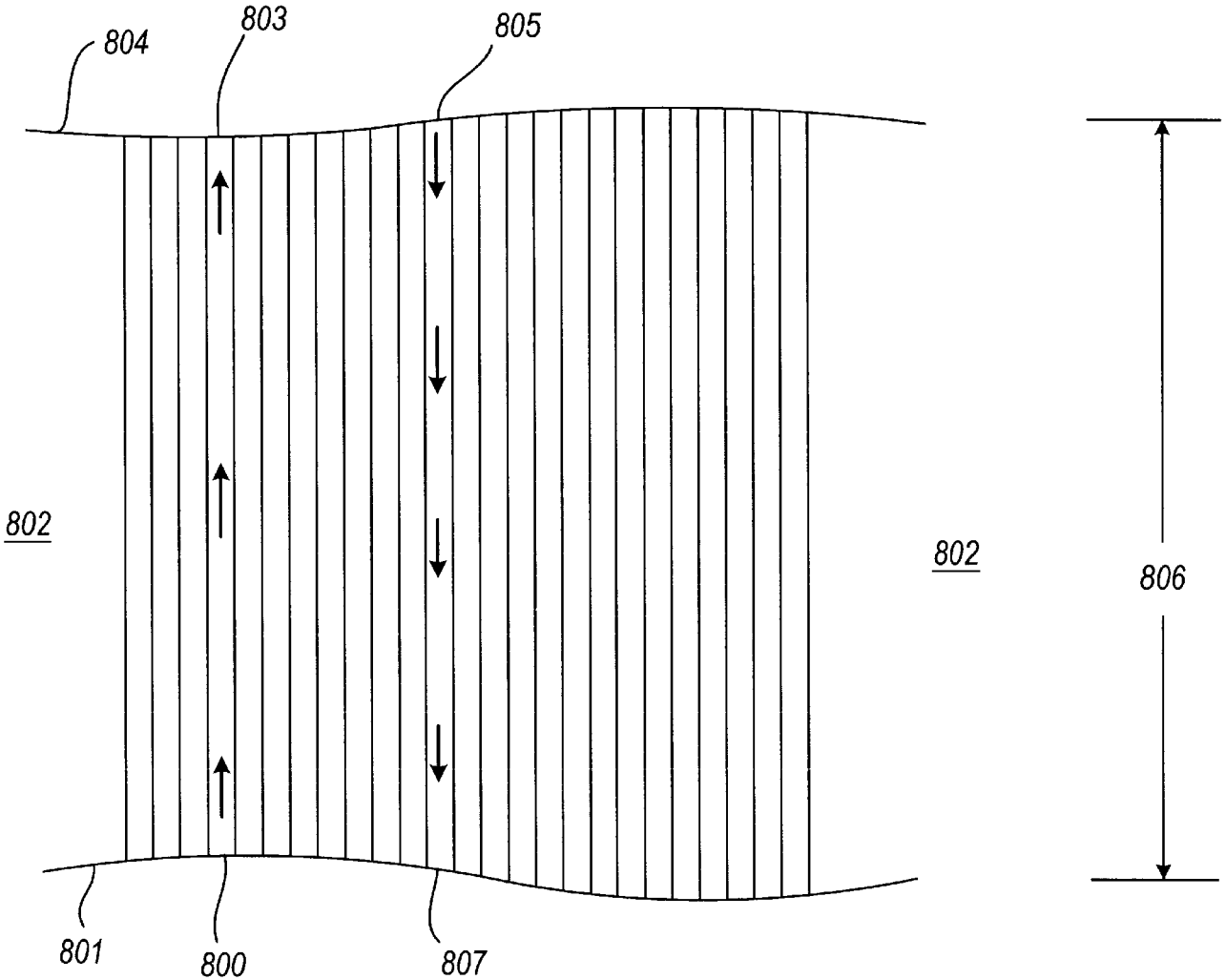
FIG. 8 shows a plan view of a mining pattern applicable to a deposit that can be entered from either side.

In certain situations, the present invention can be used to mine under a low hill or heavy overburden area that can occur, for example, within the boundaries of an otherwise surface mineable area. In these cases, the mining pattern can include a series of adjacent straight runs where the mining machine of the present invention enters through a portal on one side of the formation and exits through a portal on the other side of the formation. This would allow the mining machine to be turned around outside the portals and would avoid the need for the machine to make turns underground. A similar mining pattern can be used to mine under large tailings pond complexes or swampy areas which overlies economic grade oil sands deposits. FIG. 8 illustrates a possible mining pattern that can be used to mine under a surface impediment (in general an obstruction to surface mining techniques). In such cases, the mining machine could enter at a portal 800 on one side 801 of the obstruction 802, mine under the obstruction 802 and exit at a portal 803 on the opposite side 804 of the obstruction 802. Once the excavating machine exits the obstruction 802, it may be turned around by various means and positioned to enter another entrance portal 805 preferably not adjacent to the exit portal 803. The machine then completes its return run exiting at a portal 807. This procedure eliminates the need for the mining machine to make any large turns while underground such as would occur for example in the mining patterns originating from a single working face, other than turns to perhaps avoid zones of barren material or difficult ground conditions. The mining pattern of FIG. 8 may be implemented by entering and exiting through any adjacent tracks or nonadjacent tracks depending on the condition of the backfill material, geological, operational or any other considerations. A typical dimension 806 for this pattern is in the range of approximately about 500 meters to 10,000 meters.

If excavation proceeds from an existing open-pit operation, then an individual run can start and end at portals located at the surface. New mining operations in shallow deposits can also be initiated by excavating a large surface cut to allow the mining machines of the present invention to gain access to the ore deposits. For deposits that are deeper underground, the machines may have to be assembled underground in a large excavated area or cavern, accessed by one or more large shafts or declines. Once the underground staging cavern has been completed, machines can be assembled and be used to execute an excavation pattern identical to that shown in FIGS. 6, 7 and 8 with each run ending in the underground staging area.

Figure 9:
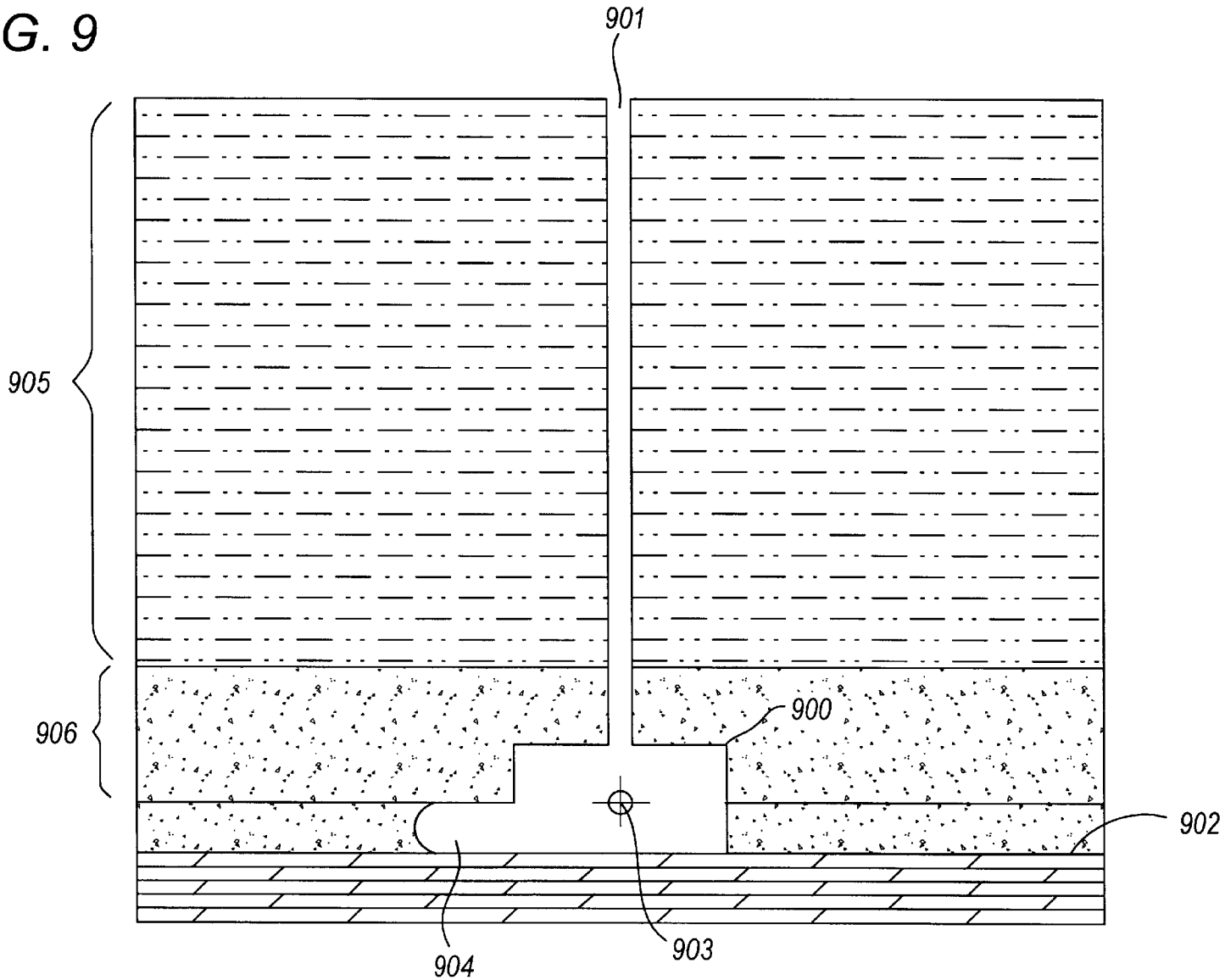
FIG. 9 is an end view of a fully supported cavern used as a staging area for deposits not accessible from the face of an open-pit or a high wall entry.

FIG. 9 shows an end view of an underground staging cavern 900. To construct the cavern, an access shaft 901 is sunk from the surface to, for example, through the overburden 905 and the ore deposit 906 to the bottom 902 of the oil sands deposit 906. A cavern can then constructed at the bottom of the shaft, sufficient in size to assemble a mining machine of the present invention. The mining machine can then be used to form a full-diameter lined cavity by excavating along an axis or line 903 that bisects two sections to be mined. The mining machine may then turn 180 degrees and return back along the line adjacent to the outward run. Alternately, a second shaft and cavern can be formed and a second machine can be assembled to form the adjacent lined cavity. When completed, the parallel, lined cavities can be connected to form a single large cavern 900 along the boundary of the area to be mined. Once this large cavern 900 is completed, mining machines can be assembled and can begin excavating the oil sands deposits by forming an entrance portal 904 perpendicular to the staging cavern axis. The mining machines can excavate a pattern such as shown in FIGS. 6 and 7, returning to the cavern by forming an exit portal also perpendicular to the axis of the staging cavern. Alternately, the mining machines can excavate by a series of more or less straight runs such as shown in FIG. 8 where the machines mine from the cavern 900 to a similar cavern (not shown) excavated at the other side of the ore body to be mined.

Figure 10:
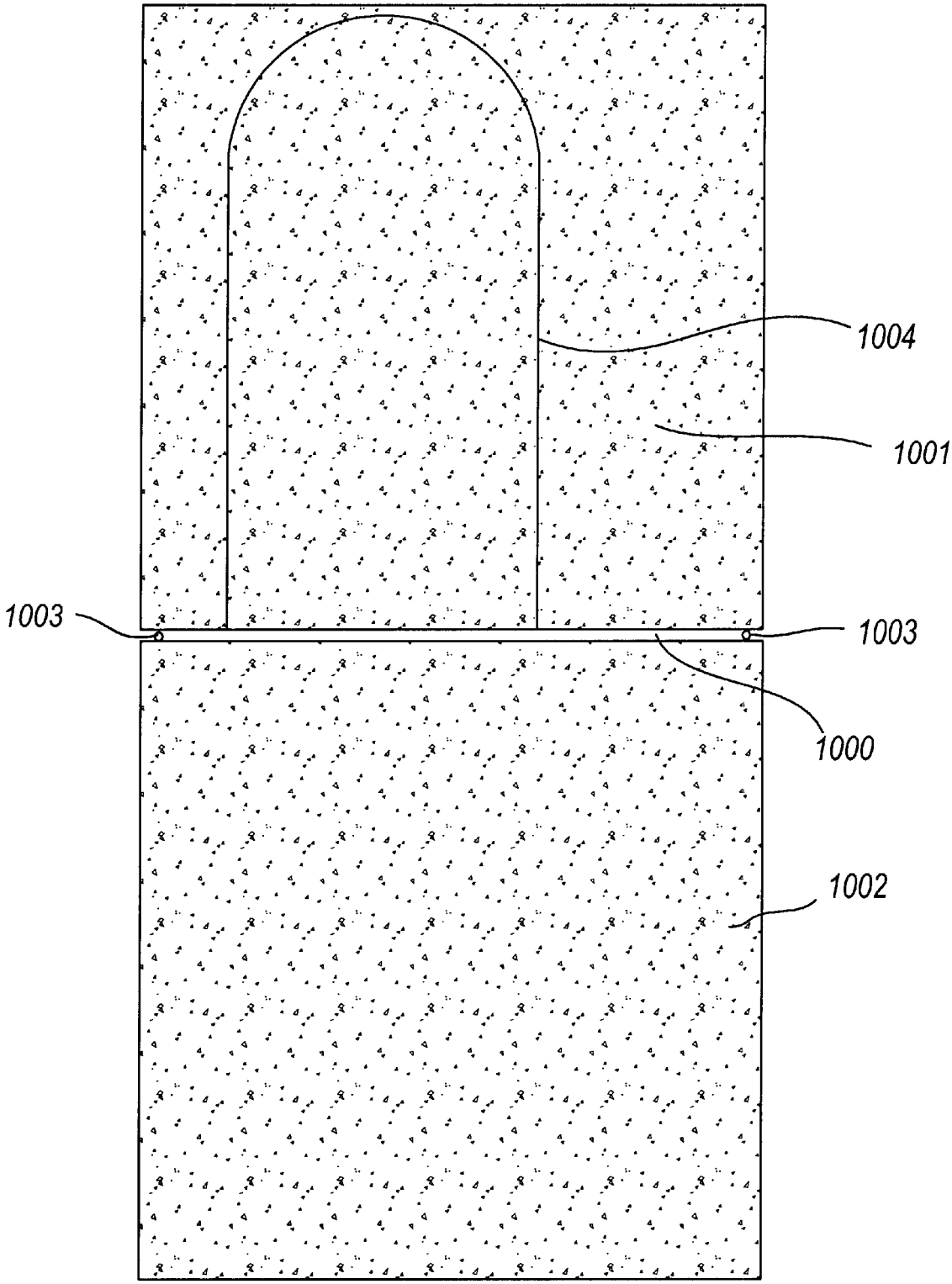
FIG. 10 is a plan view of a feasible underground staging area for machines to excavate a mining pattern similar to those patterns applicable to a high wall entry.

FIG. 10 is a plan view of a feasible underground staging area for machines to excavate a mining pattern similar to those patterns applicable to a high wall entry. Here, a large underground cavern 1000 is constructed along a line that bisects two sections 1001 and 1002 of oil sands deposits or leases to be mined. The cavern is connected to the surface via one or more access shafts 1003 or declines. In this configuration, the ore deposits in sections 1001 and 1002 can both be mined from a single cavern 1000. A typical mining drive trajectory 1004 is shown, although other mining patterns can be used.

Figure 11:
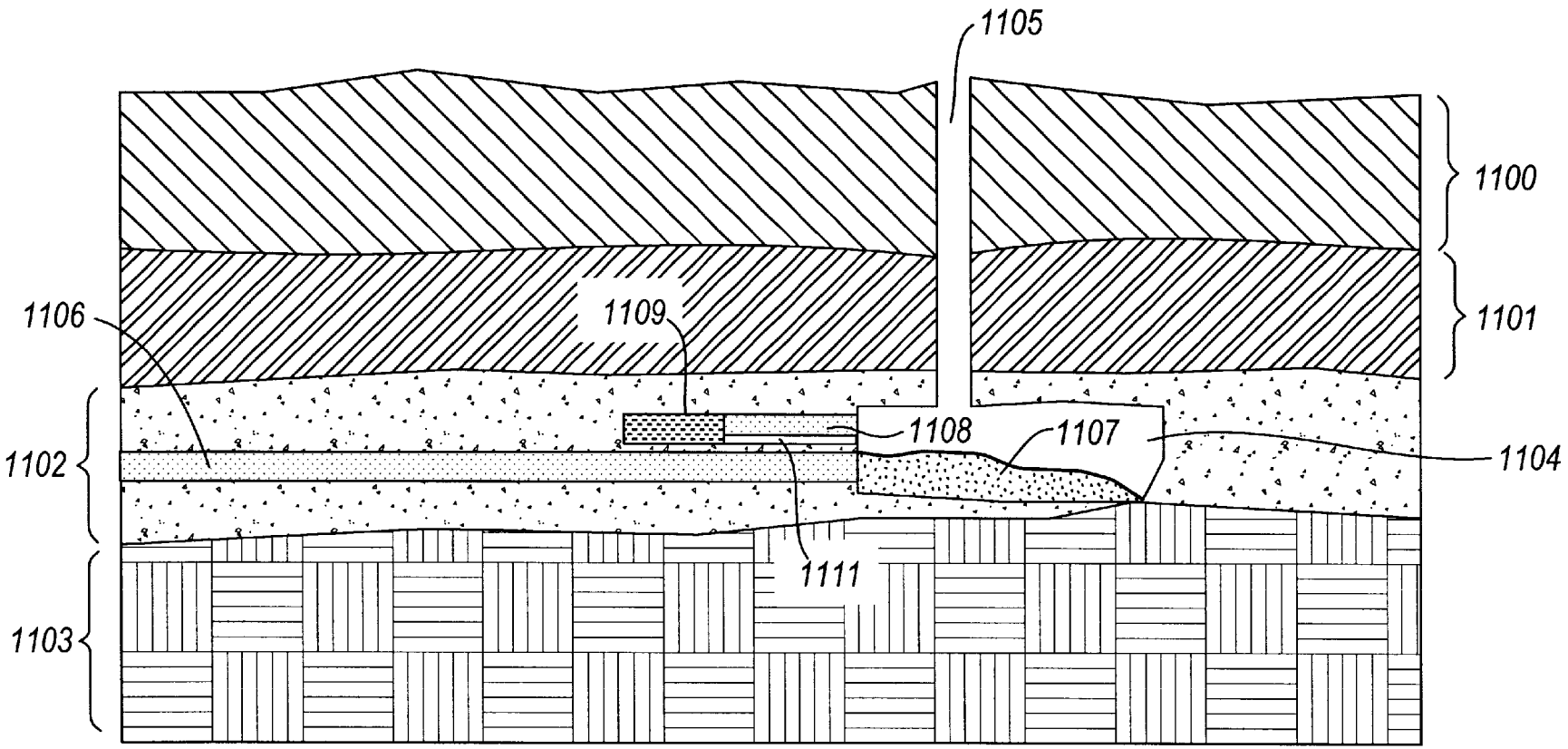
FIG. 11 shows a side view depicting how mining patterns can be applied to different levels of an underground deposit.

FIG. 11 illustrates how mining patterns can be applied to different levels of an underground deposit. Two layers of overburden 1100 and 1101 are shown overlying an ore deposit 1102 which, in turn, overlays a basement formation 1103. An underground staging cavern 1104 and an access shaft 1105 are shown. Also shown is a previous level of mined ore that has been replaced by backfill 1106. To mine out the next level, additional earthen or rock material 1107 has been placed on the cavern floor to provide a platform for mining drives 1108 carried out by a mining machine 1109 on the new level. A small trailing access tunnel 1110 is shown behind the mining machine 1109. The method of depositing material to serve as a platform for mining various levels of an ore deposit can be used any number of times and can also be applied to mining various levels accessed at the surface from a high wall entry.

Figure 12:
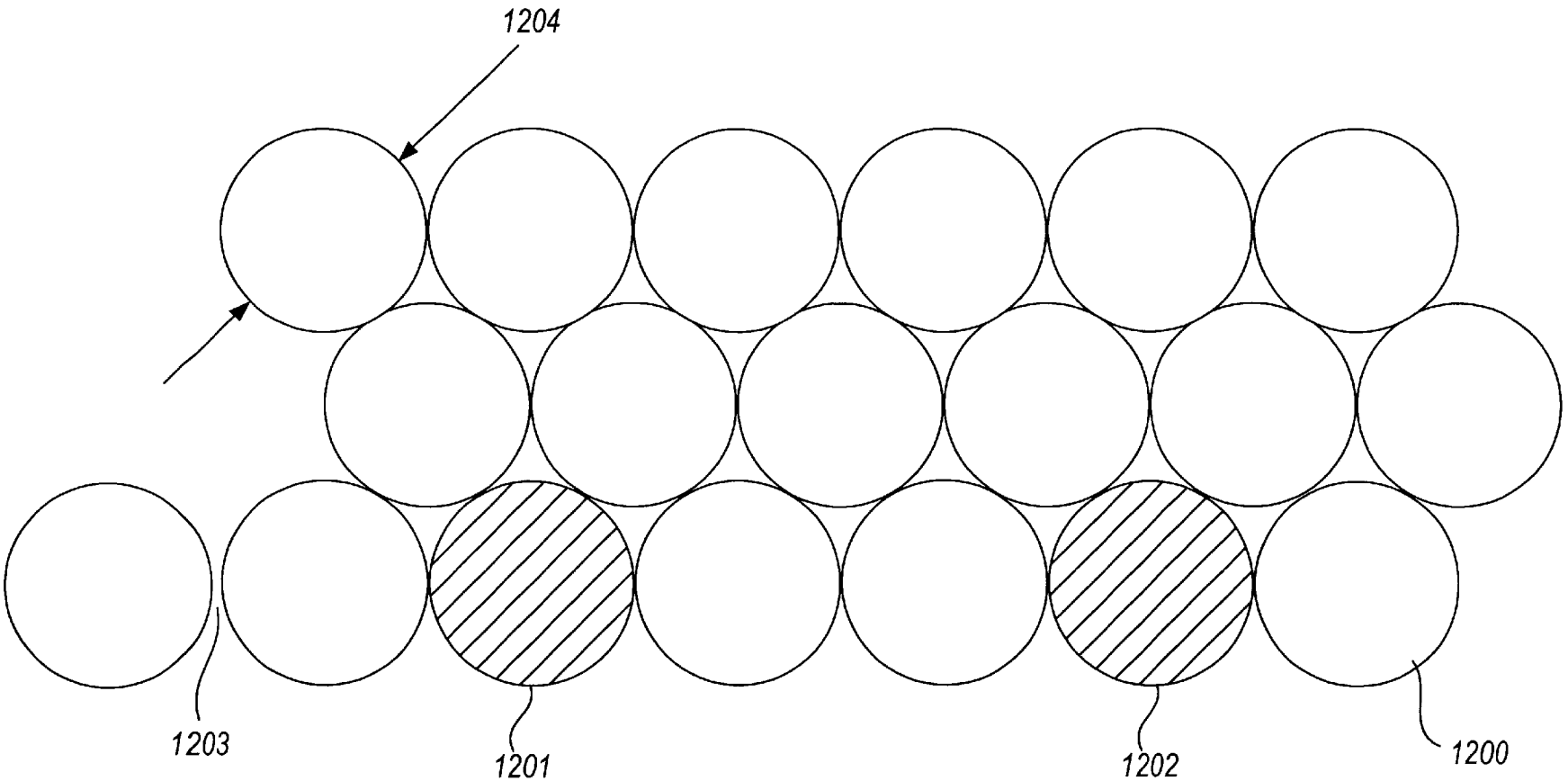
FIG. 12 shows a front view illustrating the most efficient method of configuring adjacent mining drives using cylindrical TBMs.

It is possible to control the positioning of a large TBM with high accuracy, so it is also possible to achieve a higher recovery rate by nesting adjacent drives using a cylindrical tunnel boring machine adapted for mining. FIG. 12 illustrates the most efficient system of configuring adjacent mining drives using cylindrical machines. FIG. 12 shows a head-on cross-sectional view of adjacent drives 1200 such as would be formed by a cylindrical mining machine. The adjacent drives are nested so as to maximize the amount of ore recovered while not excavating previously backfilled material. The drives may be made at widely different times in order to allow the backfill from each drive to become sufficiently consolidated so that an adjacent drive can be made without leaving a large unmined area to act as a retaining wall or pillar. As an example, a drive 1201 may be made first. The next drive 1202 may be made sufficiently far away from drive 1202 so that the unmined ground will serve as a stable wall between these drives. It is also possible to leave an unmined area 1203 to serve as a retaining wall between adjacent drives. The timing, location and spacing between adjacent mining drives is dictated in large part by the nature of the backfill material. If the backfill consolidates quickly with some strength and approximately the same density as the unmined ore, then adjacent drives can be made shortly after completing the neighboring drive. If the backfill does not consolidate well, the range of spacing 1203 between adjacent drives may be in the range of approximately 0.25 to 2 diameters 1204.

As will be appreciated, a bitumen separator apparatus in the machine can bring about bitumen separation by any of several techniques. For example, the separator can utilize the Clark process in which caustic is added to an agitated hot water slurry (approximately 80 C.) of the oil sands with the bitumen separation completed by flotation processes. Other methods eliminate the addition of caustic and use greater amounts of mechanical agitation at a lower water temperatures to separate the bitumen.

Mining Process

The backfilling operations envisioned by the present invention can be carried out in a number of ways. In one configuration, the aft most section of the machine may be advanced creating a free volume behind the machine and under the large tail shield. In this case, previously place backfill may slump into this volume. Thereupon, backfill material may be injected or otherwise placed into the volume behind the advancing machine. The erection and extension of access tunnel liner segments or extrusion of a cast-in-place liner can take place independently of the backfilling process. The following drawings illustrate three variants on the method of the present invention.

Figure 13:
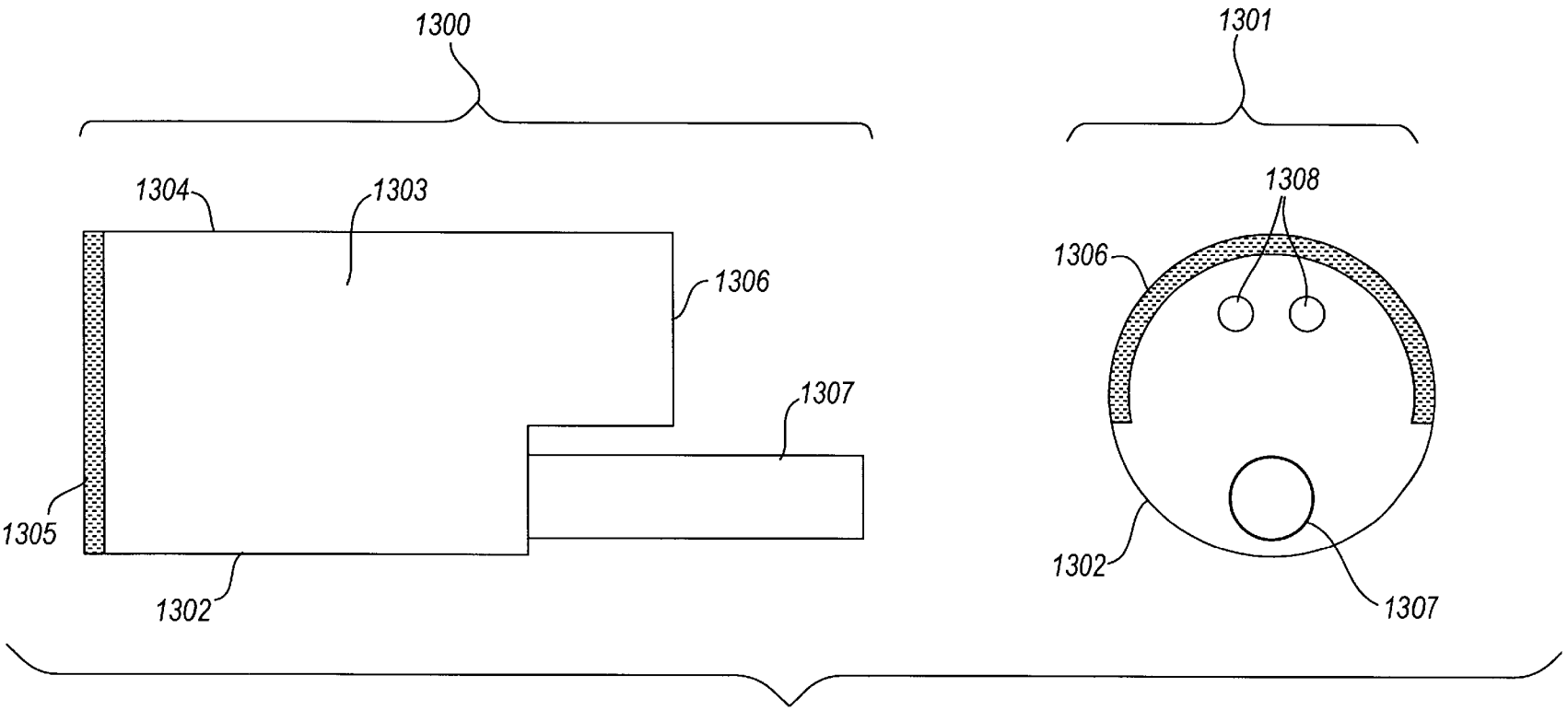
FIG. 13 shows a side view and a rear view of a mining machine typical of the present invention illustrating a large backfill tail shroud and a small access tunnel tail shroud.

The following drawings illustrate more details of the mining method and means of the present invention. FIG. 13 shows a side view and a rear view of a mining machine typical of the present invention illustrating a large backfill tail shroud and a small access tunnel tail shroud. FIG. 13 shows a side view cross-section 1300 and a rear view cross-section 1301 of a generic mining machine 1302 that is part of the present invention. The machine includes a primary ground support shield 1303. The top portion of the shield 1304 is called a hood and controls the overburden and protects the excavation area. The body of the shield 1303 houses the working mechanisms of the machine including the means of excavation 1305 at the front of the machine 1300. The shield 1303 may be extended past the rear of the machine to form a tail shield 1306 which can protect the rear of the machine during the backfilling operations. The machine 1300 may also include a substantially smaller (in cross-section) liner tail shield 1307 which furnishes ground support during the installation process for an access tunnel liner. Preferably, the cross-sectional area enclosed by the liner tail shield (in the plane of the page) is no more than about 30%, more preferably no more than about 20%, even more preferably no more than about 10% and most preferably ranges from about 5% to about 10% of the cross-sectional area (in the same plane) of the area enclosed by the large tail shield (which includes the area enclosed by the liner tail shield). In the rear view, the muck discharge ducts 1308 are shown. These ducts 1308 expel backfill material into the excavated volume behind the machine as the back section of the machine is advanced.

FIG. 14 shows a sequence of cross-sectional side views of a possible mining process in which the access liner is formed by adding liner segments and the backfill is added at different intervals. In FIG. 14*a* the mining machine 1400 is shown with a cutting head 1401 and an internal apparatus 1402 for depositing backfill material 1403 through a rear bulkhead 1404 into the volume behind the machine 1400. A liner tail shield 1405 is shown in which pre-cast tunnel liner segments 1406 are assembled. In FIG. 14*b*, the front of the machine 1400 advances pulling the backfill apparatus 1402 and the liner tail shield 1405 along with it but not far enough to uncover the last pre-cast liner segment 1406. The rear of the machine 1400 remains in place along with the rear bulkhead 1404. In FIG. 14*c*, the rear of the machine 1400 and the rear bulkhead 1404 are moved forward, causing some of the backfill material 1403 to slump into the volume created by the moving rear bulkhead 1404. During this part of the cycle, two additional liner segments 1406 are installed under the liner tail shield 1405. In FIG. 14*d*, the backfill apparatus 1402 deposits backfill behind the rear bulkhead 1404 to fill up the volume behind the machine 1400. The machine 1400 in FIG. 14*d* has advanced and is in the same state as in FIG. 14*a* except that two additional liner segments 1406 have been added. FIG. 14*e* is a repeat of FIG. 14*b* in which the front end 1401 has again advanced. The liner segments 1406, if used, may be formed from any standard concrete based on portland cement or it may utilize other materials such as fly ash, sawdust or even mature tailings paste or bitumen to reduce tunnel liner costs.

FIG. 15 shows a sequence of cross-sectional side views of the mining process in which the access liner is formed by adding liner segments and the backfill is continuously deposited so as to leave no empty volume behind the machine. In FIG. 15*a* the mining machine 1500 is shown with a cutting head 1501 and an internal apparatus 1502 for depositing backfill material 1503 through a rear bulkhead 1504 into the volume behind the machine 1500. A liner tail shield 1505 is shown in which pre-cast tunnel liner segments 1506 are assembled. In FIG. 15*b*, the front of the machine

1500 advances pulling the backfill apparatus 1502 and the liner tail shield 1505 along with it but not far enough to uncover the last pre-cast liner segment 1506. The rear of the machine 1500 remains in place along with the rear bulkhead 1504. In FIG. 15*c*, the rear of the machine 1500 and the rear bulkhead 1504 are moved forward while backfill material is continuously deposited into the volume immediately behind the moving rear bulkhead 1504. During this part of the cycle, two additional liner segments 1506 are installed under the liner shield 1505. In FIG. 15*d*, the front portion of the machine 1500 has been advanced and is in the same state as in FIG. 15*b* except that two additional liner segments 1506 have been added. This embodiment is preferred in very loose and/or unstable ground because it leaves no free volume for any ground motion to occur.

Alternately and more preferably, the tunnel liner may be formed by extruding concrete between two moveable forms to form a tunnel liner. In this embodiment, concrete may be mixed in a batch plant near the tunnel portal and slurried into the excavation machine, or may be mixed in a batch plant contained in the excavating machine. The concrete can then be pumped into the space between the moveable forms. The forms are initially located within the mining machine. As the machine advances, the forms remain stationary until the concrete has set and then the forms are withdrawn back into the machine, leaving the concrete tunnel liner in place with enough strength to support the backfill material and any other material that is not supported as a result of the excavation process. FIG. 16 shows a sequence of cross-sectional side views of a more preferred embodiment of the mining process in which the access liner is formed by continuously extruding a liner and the backfill is continuously deposited so as not to leave any empty volume behind the machine. In FIG. 16*a* the mining machine 1600 is shown with a cutting head 1601 and an internal apparatus 1602 for depositing backfill material 1603 through a rear bulkhead 1604 into the volume behind the machine 1600. A liner shield 1605 is shown in which the extruded liner 1606 is assembled. The extruded liner is formed by an apparatus 1607 contained in the mining machine 1600. The liner form 1609 may have strengthening ribs 1608 cast as part of the liner structure. In FIG. 16*b*, the front of the machine 1600 advances pulling the backfill apparatus 1602, the liner shield 1605, the liner extrusion apparatus 1607 and the liner form along with it but not far enough to uncover the extruded liner portions that have not attained the level of strength to support the backfill 1603. The rear of the machine 1600 remains in place along with the rear bulkhead 1604. In FIG. 16*c*, the rear of the machine 1600 and the rear bulkhead 1604 are moved forward while backfill material is continuously deposited into the volume immediately behind the moving rear bulkhead 1604. During this part of the cycle, the cast-in-place or extruded liner 1606 continues to be formed under the liner tail shield 1605. In FIG. 16*d*, the front portion of the machine 1600 has been advanced and is in the same state as in FIG. 16*b* except that additional extruded liner 1606 length has been added. This embodiment is preferred over the pre-cast liner segment embodiment because it requires less labor and is mor readily automated. The extruded liner may be formed from any of a number of fast-setting concretes, for example, which utilize accelerants to cause the concrete to achieve a reasonable strength level in a period typically of less than a hour.

As will be appreciated, any suitable rotary cutter head design can be employed for the machine. By way of example, FIG. 17 shows front views of various ways in which arrays of rotary cutter heads can be arranged to excavate circular or rectangular openings. FIG. 17*a* shows a conventional single rotary cutter head 1700 that might be used for a cylindrical boring machine used in the present invention to excavate a circular opening. The cutter head shown includes three cutting arms 1701. Cutting tools 1702 may be mounted on the cutting arms 1701. The cutting head is rotated about its axis 1703 in a direction indicated by the arrow 1704. Such a single headed machine will have a tendency to roll in the direction of head rotation 1704 which can be counteracted by several known means. A machine with a excavating head comprised of an array of smaller conventional rotary boring heads is illustrated in FIG. 17*b*. Such an array of heads 1710 would be mounted in a large frame structure 1711 that forms the front-end of a tunnel boring machine and would be capable of excavating an approximately rectangular opening. As the rotary heads advance through the oil sands deposits, the material that passes in the areas 1712 between adjacent heads will be partially broken down by the agitation of the rotary head motion, especially if adjacent heads are rotating in opposite directions. This material can be further reduced in size distribution by a primary crusher located in the machine to reduce the larger rock and sands accretions to a size amenable to hydrotransporting. Only the material adjacent to the four corners 1713 of the machine may be by-passed by this array of boring heads. In the geometry illustrated, the by-passed material would be about 3% of the total material in the rectangular cross-section shown. In contrast, a single large rotary boring head 1700 FIG. 17*a*, would excavate a circular cross-section and would leave behind much as 22% of the material of the square cross-section because it would not excavate the areas outside its circumference. The main bearing required for a rotary head can seize or otherwise break down and need to be replaced while a machine is in the process of a run. The size of this bearing is about 15 to 20% the size of the rotary head. Therefore, a spare bearing stored in the machine would take up considerable space. Alternately, a replacement bearing would have to be brought in via the trailing access tunnel. This would force the construction of an access tunnel having a cross-section of at least 25 to 35% of the size of the rotary head so that the replacement bearing could be brought in past the utility lines. In the case of an array of smaller heads in the array 1710, one or two replacement bearings could be stored in the machine, taking up far less space than a single large bearing. Also the smaller replacement bearings could be brought into the machine by a small access tunnel as envisioned in the present invention. The direction of rotation of the rotary heads in the array 1710 can be alternated to cancel out most of the tendency of the machine 1711 to roll.

FIG. 17*c* illustrates yet other configurations of rotary cutter heads that can be used to excavate an approximately rectangular opening and better comminute the ore. This machine 1720 has three large cutting heads 1721, 1722 and 1723. The large center head 1722 is shown mounted ahead of the two large side cutting heads 1721 and 1723 so that the cutting cross-sections overlap. Smaller cutting heads 1724 are mounted in the spaces between the large cutting heads to help comminute the excavated material missed by the large cutter heads. For large machines such as envisioned for the present invention, smaller concentric cutter heads 1725 may be mounted coaxially with the large cutter heads. These smaller concentric heads 1725 may be rotated counter to the direction of the large coaxial heads as shown to assist in preventing excavated material from sticking near the center of the primary cutter heads. The three large cutting heads may be rotated in opposite directions, as shown, to reduce the roll tendency of the machine 1720. The preferred cross-section is rectangular with overall dimensions in the range of approximately 7.5 to 30 meters wide by approximately 7.5 to 20 meters high. If circular cutting heads are used, the preferred number of heads that comprise the front end is in the range of about 2 to 12.

An identified problem of excavating oil sand is mechanical cutter wear due to the abrasive nature of the quartz sand grains. Another identified problem is the difficulty in handling oil sand material because it tends to become very sticky with working and re-working. Working the oil sand material tends to heat it which causes the bitumen to become more fluid (less viscous), turning it from a solid or semi-solid bituminous substance to very viscous heavy oil. In excavating sandstone or sandy material, TBMs often employ a slurry shield or mixed slurry shield type of cutting head to assist with stabilization of the excavation face. To implement this technique, water is injected into the volume immediately ahead of the cutting head to create a slurry of the excavated material. The slurry so formed is often kept at a slightly higher pressure so as to prevent voids and cavitation from developing so that the material will flow through openings in the cutter head and into the materials handling system. The method can be extended in unconsolidated and soft rock media by using high pressure water jets to excavate the material. Often, the water jets perform the primary excavation and mechanical cutter elements are included to provide backup excavation of any material not fully broken by the action of the water jets.

A slurry shield front-end would overcome the two excavation problems described above. First, the formation of a slurry will substantially reduce cutter head wear. Additionally, if water jets are used for the primary excavation, any mechanical cutter heads will be subjected to even less wear from the abrasive action of sand grains. The formation of a slurry by the addition of ambient temperature water ahead of the TBM cutter head also controls the temperature of the excavated material by (1) diluting the material with a heat sink material and (2) by substantially reducing mechanical working of the material. The excavated oil sand material thus may tend to remain as semi-solid substance and not be transformed into a sticky, highly viscous material that will clog machinery or adhere to surfaces of the material handling system.

Figure 18B:
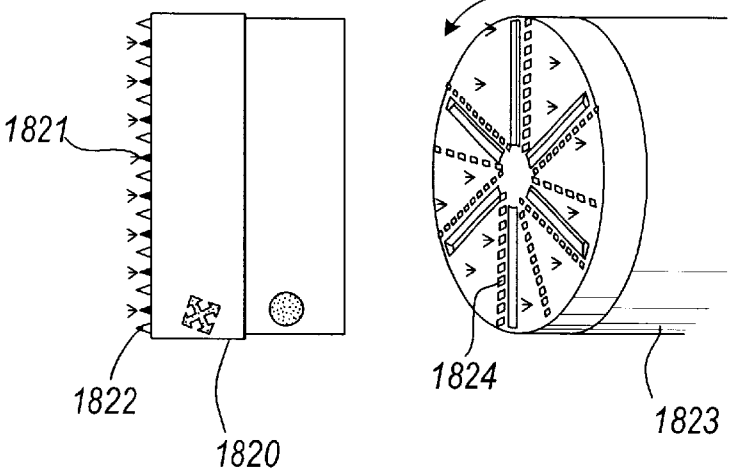
FIG. 18 shows a several views of a cutter head assembly comprised of both mechanical cutter elements and water jet cutter elements.
Figure 18A:
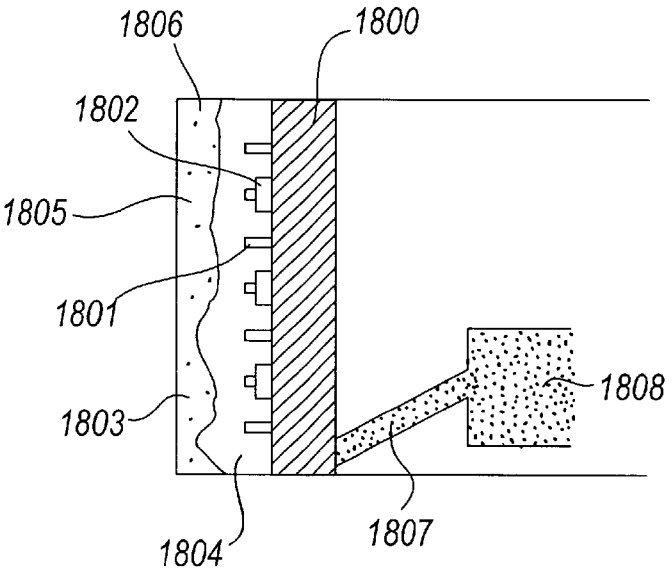

FIG. 18*a* shows a schematic side view of a cutter head assembly comprised of both mechanical cutter elements and water jet cutter elements. The cutter 1800 head contains a number of mechanical cutters 1801 and water jet cutters 1802. The water jet cutters 1802 are used for primary excavation of the oil sand material 1803 and also provide the water to form a slurry 1804 in the volume 1805 between the cutter head 1800 and the forward shield 1806. The slurry 1804 is transported through the cutter head 1800 into a pipeline 1807 which feeds the slurry 1804 into a primary crusher 1807. FIG. 18*b* illustrates a closed cutter head assembly 1820 also using both water jets 1821 and mechanical cutters 1822 for excavating the material and forming a slurry. The isometric view 1823 shows the water jets and mechanical cutters arrayed on a rotary cutter head 1824.

Figure 19:
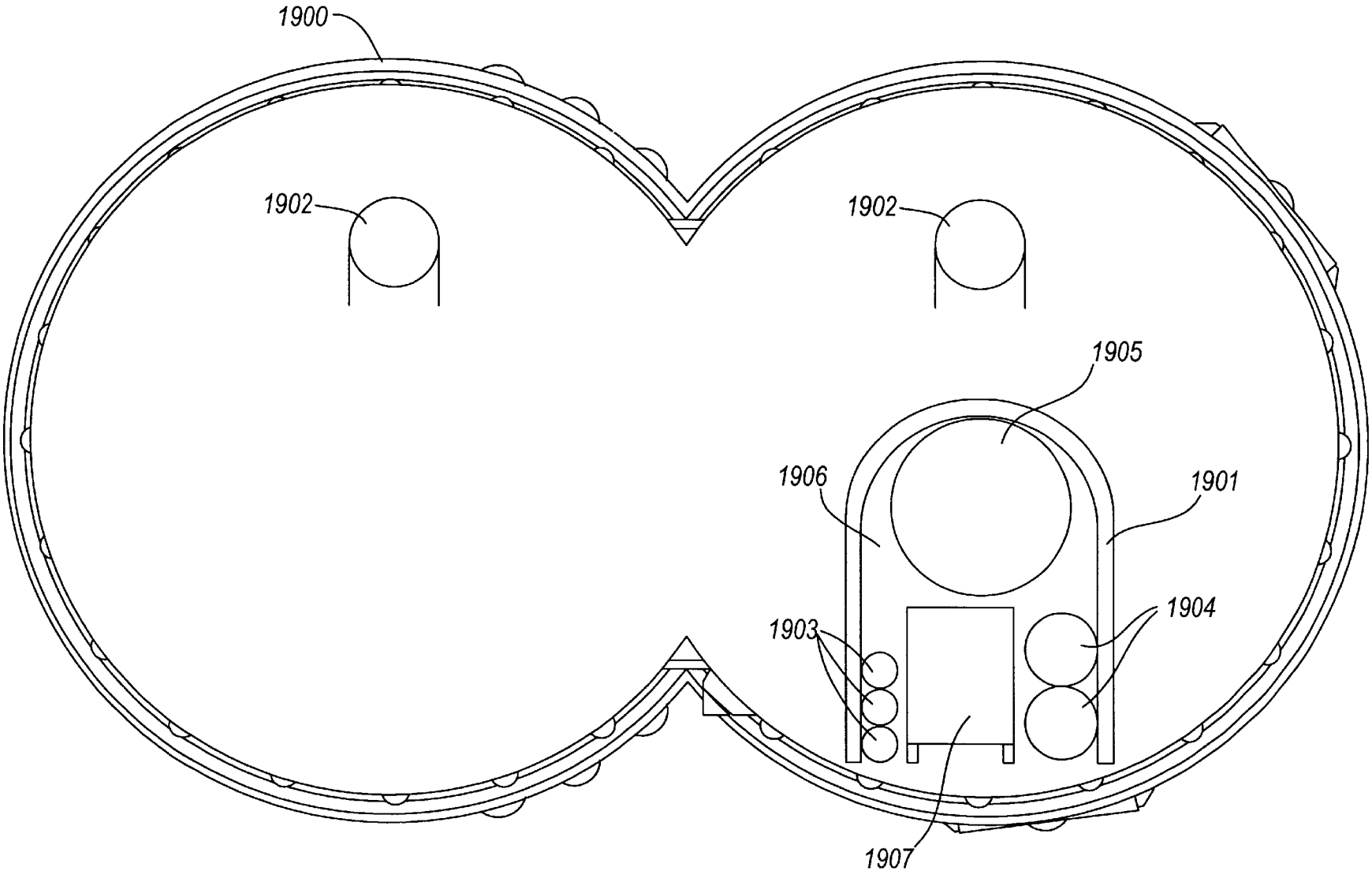
FIG. 19 shows a rear view of a large excavating machine with two rotary cutter heads illustrating the cross section of a trailing access tunnel and various other features.

FIG. 19 shows a rear view of a large excavating machine with two overlapping rotary cutter heads illustrating the cross section of the trailing access tunnel and various other features. FIG. 19 shows a rear view of a large binocular excavating machine 1900 that can excavate a roughly rectangular excavation opening, illustrating the cross-section of the trailing access tunnel 1901, the backfill or spoil injection discharge pipes 1902, utility lines 1903 and hydrotransport slurry pipelines 1904. Utilities include electrical power, water input and output, chemicals necessary for forming a slurry, sewage disposal, and the like. A ventilation duct 1905 for incoming ventilation air is shown. The outgoing ventilation air in this configuration uses the main tunnel volume 1906. Because of the small diameter of the access/service tunnel, the design of the ventilation system requires special attention. Output ventilation air may have to be compressed and discharged under pressure to minimize the diameter of the discharge line. Input fresh ventilation air can also be compressed and input under pressure to minimize its line diameter. This would require a filtration unit in the excavation machine to remove any contaminants (such as oil) that result from the compression and pressurized pumping process. The access tunnel is shown with utility lines 1903, slurry transport lines 1904 and a large ventilation duct 1905 arranged in such a way as to allow a transport vehicle 1907 to pass through the tunnel 170.

Mining Operations

Figure 20:
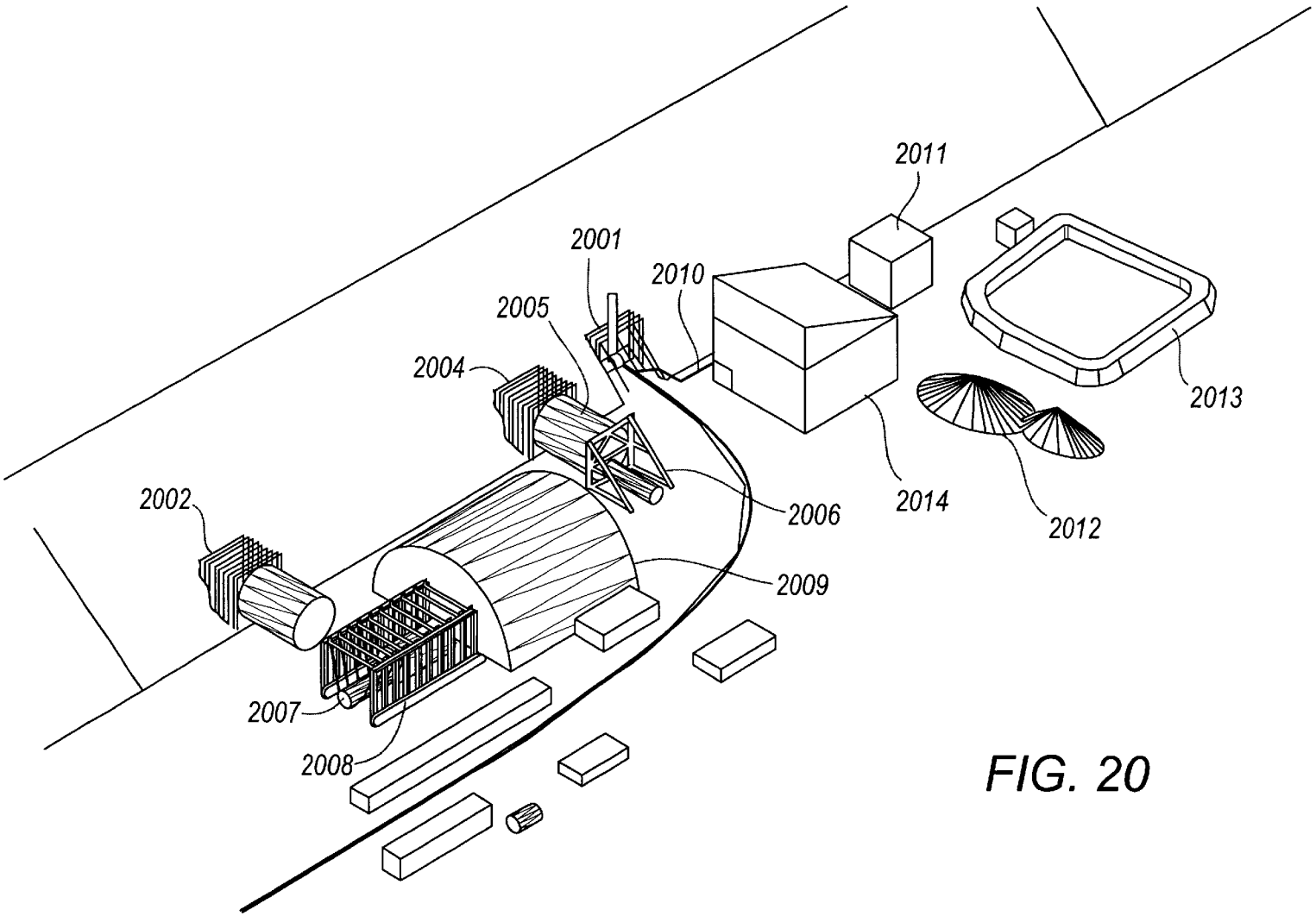
FIG. 20 shows an isometric view looking down of some of the elements of a possible mining operation using tunnel boring machines entering and exiting at an exposed working face.

A mining operation based on the present invention can use large mining machines either as a stand-alone mining operation or in conjunction with an on-going open-pit mining operation. The following figures show examples of some of the surface facilities required to support an underground mining operation using large TBMs that backfill behind themselves as they advance (the bore & fill method). FIG. 20 is an isometric view looking down on a possible mining operation near a working portal. A working portal 2001 that supports an underground machine is shown along with an exit portal 2002 formed by another mining machine 2003 that has recently completed a drive. A new entrance portal 2004 under development is also shown along with a mining machine 2005 which is using a thrust stand 2006 to push off and begin to advance its tunnel. Another mining machine 2007 is shown in a TBM mover apparatus 2008. This mover 2008 acquires a TBM mining machine at an exit portal after the TBM has completed a mining pass or drive, transports it into a maintenance shop 2009 for overhaul, then moves it into position at a newly installed entrance portal so that the refurbished mining machine can begin its next mining pass. Some of the utilities and other supplies to support an on-going underground TBM mining drive are also shown. Oil sand slurry output 2010 shown coming out of the working portal 2001 is directed to an area where the bitumen can be extracted by a bitumen separation facility 2011 that serves a number of portals. The tailings materials left after the bitumen has been extracted are shown stored in piles 2012 and small tailings pond facilities 2013, as required. An small office 2014 building for support personnel is also shown.

Figure 21:
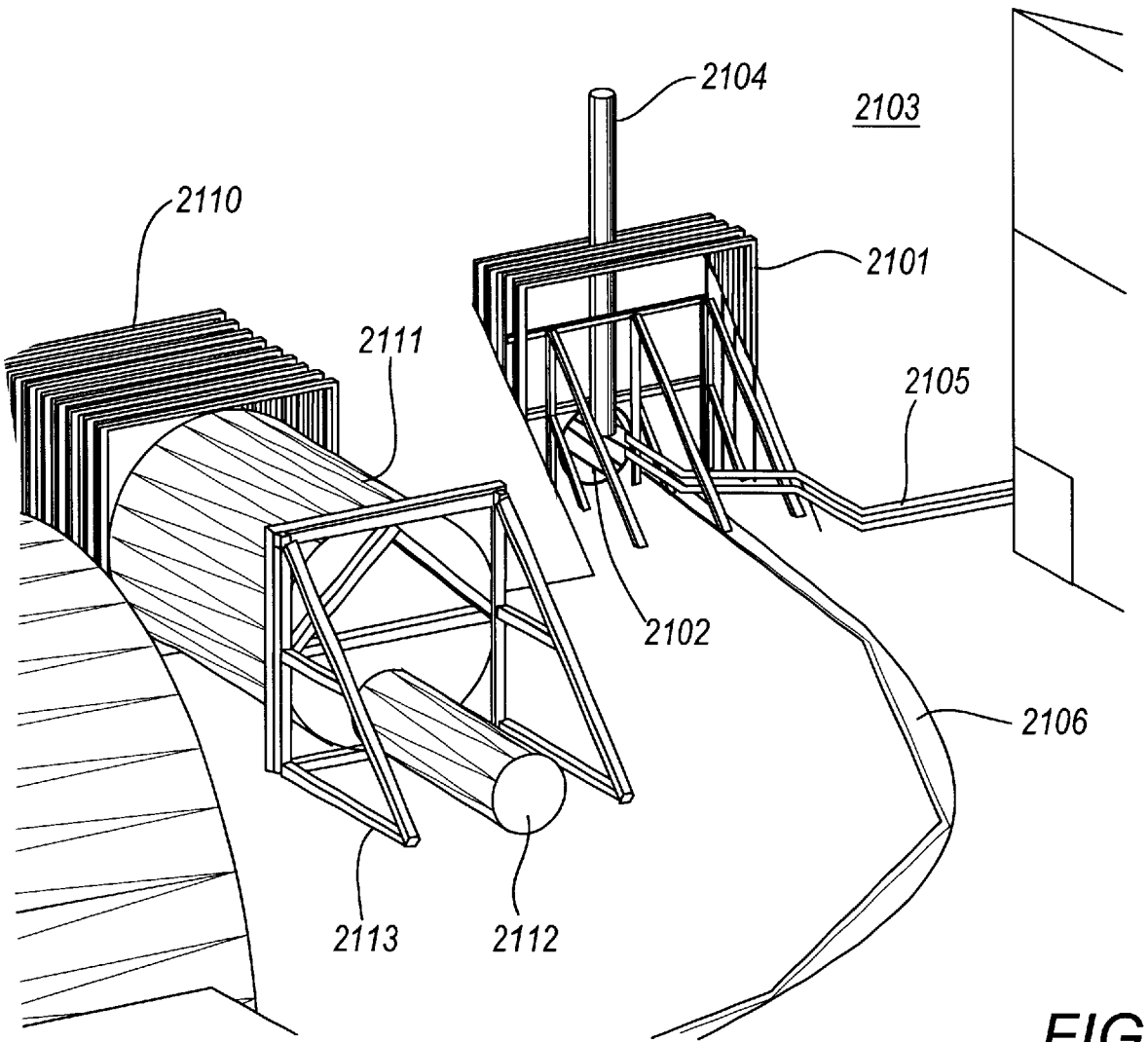
FIG. 21 shows an isometric view of the portal area of a possible mining operation using tunnel boring machines entering and exiting at an exposed working face.

FIG. 21 shows an isometric view of the portal area of a possible mining operation using tunnel boring machines entering and exiting at an exposed working face. The structure 2101 to support a working portal 2102 is shown installed into the face of the ore deposit 2103. The vertical pipe 2104 is the ventilation duct that services the working portal 2102. Input and output slurry lines 2105 and the utilities lines 2106 are also shown. A second portal structure 2110 is shown with a large mining machine 2111 and its access tunnel tail shield 2112. The mining machine 2111 is started into the portal 2110 by thrusting off a fixed thrust frame 2113.

Figure 22:
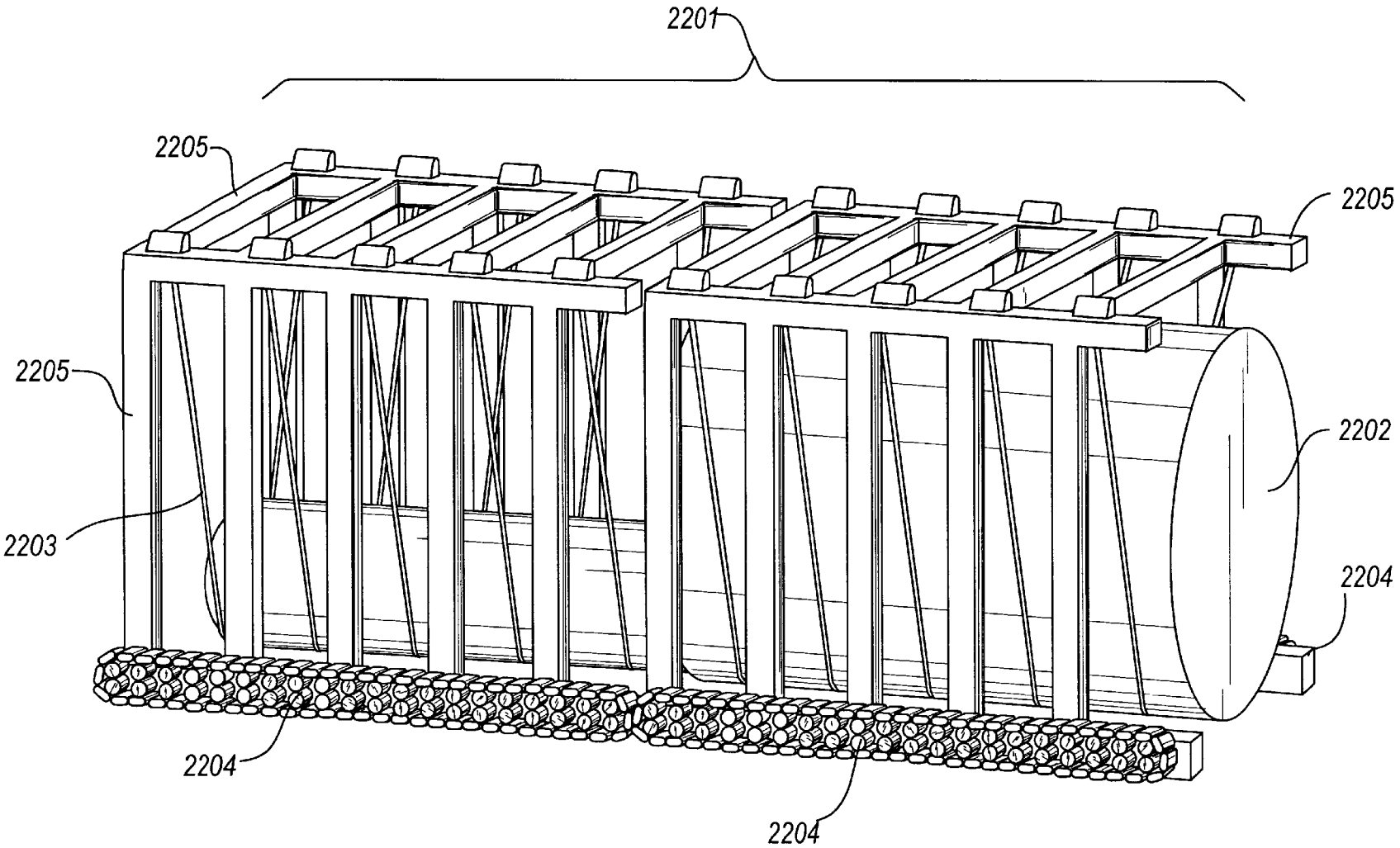
FIG. 22 shows an isometric schematic view of a machine that can lift and turn a large TBM.

FIG. 22 shows an isometric schematic view of a machine that can lift and turn a large mining machine of the present invention. The large mover 2201 would acquire a mining machine, such as a tunnel boring machine 2202 that had exited a portal from a mining drive. The mover 2201 would hold the mining machine 2202 for example using a series of slings 2203. The mover 2201 would move, for example, by utilizing tracks 2204 to move the mining machine 2201 out from an exit portal, move it into a maintenance facility for overhaul, and then move it into position in front of an entrance portal for the next mining pass. The mover 2201 an be fabricated from, for example, structural steel members 2205 and powered by any of a number of means such as compressed air, hydraulic, electric or internal combustion engines.

Internal Processes

Figure 23:
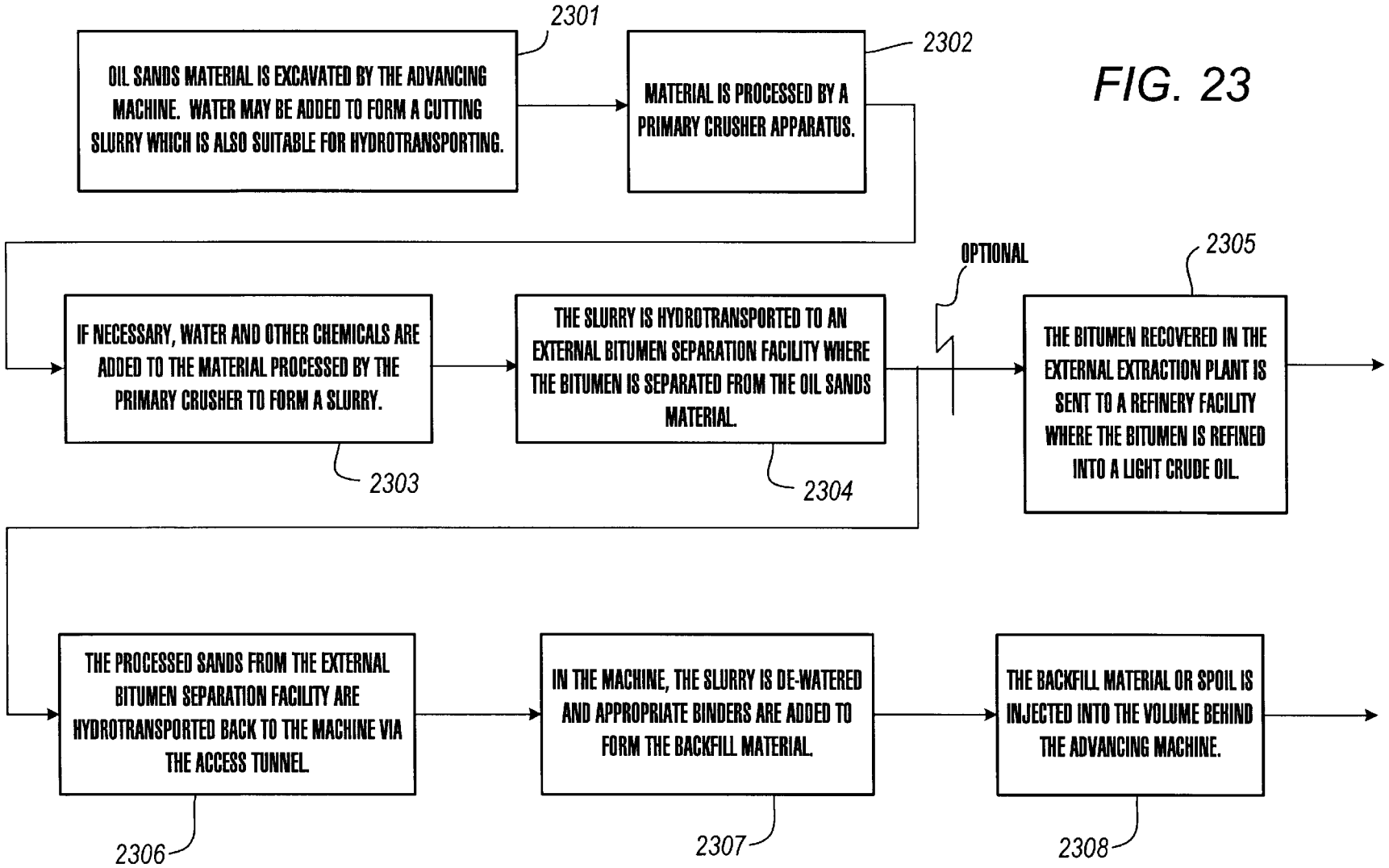
FIG. 23 shows a flow chart of the oil sands material as it passes through the mining machine.

In the present invention, the large shields provide opportunity for many processes, in addition to excavating and transporting out ore, to be carried out within the mining machine. FIG. 23 presents a flow chart of the oil sands material as it passes through the mining machine for the case where the bitumen is separated from the oil sands in an external processing facility. Oil sands material 2301 enters by the action of the cutter heads. The excavation may be carried out by forming a slurry at the working face in which case a slurry suitable for hydrotransporting may already be formed. The excavated material is then fed into a primary crusher 2302 where any large fragments are broken down. The oil sands material is then fed to an apparatus where water and other chemicals, if necessary, are combined to form a final hydrotransportable slurry 2303. The slurry is then hydrotransported 2304 out the access tunnel to an external bitumen separation facility where the bitumen is recovered. The bitumen extraction facility may be located outside the portal or at a substantial distance from the portal. Outside of the scope of the present invention, the bitumen is then sent to a refinery where it is converted into crude oil 2305, the final product. Sand, mud and shale material remaining after the bitumen separation process is hydrotransported 2306 as needed back to the machine via the access tunnel. The returning slurry is fed to an apparatus 2307 where the bulk of the water is removed from the material and appropriate binder and stabilizing agents are added. The resultant material or spoil is then injected 2308 into the volume behind the advancing machine.

Figure 24:
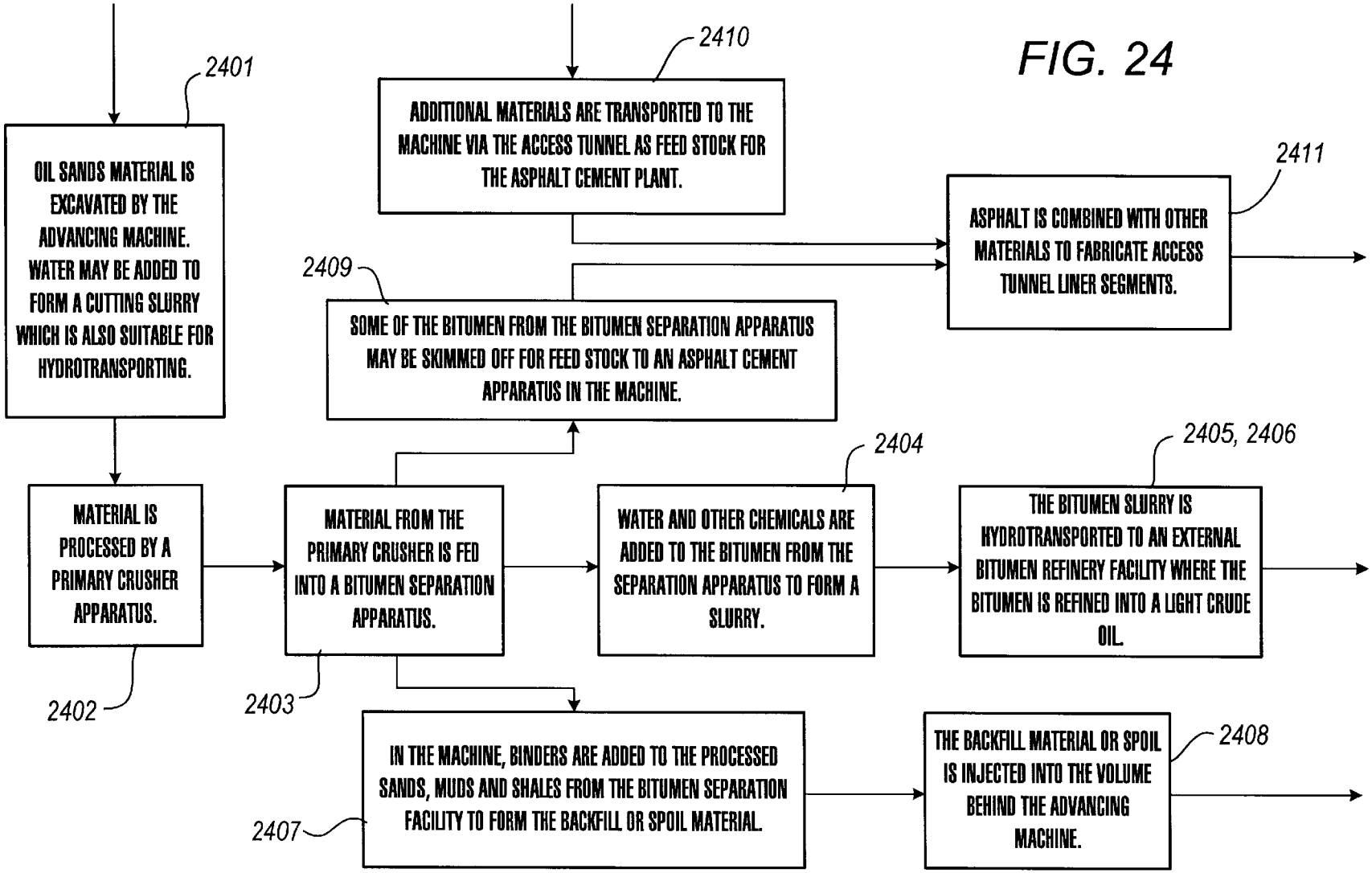
FIG. 24 shows a flow chart of the oil sands material as it passes through the mining machine for the case where bitumen or heavy oil is separated from the oil sands in the machine.

FIG. 24 shows a flow chart of the oil sands material as it passes through the mining machine for the case where bitumen or heavy oil is separated from the oil sands inside the mining machine. Oil sands material 2401 enters by the action of the cutter heads. The excavation may be carried out by forming a slurry at the working face in which case a slurry suitable for hydrotransporting may already be formed. The material is fed into a primary crusher 2402 where any large fragments are broken down. The oil sands material is then fed to an apparatus where the bitumen is separated from the oil sands 2403. The separated bitumen is then sent to an apparatus in which water and other chemicals, if needed, are combined to form a slurry 2404. For example, caustic may be added to speed up the separation process as is done in the Clark process. Since bitumen separation involves an interplay between mechanical agitation, slurry temperature and slurry PH, chemicals other than caustic may prove cost-effective. The slurry is then hydrotransported 2405 out the access tunnel to an external refinery where it is converted into crude oil 2406, the final product. Back in the machine, the sand, mud and shale material remaining after the bitumen separation process is then fed to an apparatus 2407 where appropriate binder and stabilizing agents are added. The resultant backfill material or spoil is then injected 2408 into the volume behind the advancing machine. Some of the bitumen is removed before the bulk of the bitumen is formed into a slurry and is fed 2409 into a compact asphalt cement plant inside the machine. Additional materials such as binders and crushed rock are brought in from the outside via the access tunnel and fed 2410 into the asphalt cement plant. The materials are processed in the asphalt cement plant 2411 to form part or all of the tunnel liner segments that will be installed as the access tunnel is extended behind the advancing machine.

Figure 25:
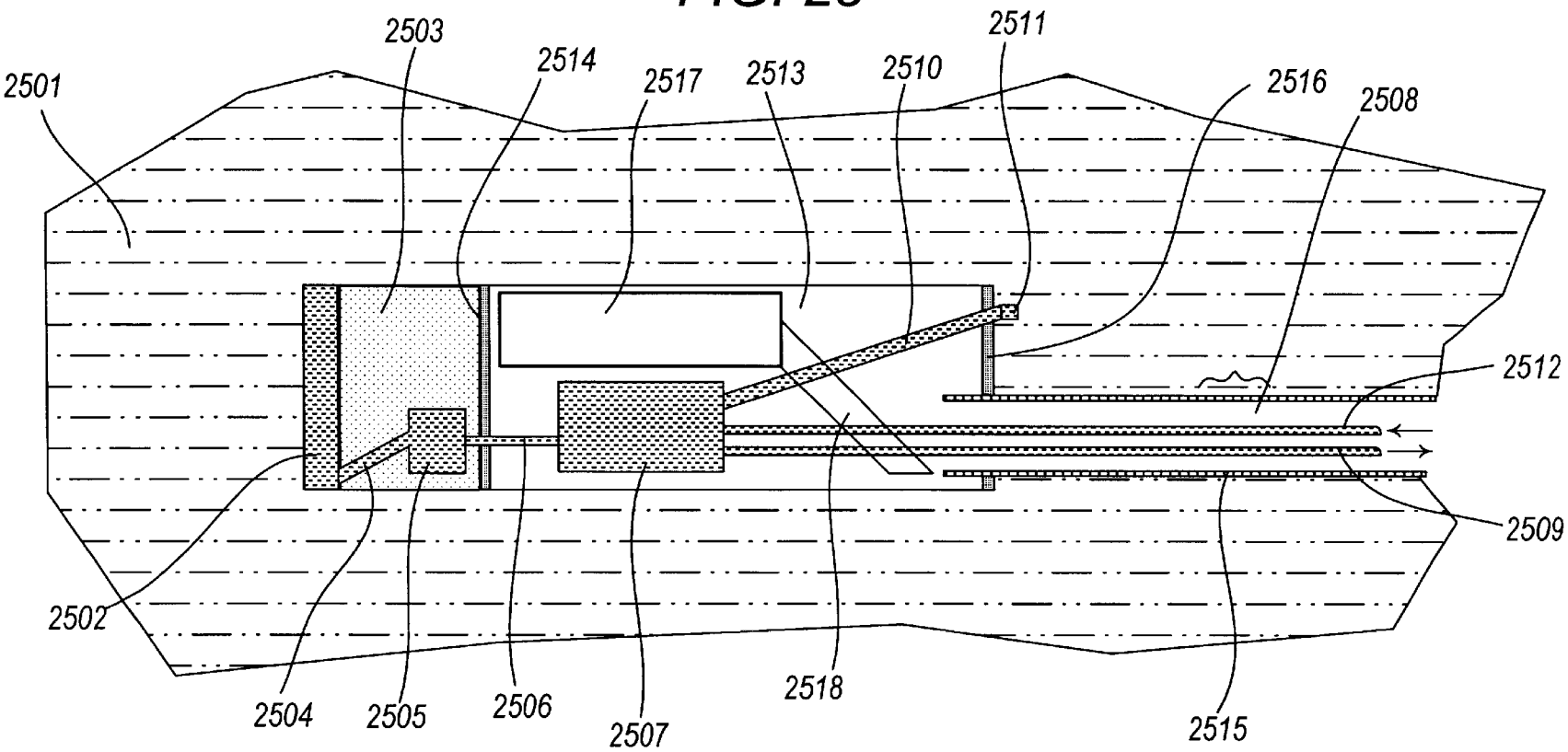
FIG. 25 shows a side view of a TBM mining machine in which the flow of excavated material and backfill material is isolated from the personnel in the interior of the machine.

The present invention is extended to include an internal materials processing system that is completely isolated from the machine personnel areas. An example of this additional capability is illustrated in FIG. 25 in which a TBM mining machine is shown in side view excavating into a hydrocarbon deposit. The crew area can be constructed as a self-contained pressure-resistant volume. Normally the crew area can be open to the access tunnel and remain at atmospheric pressure. In the case of an emergency, however, the crew area can be closed off and operated using a supply fresh air until the emergency conditions are corrected. In the present invention, the emissions from the excavated ore and the mining machine are all contained and routed into the isolated ore transportation system and not released into the atmosphere. Thus the present invention has the potential to contain and dispose of significant methane, carbon monoxide, carbon dioxide and other toxic gases. Further, much of the excess heat generated in the mining machine of the present invention is used to help separate bitumen from the oil sand, further reducing the amount of emissions from the mining, hydrotransport and bitumen separation processes. The present invention therefore can significantly reduce the total emissions associated with the large scale oil sands mining process. FIG. 25 shows a side view of a TBM mining machine 2500 excavating into a hydrocarbon deposit 2501, in which the flow of materials is isolated from the personnel. The material excavated passes through the cutter head assembly 2502 into a pressurized chamber 2503 in which the material is fed down a muck chute 2504 into the primary crusher 2505. The excavated material may or may not be in slurry form depending on the mode of cutting. The material moves from the primary crusher 2505 through a closed pipeline 2506 into a materials processing chamber 2507. The materials processing chamber 2507 may separate the desired material (for example bitumen) and form a slurry of the desired material for hydrotransporting out the access tunnel 2508 via an outgoing slurry pipeline 2509. Concurrently, the remaining separated material or spoil is sent via a slurry pipeline 2510 and injected or returned into the formation at the muck or spoil discharge point 2511 behind the advancing machine.

Alternately, excavated material may be formed into a slurry inside the cutting head 2502 or the processing chamber 2507 and hydrotransported out the access tunnel 2508 via the outgoing slurry pipeline 2509. In this case, the desired material (for example bitumen) is separated above ground in an external facility and backfill or spoil material is hydrotransported back to the machine via an in-coming slurry pipeline 2512 to the processing chamber 2507. The material is then prepared as needed and sent via a pipeline 2510 to be injected into the formation at the muck or spoil discharge point 2511 behind the advancing machine.

The out-going pipeline 2509 and in-coming pipeline 2512 may also be used to add or subtract small amounts to the spoil material to be injected back into the formation in order to ensure that the proper volume of material is injected to exactly fill the volume behind the advancing machine. This may be necessary since a desired product material is removed from the excavated material and the spoil may be compacted by the thrust of the advancing machine.

The pressurized chamber 2503 is at a pressure slightly higher than ambient formation pressure in order to exclude unwanted vapors and fluids. The excavated material is brought into the machine by the mechanical action of devices such as for example, a screw auger or directly as a slurry if the machine 2500 is operated in a slurry or earth pressure balance mode. The formation pressures can typically range from atmospheric pressure to pressures up to about 20 or more atmospheres. The pressure in the pressurized chamber 2503 is preferably about 0.1 to 3 atmospheres higher than formation pressure. The pressure in the areas 2513 where operators and personnel are stationed is typically atmospheric since this portion of the machine is connected to the outside world by the trailing access tunnel 2508.

The crew area 2513 is separated from the pressurized chamber 2503 by a pressure bulkhead 2514. The muck discharge pipeline 2510 and the trailing access tunnel liner 2515 both pass through another pressure bulkhead 2516. The access tunnel liner 2515 has a sliding seal mechanism to allow the liner to be assembled within the machine and to be left behind as the machine excavates and advances. Also shown is a control room 2517 normally connected to the total working area can serve as an emergency self-contained personnel haven. The self-contained control/personnel room 2517 is connected to the main working area 2513 for example by a stairwell 2518 or some other access means. Under normal operating conditions the work area 2513, the access tunnel 2508 and the control/personnel room 2517 and connecting stairwell 2518 are all open and on the same air supply. In an emergency situation such as a breach in the materials handling system or in the tunnel liner 2515, the personnel can be sequestered in the control/personnel room 2517 and the access stairwell 2518 can be closed off by a pressure door. The air in the control/personnel room 2517 can be supplied by a self-contained air supply such as provided for example by a number of compressed air bottles. The self-contained control/personnel room 2517 is preferably large enough to hold from 10 15 persons for a period of up to 6 days.

Figure 26:
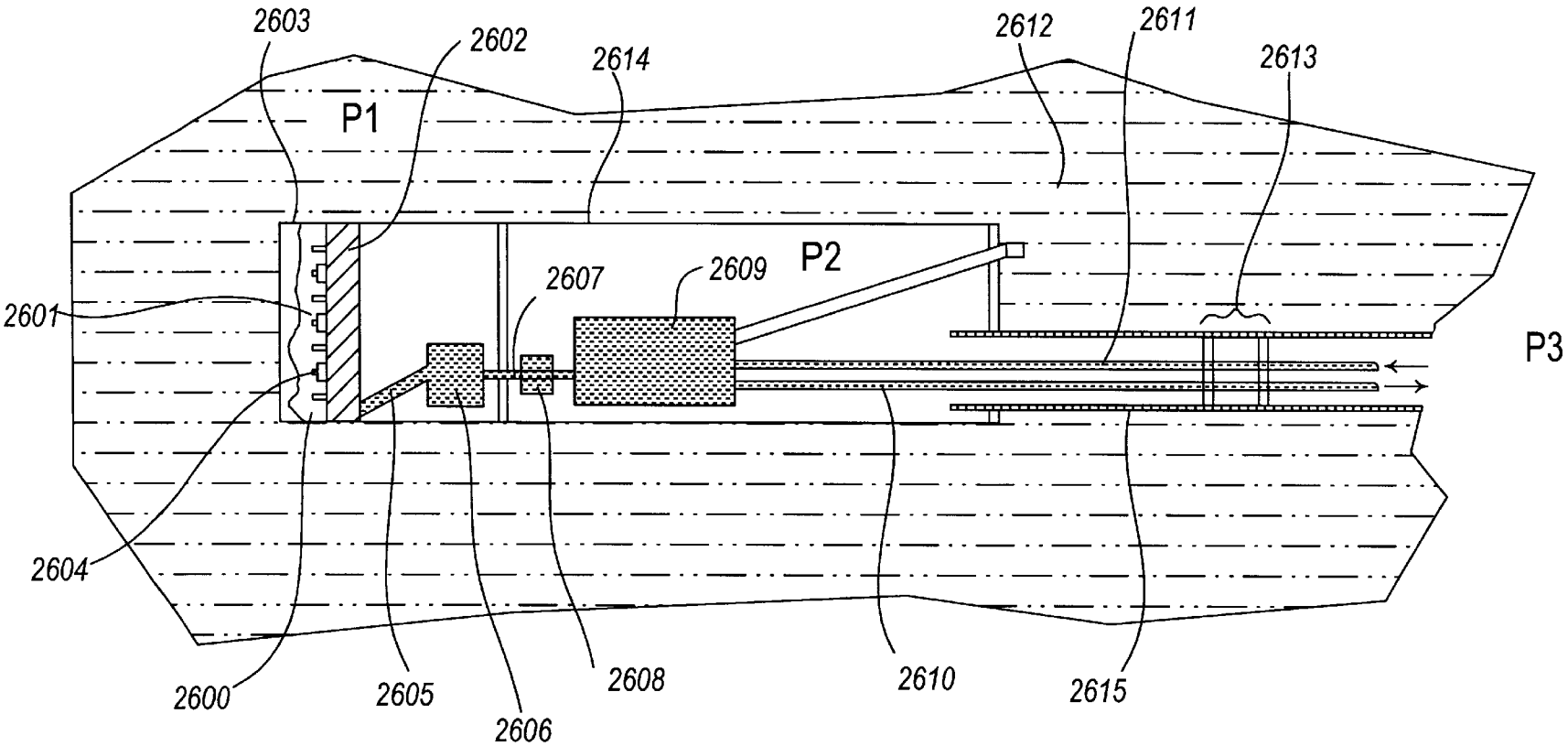
FIG. 26 shows a side schematic view of a TBM mining machine illustrating the volumes occupied by both outgoing oil sand or bitumen slurry and incoming tailings slurry.

FIG. 26 shows a side schematic view of a TBM mining machine configuration illustrating the volumes occupied by both outgoing oil sand or bitumen slurry and incoming tailings slurry and other features. The slurry 2600 is formed in the volume 2601 between the cutter head 2602 and the forward portion of the main shield 2603 either by water injected into the volume 2601 or by water from the water jet cutters 2604 or from both water jet cutters 2604 and other water injection ports. The slurry 2600 passes through the cutter head 2602, down a pipeline 2605 to a primary crusher 2606, down a pipeline 2607, through a flow monitoring station 2608 and into a processing/switching apparatus 2609 and out a hydrotransport pipeline 2610. A return hydrotransport pipeline 2611 contains a slurry of processed material which is fed into the processing/switching apparatus 2609 where it is de-watered and prepared for injection as backfill into the volume 2612 behind the advancing machine. The processing/switching apparatus 2609 contains an internal apparatus that includes but is not limited to a de-watering apparatus for de-watering the returning processed sands; an internal apparatus for preparing the de-watered sand for injection as backfill; an internal apparatus for separating bitumen from oil sand; and an internal apparatus for diverting the slurry from the primary crusher directly to the de-watering apparatus for de-watering the returning processed sands.

The oil sands deposits can be highly variable in ore grade both through the thickness of the deposit and over the areal extent of the deposit. It is also possible to encounter barren water-saturated sands or sands containing a significant fraction of shale, clay and /or mudstone stringers. An extension of the present invention is the addition of an apparatus 2608 to determine the approximate grade of the ore after it passes out of the primary crusher of the mining machine. If the grade of the ore is too low for transporting to the portal, then the slurried ore can be directed to a de-watering plant contained in apparatus 2609 in the machine and injected into the volume 2612 behind the advancing machine. In the case where the machine contains a bitumen separation plant in apparatus 2609, the low grade ore or barren material can be diverted to the de-watering plant in the machine and injected into the volume 2609 behind the advancing machine.

If the excavated ore is in the form of a slurry, it can be passed through an apparatus 2608 where various diagnostics may be used to determine the average grade of the ore. The ore grade is usually expressed as a percent by mass of bitumen in the oil sand. Typical acceptable ore grades for oil sand is about 6% to 9% by mass bitumen (lean); 10% to 11% (average) and 12% to 15% (rich). A typical oil sand slurry is comprised of water (about 25% to 50% by mass) with the rest being oil sand. Typical slurry flow velocities are in the range of about 2 to 5 meters per second.

The slurry flowing through a diagnostic pipeline section 2608 involves the material to be diagnosed flowing past the diagnostics. This is basically the reverse situation as in conventional well logging where a diagnostic sonde is pulled up through the material to be measured. The relative motions, however, are the same. Thus, conventional well-logging diagnostics can be applied to determine the water/hydrocarbon ratio of the slurry. For example, induction, resistivity, acoustic, density, neutron and nuclear magnetic resonance (NMR) diagnostics can be used to provide the data required to solve Archies equation in the same way as done in conventional well logging practice.

Another potential method for determining ore grade is by the use of Near Infra Red (NIR) technology which is based on the observation that bitumen content varies inversely with fine clay content. In particular, diffuse reflectance NIR spectroscopy using a fibre optic probe has the capability of measuring oil sand ore grade to within acceptable limits for the typical range of oil sand slurries and oil sand ore grades. This technology has been successfully demonstrated in the laboratory and can be adapted as an ore grade diagnostic for the present invention. The technique for determining ore grade accuracy should have a resolution of less than about 1% and more preferably less than about 0.5% by mass of bitumen in the ore. Once the ore grade is established, it is possible to divert below-grade oil sand slurry directly to a de-watering system and then into the backfill volume 2612 behind the advancing mining machine. This eliminates the need to send below-grade ore or barren material to the bitumen separation plant and allows the present invention to provide oil sand ore within specified limits to the separation plant.

It is possible to totally isolate the atmosphere in a TBM mining machine so that it can operate at greater depths and under greater formation pressures. In this mode, a pressure air-lock system 2613 would be required at some point in the trailing access tunnel. In this embodiment, the formation surrounding the mining machine 2514 has a characteristic formation pressure p1. The air at the surface has an atmospheric pressure p2. If the formation pressure p1 is much greater than the atmospheric pressure p3, then it may be desirable to maintain the pressure p2 in the personnel areas of the mining machine at some intermediate pressure p2, where p1>p2>p3. This can be accomplished by establishing an air-lock entry system 2613 somewhere in the access tunnel 2615 between the mining machine and the portal to the surface. The pressure on the portal side of the air-lock entry system 2613 is at the same pressure as the outside atmosphere which is at p3. Once the air-lock entry system 2613 is installed, it can be used to control pressure p2 such that the difference between the local formation pressure p1 and the interior pressure p2 in the mining machine 2614 is maintained within the safe design limits of the structural members and shield skin of the mining machine 2614.

The propulsion motors, hydraulic cylinders and other power generating sources in the machine generate large amounts of excess heat energy which must be removed via the return ventilation, water and/or slurry systems. In general, a TBM type machine produces heat from its propulsion motors, its hydraulic motors and hydraulic cylinders and by the action of mechanical cutter tools, if used. This heat can be utilized for various functions in the present invention. For example, the heat generated from the propulsion motors, hydraulic motors and cylinders and by the action of mechanical cutter tools can be transferred to water or some other appropriate fluid via a heat exchanger apparatus. The water is then available, for example, to be flushed into the area of the cutter head or muck chamber to help form a slurry suitable for hydrotransport. This warm of hot water can also be used to form water jets to help excavate the material and can be used to begin the separation of the bitumen from the sand as the material is being excavated. The waste heat can also be used to elevate the temperature of other materials such as for example a slurry in an internal bitumen separation facility, and the concrete, asphalt or grout in an internal access tunnel liner extrusion facility and the slurry in a de-watering facility used to de-water a tailings slurry used for backfill. Since the present invention operates underground, the waste heat can be captured and used for other purposes. This is an important energy efficiency advantage over open-pit excavation machines such as shovels and trucks whose waste heat is usually lost in the atmosphere.

Figure 27:
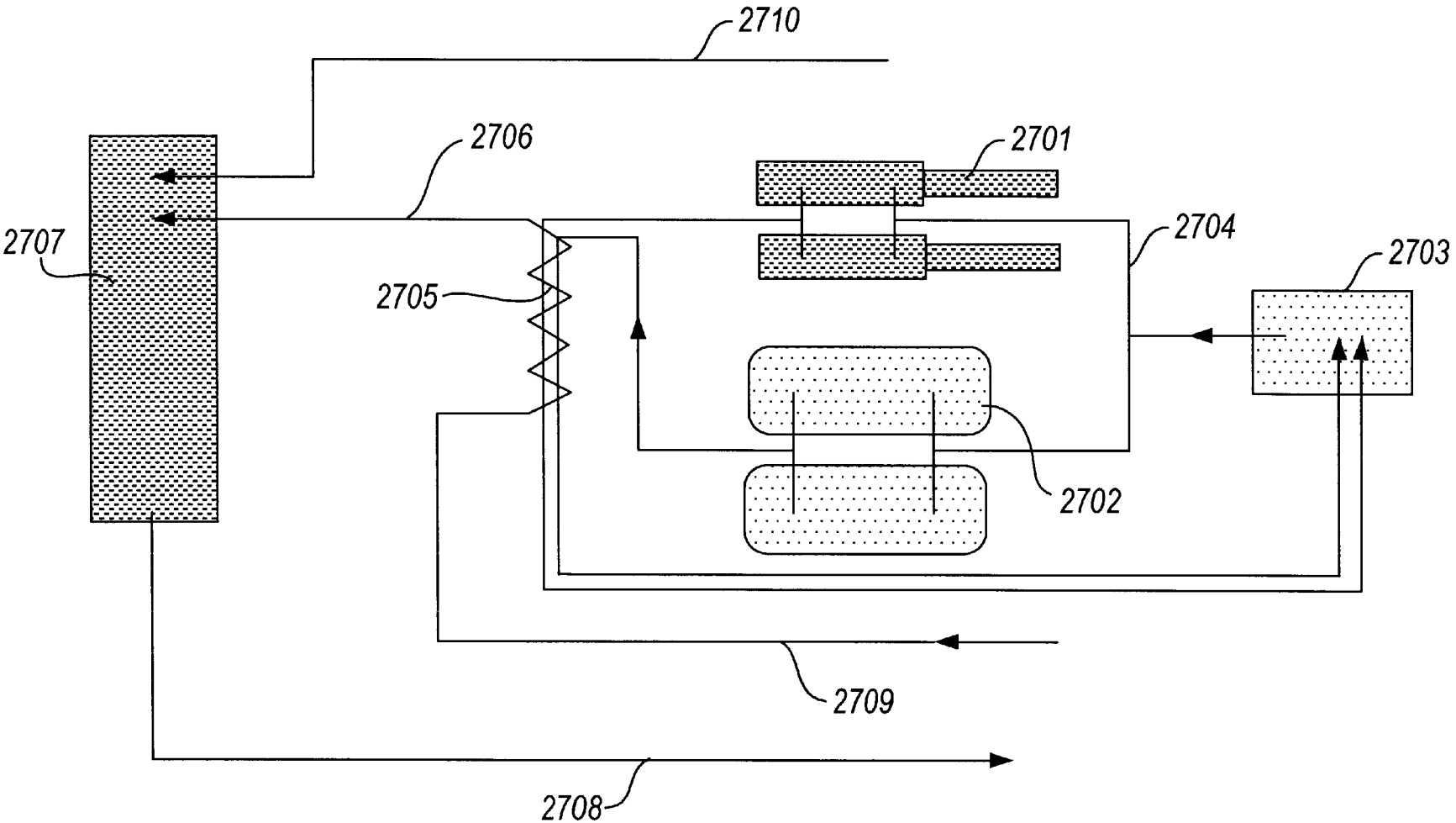
FIG. 27 shows a possible embodiment of a heat exchange system to utilize waste heat for heating a slurry at the working face.

FIG. 27 shows a preferred embodiment of a heat exchange system to utilize waste heat for heating a slurry at the working face. Waste heat is generated primarily by the action of hydraulic thrust and extension cylinders 2701 and by electric motors 2702 used for various purposes including thrusting and rotating the cutting head. These cylinders and motors may be cooled by a suitable coolant such as water that is pumped through a closed circuit. A pump 2703 pumps coolant into a circuit 2704 which passes through the cylinders 2701 and motors 2702 where it becomes heated. The heated coolant passes through a heat exchanger 2705 where the coolant gives up its excess heat to water in a separate circuit 2706. This water may originate in an outside source and come in via a pipeline 2709. The water, after passing through the heat exchanger 2705, is injected into the cutting head slurry 2707 (and/or muck chamber and/or water jets and/or bitumen separator and/or internal access tunnel liner and/or de-watering facility). Additional water from another source 2710 may be added to the slurry 2707 to achieve the required slurry conditions. This additional water may also be heated by a separate source (not shown). The slurry formed from water and excavated ore eventually makes its way out of the excavation area via a hydrotransport pipeline 2708.

A simple tunnel boring machine may advance by increments. In the case of a machine comprised of two sections, the front end of the machine advances during its cutting cycle while the rear section remains stationary. Then the advance of the front end is stopped while the rear end is moved forward by the use of grippers or other propulsion means. A double shield tunnel boring machine can overcome this incremental advance by allowing the front end and rear ends to be moved independently and simultaneously. Even these machines must stop their advance for periodic maintenance or to overcome an equipment breakdown or unanticipated change in ground conditions. Thus, it is important for a tunnel boring type machine used for mining purposes to have some form of ore surge control to allow a more or less even flow of ore from the machine out to the portal of the access tunnel. It is also important to have some form of surge control for both outgoing oil sand (or bitumen) slurry lines and incoming tailings slurry lines because it is difficult to stop and restart the flow of high density slurries in long hydrotransport lines. The surge chambers should be large enough to accommodate in the range of 0.5 to 4 hours of average production of the mining machine.

Figures 28, 28A, 28B:
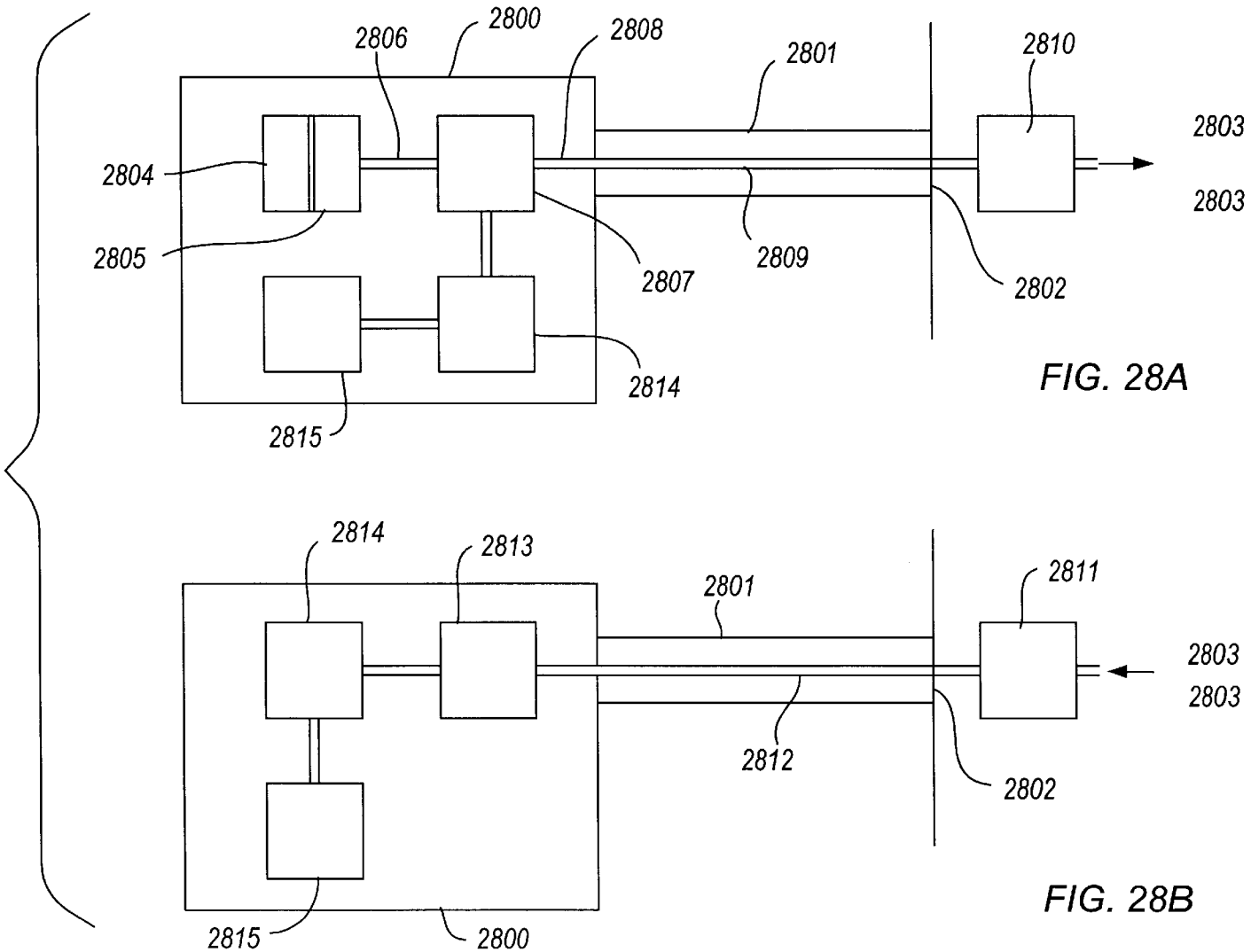
FIG. 28 shows a side schematic view of a possible placement of surge control chambers for controlling outgoing and incoming slurry pipelines.
Figure 29A:
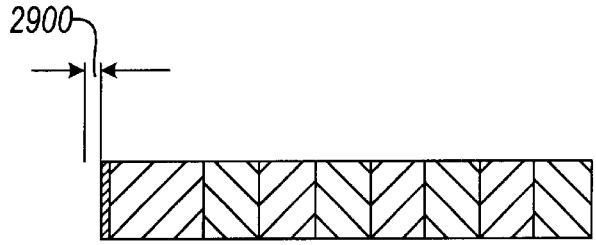
FIG. 29 shows a side view of a sequence of machine motions for a large segmented excavating machine that advances by utilizing differential friction as a means of propulsion.
Figure 29B:
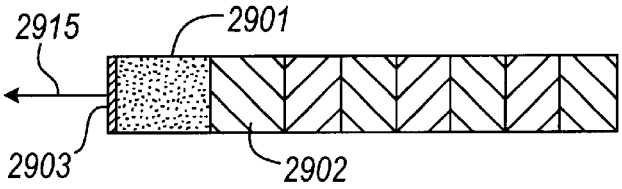
Figure 29C:
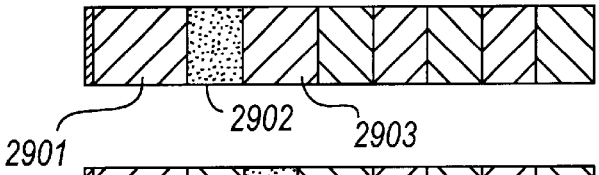
Figure 29D:
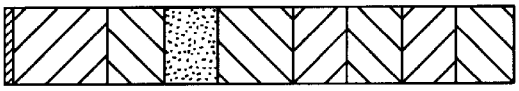
Figure 29E:
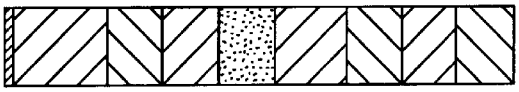
Figure 29F:
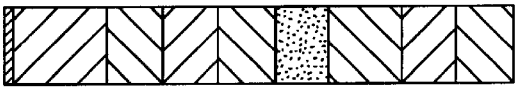
Figure 29G:
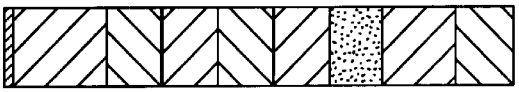
Figure 29H:
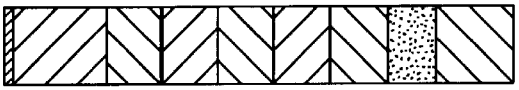
Figure 29I:
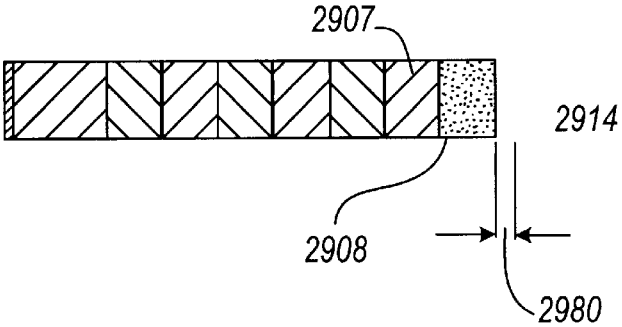

Possible locations for slurry surge control are illustrated in FIG. 28. FIG. 28*a* shows possible locations of surge control chambers for the flow of ore slurry from the mining machine 2800 through the access tunnel 2801, out the working portal 2802 to the surface area 2803. The slurry is formed in the cutter head 2804 or the adjacent muck chamber 2805 and sent via a pipeline 2806 to a surge chamber 2807 which is contained within the mining machine 2800. The surge chamber 2807 provides flow control of ore slurry while the pipeline 2808 behind the surge chamber 2807 is extended from time to time. The ore slurry moves down the access tunnel 2801 via a long hydrotransport line 2809, out the portal 2802 and into a second surge chamber 2810. The function of surge chamber 2810 is to control the flow of ore slurry from the mining machine operation to the main ore hydrotransport system of the overall oil sands mining operation. The flow of ore slurry may be diverted from the surge chamber 2807 directly into the backfill system of the machine, for example, if the ore grade is too low or the excavated ground is barren. The backfill system may be comprised of, for example, a de-watering facility 2814 coupled to a backfill pumping system 2815 which distributes backfill tailings material into the area behind the advancing mining machine 2800. FIG. 28*b* shows possible locations of slurry surge control chambers for the flow of tailings slurry from the surface area 2803 into the working portal 2802, through the access tunnel 2801 to the mining machine 2800. The tailings slurry is generated outside the access tunnel 2801 possibly at a distant bitumen separation plant or at a smaller tailings slurry facility located near the working portal 2802. The surge chamber 2811 controls the flow of tailings slurry from the main tailings slurry system of the mine to the tailings slurry pipeline 2812 in the access tunnel 2801. The tailings slurry enters a second surge chamber 2813 located in the mining machine 2800. The purpose of the second surge chamber 2813 is to control the flow of tailings slurry to the backfill system. The backfill system includes, for example, a de-watering facility 2814 coupled to a backfill pumping system 2815 which distributes tailings material into the area behind the advancing mining machine 2800.

Propulsion and Steering

As will be appreciated, modern tunnel boring machines can be propelled by a variety of means including thrusting off the tunnel liner erected behind the machine, by soft-ground gripper pads that can be thrust out against the walls of the excavation or by a combination of both methods. These methods allow a forward shield segment to advance relative to a rear shield segment, usually by an array of internal hydraulic cylinders that can extend or retract the segments relative to each other. The diameter of the main shields of most soft ground machines are short compared their length and the above means of propulsion are adequate. In the present invention, the tunnel liner is much smaller in cross-section than the main shield and the machines tend to be longer relative to their diameters because the machines often contain additional equipment such as, for example, a bitumen separator, a backfill de-watering and injection apparatus. The machines envisioned in the present invention can use large area soft-ground grippers for propulsion and can also thrust off the backfill material injected behind the machine. The following describes yet another means of propulsion suitable for a longer machine.

FIG. 29 shows a side view of a sequence of machine motions for a large segmented excavating machine that advances by utilizing differential friction as a means of propulsion. In one embodiment, the above method is implemented by a large multi-segmented boring machine apparatus. The segmentation allows the machine to change direction efficiently and allows the machine to follow the meandering oil sands deposits. The segmentation also permits the machine to advance, one segment at a time, by the moving segment thrusting against the combined static friction of the stationary segments. The sequence of motions to advance the segmented machine for the present invention is shown in FIG. 29. The initial position of the machine is shown in FIG. 29*a* and the distance through which the machine will advance in one full cycle of movement is shown by 2900. The start of a new advance cycle is shown in FIG. 29*b*. The forward most segment 2901 moves forward, pushed by the hydraulic jack cylinders connecting the forward most segment 2901 with the second segment 2902. The forward most segment 2901 contains the excavating head 2903 and the oil sand is excavated only during the movement 2915 of this forward most segment. Once these cylinders are fully extended, the second segment moves as shown in FIG. 29*c*. The second segment 2902 is advanced by the hydraulic jack cylinders connecting the forward most segment 2901 with the second segment 2902 retracting and the hydraulic jack cylinders connecting the second segment 2902 with the third segment 2903 simultaneously extending. Each subsequent segment advances in turn in a like manner as shown in FIGS. 29*d* through 29h. Finally, as shown in FIG. 29*i,* the aft most segment 2908 moves forward, pulled by the hydraulic jack cylinders connecting the aft most segment 2908 with second to last segment 2907. As the aft most segment 2908 advances, spoil is injected into the volume 2914 behind the machine created by the motion of the aft most segment 2908. The distance 2980 through which the rear end of the machine has advanced in one full cycle of movement in the direction indicated by arrow 2915 is the same as that of the front end shown by 2900. Now the machine has completed one cycle of motion and has advanced a distance 2900 at an average advance rate of the instantaneous advance rate of each segment divided by the number of segments.

Figure 30A:
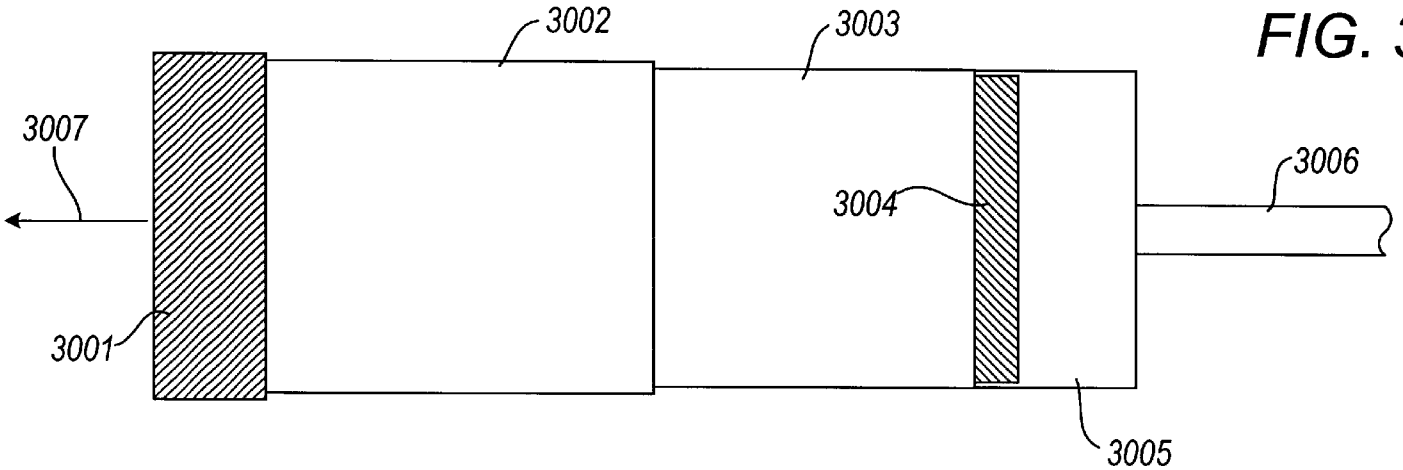
FIG. 30 shows a side view of several means for a large shield machine to execute an underground turn.
Figure 30B:
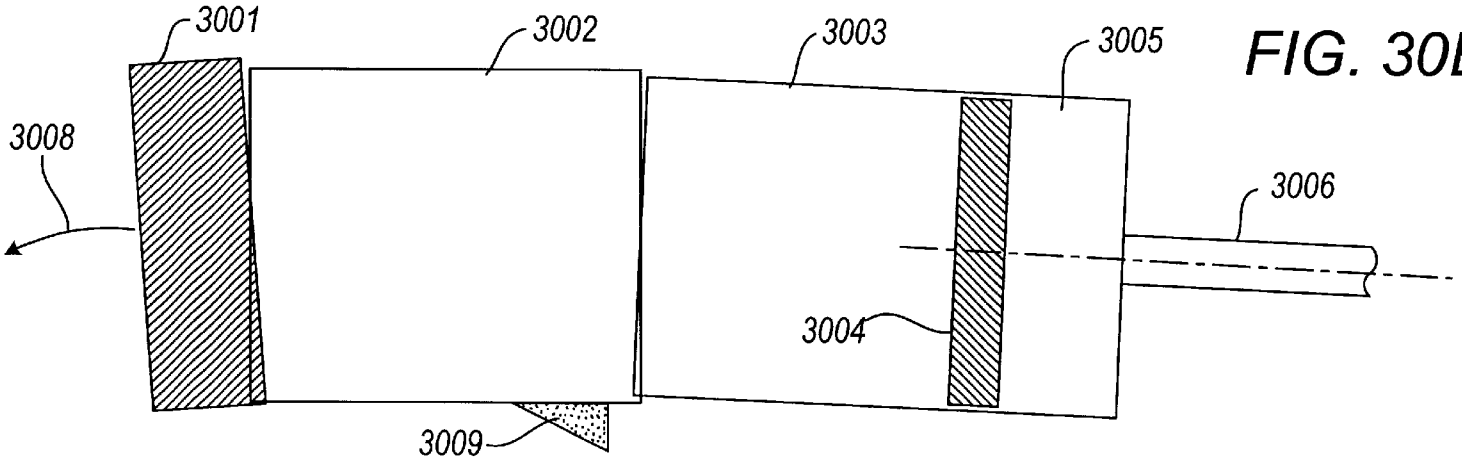

FIG. 30 shows various alternate means for a TBM mining machine to propel and steer itself. FIG. 30*a* shows a mining machine in a straight, non-turning position. The cutter head 3001, the forward segment 3002, the rear segment 3003, the backfill thrust plate 3004, the backfill tail shield 3005 and the access tunnel tail shield 3005 are all shown in-line along the same axis. The direction of motion of the mining machine is indicated by the arrow 3007. FIG. 30*b* shows the various means by which a mining TBM can turn. The turn can be to the left, to the right, upwards or downwards or any combination thereof Also any of the means of turning may be applied in any combination to achieve a desired machine positional control and steering. The cutter head 3001 can be articulated with respect to the forward segment 3002 to turn in the direction indicated by arrow 3008. The forward segment 3002 may be articulated with respect to the rear segment 3003 by, for example, differentially extending its connecting hydraulic cylinders to turn in the direction indicated by arrow 3008. A hydraulically or otherwise actuated drag plate 3009 may be deployed to cause additional drag which will cause the machine to turn in the direction indicated by arrow 3008. The backfill tail shield 3005 is attached to the rear segment 3003 and so follows the motion of the rear segment 3003. The backfill thrust plate 3004 may be articulated with respect to the rear segment 3003 to turn in the direction indicated by arrow 3008. The access tunnel tail shield 3006 is attached to the backfill thrust plate 3004 and so follows the motion of the backfill thrust plate 3004. The cutter tools (not shown in this view) mounted on the cutter head 3001 may be retracted, extended and oriented by hydraulic actuators to also affect the cutting forces applied to the excavated face. This action can also be used alone or in combination with any of the aforementioned methods to achieve a desired machine positional control and steering. As will be appreciated, drag plates can be located on the right side of the machine to facilitate right turns, on the left side of the machine to facilitate left turns, on the bottom of the machine to facilitate downward turns, and/or on the top of the machine to facilitate upward turns. A drag plate, as its name implies, contacts a wall of the excavation and the resulting frictional force causes the advancement of the machine side on which the drag plate is located to be slower than the opposite side of the machine on which the drag plate is absent or is in the retracted position. The drag plates may be hinged to rotate outwardly (the deployed position) and inwardly (the retracted position), or the drag plates may be hydraulically extended and retracted without hinging.

Figure 31:
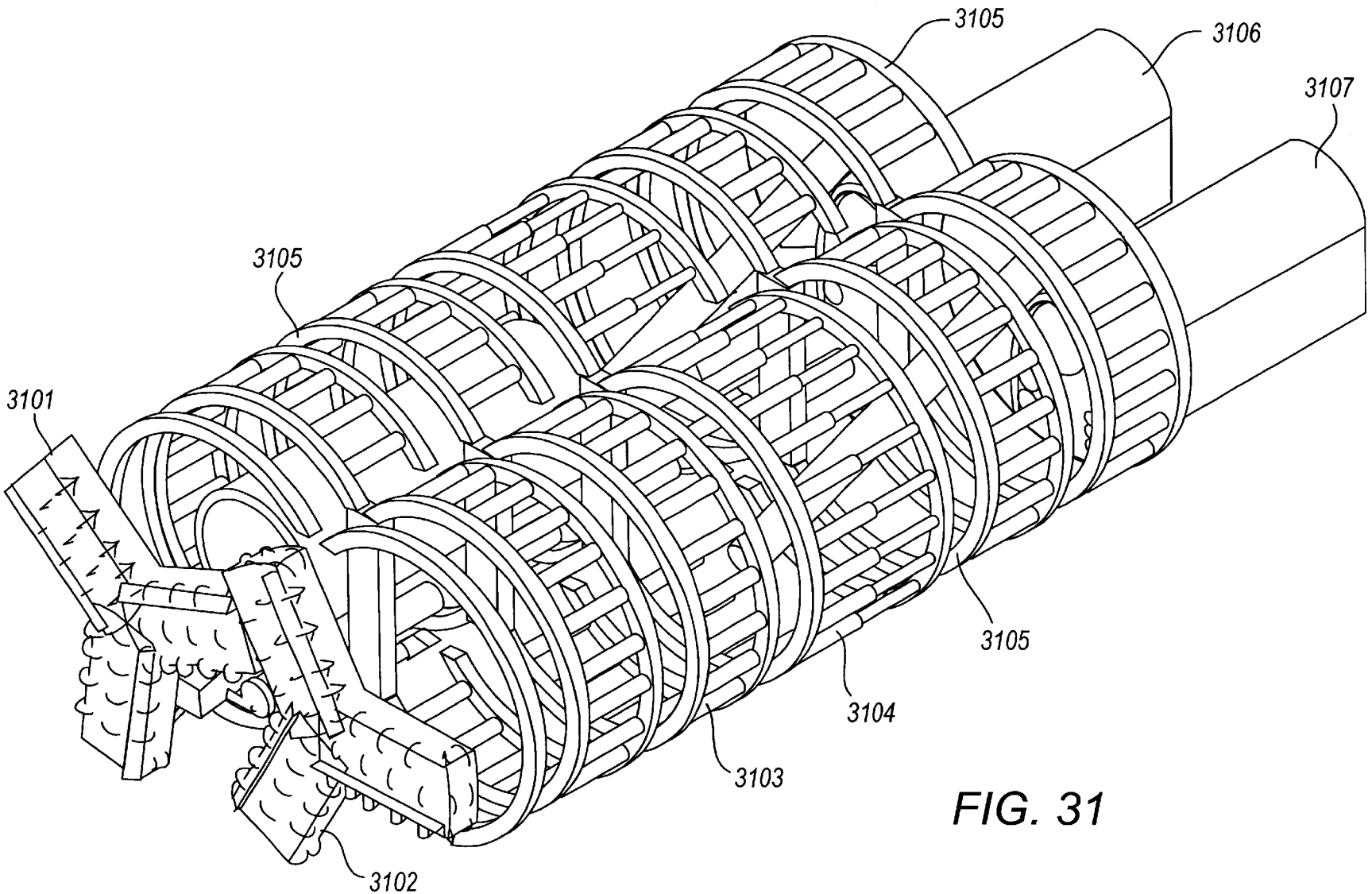
FIG. 31 shows an isometric view of a possible the hydraulic cylinder arrangement for propulsion and steering of a multi-segmented machine with two rotary cutter heads.

FIG. 31 shows an isometric view of a possible the hydraulic cylinder arrangement for propulsion and steering of a basic segmented machine with two rotary cutter heads 3101 and 3102. This binocular TBM can mine a roughly rectangular cross-section. FIG. 31 highlights the arrays of retracted hydraulic push jack cylinders 3103 and extended cylinders 3104 that provide the propulsion and steering capability for the machine. In the embodiment shown in FIG. 31, the segments of the machine are all connected to form a single skeletal structure by the arrays of cylinders which are attached to thrust plates 3105 as shown. The machine shown has dual trailing access tunnel tail shields 3106 and 3107. This machine configuration is capable of erecting dual access tunnel liners, one of which may contain all input utilities and material pipelines and the other output utilities and material pipelines. In addition, the dual tunnels themselves may serve as input and output ventilation ducts. Dual tunnels also provide safe egress in the event that one of the tunnels collapses.

Figure 32:
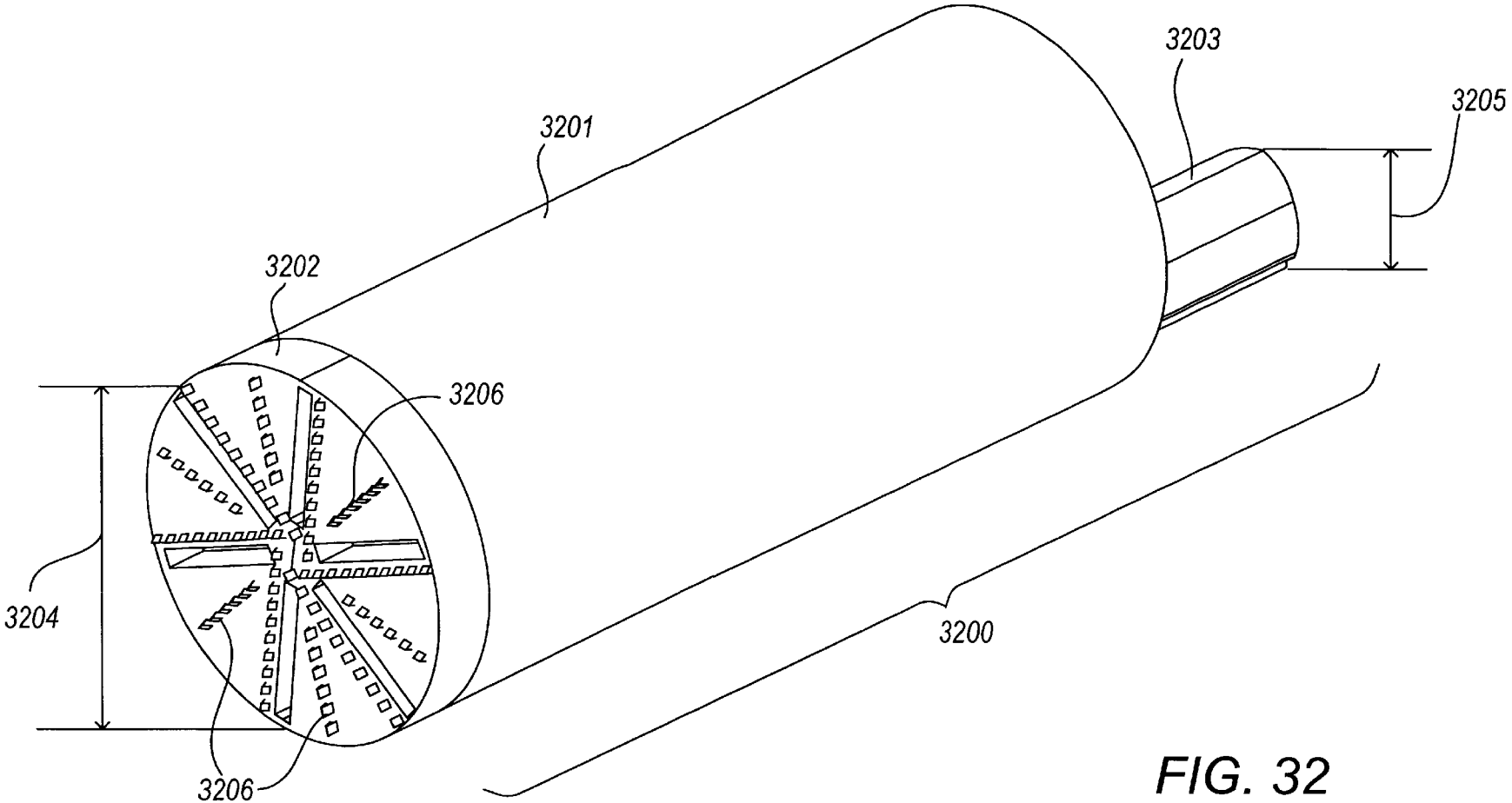
FIG. 32 illustrates a large one-segment TBM mining machine that can be steered by a combination of cutter head movements and thrust backplate movements.

FIG. 32 shows an example of a single segmented TBM mining machine. The machine 3200 is formed from a single large shield 3201, an articulated cutter head 3202 and an access tunnel tail shield 3203. A typical diameter 3204 for the main shield 3201 and cutter head 3202 is in the range of approximately 10 meters to 20 meters. A typical dimension 3205 for the access tunnel tail shield 3205 is in the range of approximately 2.5 meters to 4 meters. The machine 3200 can be propelled by thrusting off the backfill material. The machine 3200 can be steered by any combination of means such as (1) the cutter head 3202 articulating with respect to the main shield 3201; (2) the backfill thrust plate (not shown) articulating with respect to the main shield 3201; (3) deploying one or more a drag plates (not shown) from the main shield 3201; and (4) retracting, extending and/or orienting the cutter tools 3206 on the cutter head 3202.

Figure 33:
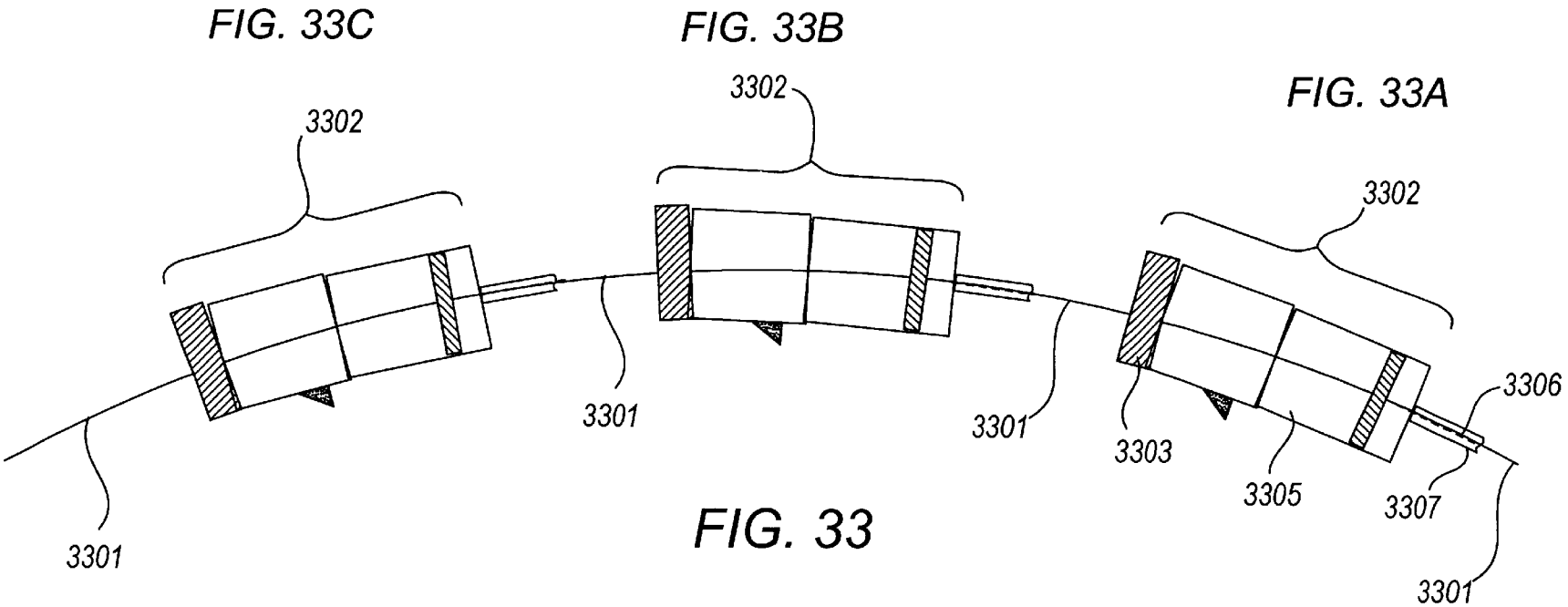
FIG. 33 shows sequence illustrating how a large mining machine of the present invention can execute an underground turn.
Figure 34C:
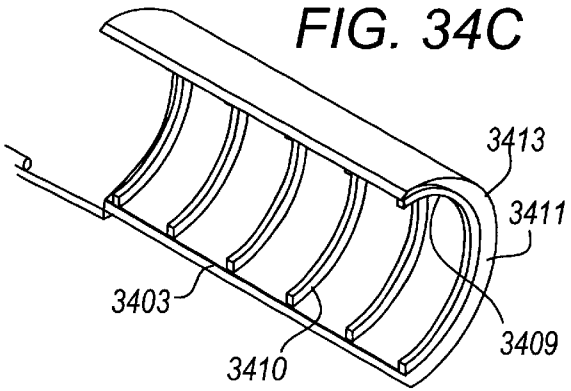
FIG. 34 shows an apparatus for forming an extruded liner and a side view of soft-ground grippers.
Figure 34B:
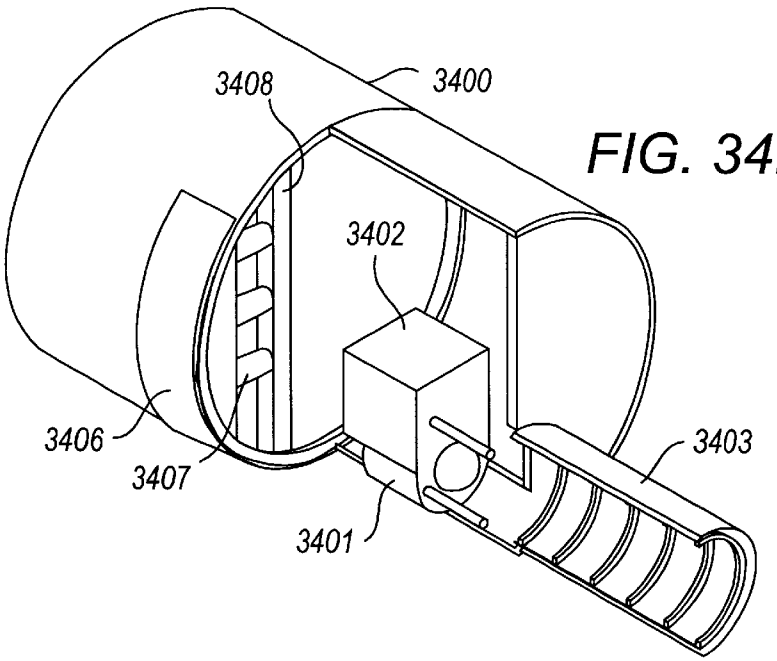
Figure 34A:
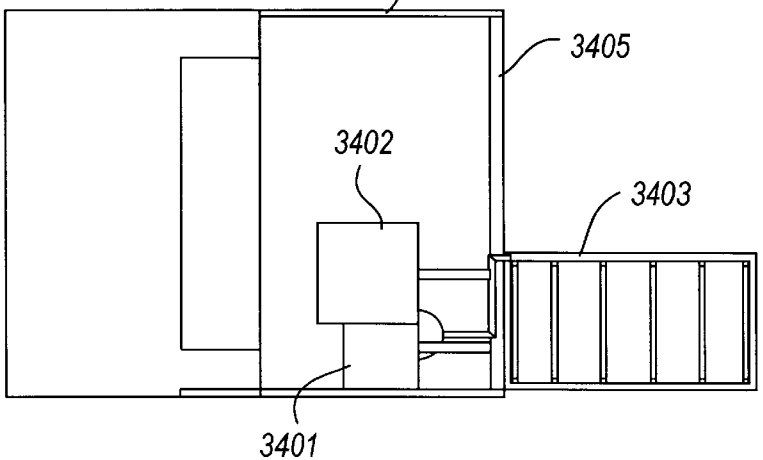
Figure 34D:
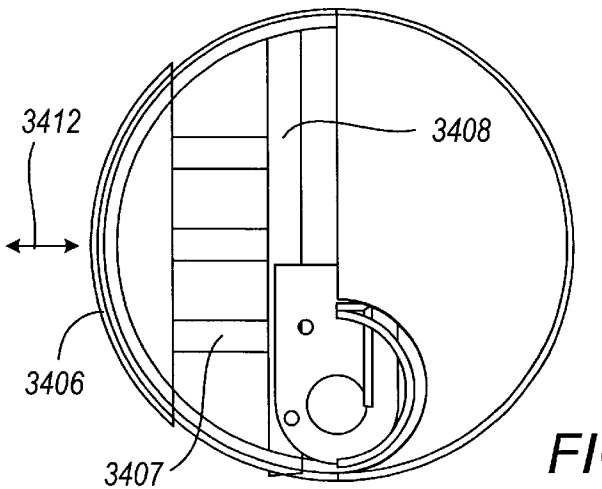

FIG. 33 shows a turning sequence that might be used to execute a turn required by one of several possible mining patterns or to avoid barren ground or to navigate around an obstacle. The turn may be executed in any orientation in space (right, left, up, down etcetera). The desired path of excavation is shown by the track 3301. In FIG. 33*a*, the mining machine 3302 is shown entering the turn, using several means to cause the cutter head 3303, the forward segment 3304 and the rear segment 3305 to turn in the desired direction. The axis 3306 of the access tunnel tail shield 3307 remains aligned with the desired track 3301. FIG. 33*b* shows the machine 3302 in the middle of the desired turn. FIG. 33*c* shows the machine 3302 near the end of the desired turn. All through the turn, The axis 3306 of the access tunnel tail shield 3307 remains aligned with the desired track 3301. As will be appreciated, the right turn is the mirror image of the left turn.

Access Tunnel Liners

An important feature of the present invention is an access tunnel that has a substantially smaller cross-sectional area than the cross-sectional area of the main excavation. There are several means to form the access tunnel, including erecting pre-cast liner segments, extruding the liner or allowing the liner to be formed by consolidated backfill material formed around a temporary form. The preferred embodiment is an extruded liner.

FIG. 34 shows an apparatus for forming an extruded access tunnel liner and also shows a side view of soft-ground grippers. FIG. 34*a* shows a side view of a mining machine 3400 which shows a concrete batch mixing plant 3401 and an apparatus 3402 for extruding concrete into a liner form 3403. The mixing plant 3401, the extruding apparatus 3402 and the end of the liner form 3403 are all contained inside the mining machine 3400 behind the backfill thrust plate 3405. FIG. 34*b* is an isometric view of the same machine 3400 showing the mixing plant 3401, the extruding apparatus 3402, the liner form 3403 and the backfill thrust plate 3405. Also shown in this view is a gripper plate 3406 and its associated hydraulic cylinders 3407. The gripper plate 3406 is moved in and out to contact the wall of the excavation, when needed, by the cylinders 3407 thrusting off a thrust plate 3408 which is rigidly connected to the mining machine 3400. FIG. 34*c* shows an isometric view of the liner form 3403. The liner form 3403 is comprised, for example, of an outer slip form shell 3413 and an inner slip form shell 3409. The inner shell 3409 also may include strengthening ribs 3410. The concrete or other suitable liner material is extruded into the space 3411 between the outer shell 3413 and the inner shell 3409. As the mining machine 3400 advances forward, the liner form 3403 advance with the machine 3400, leaving behind a shell of extruded liner material. FIG. 34*d* is a cross-section view that shows the gripper plate 3406, the gripper plate extension/retraction cylinders 3407 and the fixed gripper thrust member 3408. The inward and outward motion of the gripper plate is illustrated by the two way arrow 3412.

Figure 35:
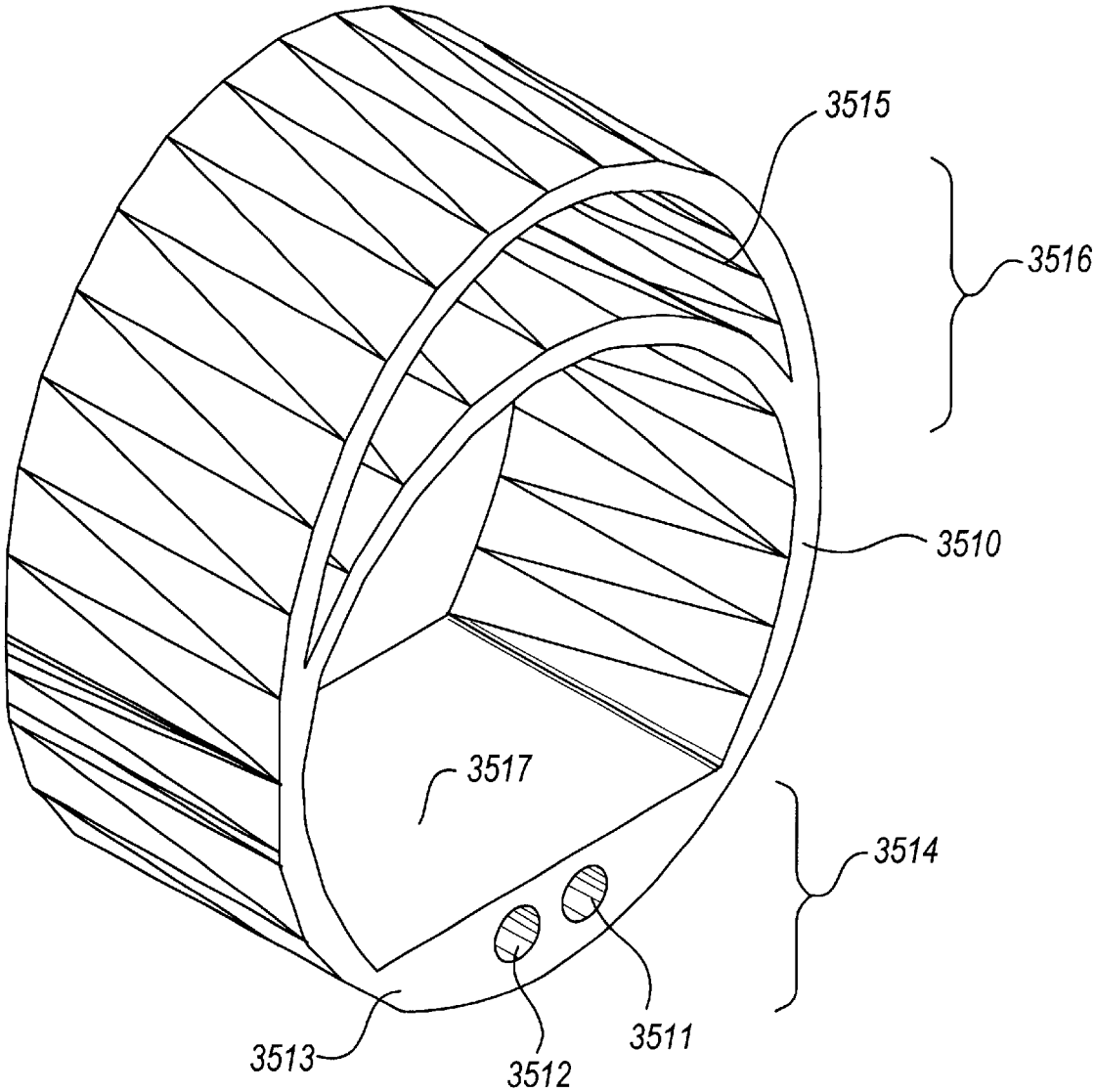
FIG. 35 shows an isometric view of a possible extruded access liner which contains pipelines and other ducts and conduits formed within the liner material.

As noted above, the access tunnel liner may be formed by extruding concrete or some other suitable liner material between moveable forms. It then becomes possible to fabricate the forms such that slurry pipelines and other utilities conduits are formed into the liner. This would eliminate the need for separate slurry pipelines and other utilities pipelines and ducts. FIG. 35 shows an isometric view of a possible extruded access liner which contains pipelines and other ducts and conduits within the liner material. A possible extruded concrete access liner 3510 which contains an outgoing ore slurry pipeline 3511 and an incoming tailings slurry pipeline 3512 formed into the extruded liner material 3513 within the bottom portion or invert 3514 of the liner 3510. A ventilation duct 3515 is shown formed into the top portion or crown 3516 of the liner 3510. The floor 3517 of the tunnel liner 3510 is preferably flat to allow transport vehicles to pass in and out of the access tunnel.

There may be situations where dual access tunnels are required for safety and/or regulatory reasons. In addition, it may be advantageous to have dual access tunnels for ventilation and utilities. For example, one tunnel can be used for in-going ventilation and slurries and the second tunnel for outgoing ventilation and slurries. FIG. 36 shows several views of a multi-segmented binocular type TBM with dual trailing access tunnels. FIG. 36*a* shows a side view illustrating the cutter head 3601, several shield segments 3602 and an access tunnel tail shield 3603. FIG. 36*b* shows a plan view of the machine showing the two main TBM cylinders 3604 and 3605 and the dual access tail shields 3606 and 3607. One of the segments 3608 is shown in a retracted state while the other segments are shown fully extended. FIG. 36*c* is an isometric view of the mining machine and shows the two cutter heads 3609 and 3610. FIG. 36*d* shows a cross-section rear view and illustrates two backfill ducts 3611 and 3612 as well as two access tunnel liners 3613 and 3614 with their included utilities which were described elsewhere.

Figure 37:
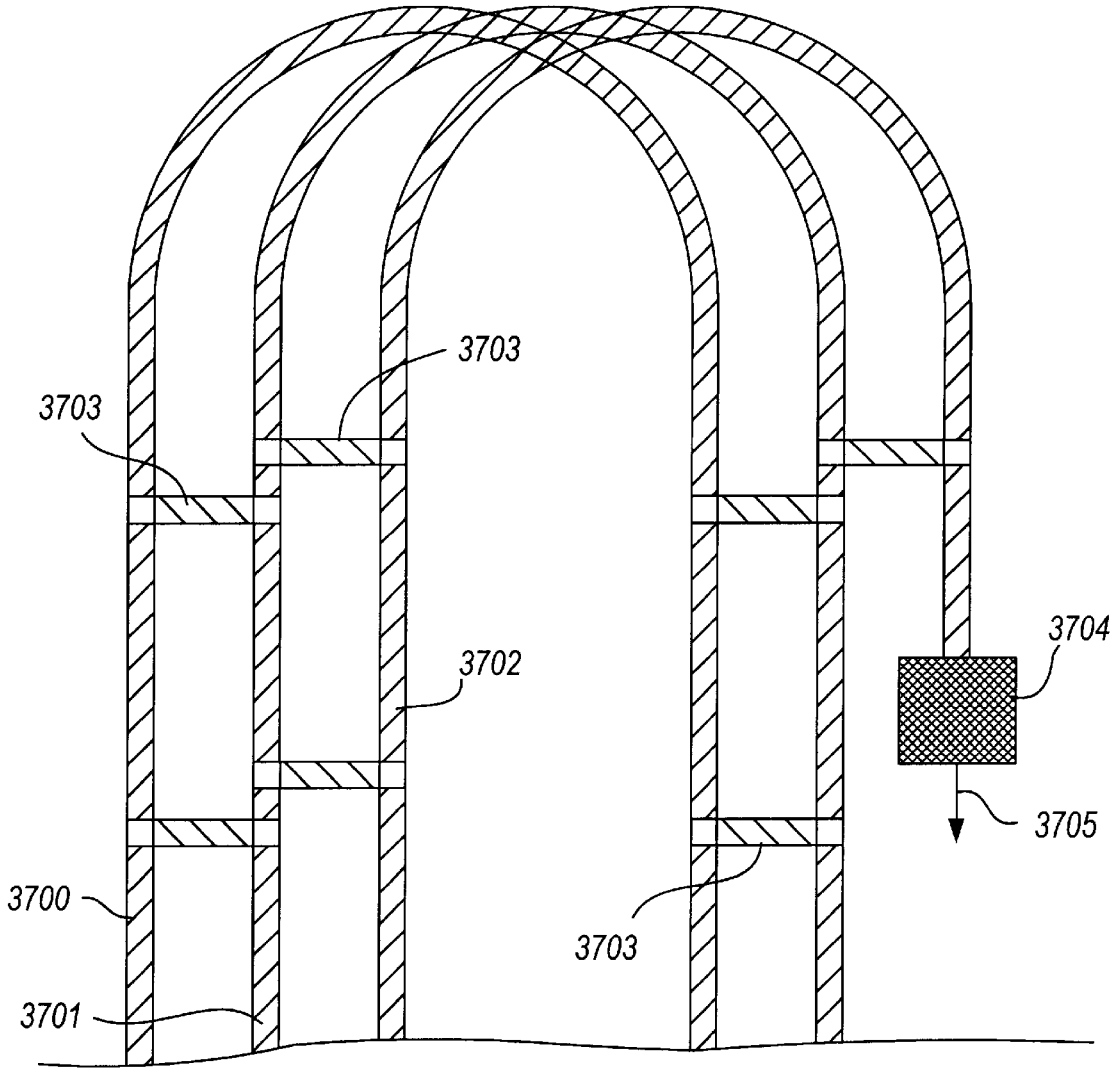
FIG. 37 shows a plan view of access tunnels in the formation with cross-connecting tunnels to provide entry to neighboring access tunnels to assist in emergency escape.

In many mining operations accessed by adits or tunnels, two or more adits may be required for personnel safety and exit. In a typical mining pattern envisioned in the present invention, a series of horseshoe tunnels, for example, may be driven with each successive tunnel adjacent to the previous tunnel. The first tunnel drive in a pattern will have only one exit during installation. Each successive TBM drive will leave an access tunnel that can be connected to neighboring abandoned access tunnels by a small diameter, lined drift so that personnel can get from one access tunnel to the next, thereby providing the required multiple exits. FIG. 37 shows a plan view of access tunnels in a formation with cross-connecting tunnels to provide entry to neighboring tunnels to assist in emergency escape. FIG. 37 illustrates two completed access tunnels 3700 and 3701. One tunnel 3702 is in the process of being excavated by a mining machine 3704 which is advancing in the direction indicated by arrow 3705. The tunnels are offset because the cross-section of the area mined is much larger than the cross-sectional area of the trailing access tunnels. A number of cross-connections 3703 are shown connecting the completed tunnels. The uncompleted tunnel 3702 is shown connected in three locations to the previously installed access tunnel. The interconnections can also be equipped with air-tight doors or hatches so that tunnels can be isolated from other tunnels that may have unsafe levels of toxic gases.

Alternate Cutter Heads

In certain geologic environments, the front-end of the mining machine of the present invention can be comprised of an array of shovel, picks and ripper tool heads such as shown for example in FIG. 38. This open-face approach has the advantage of being flexible for excavating variable geology and for maintenance, servicing and overhauling. FIG. 38*a* shows an isometric view of the front end of mining machine 3801 that uses a hydraulically actuated shovel/scoop 3802 for excavating in relatively soft rock or soil. A typical diameter 3803 for the machine 3801 is in the range of approximately 5 meters to 15 meters. FIG. 38*b* shows a possible hydraulically actuated backhoe 3804 that can dig and muck most compacted oil sands material. A hydraulic hammer/pick attachment 3805 can be mounted on the back of the backhoe assembly 3806 and can be used in harder ground. For example, the hammer/pick 3805 can chip at mud/shale inclusions or compacted oil sand accretions that cannot be broken up by the backhoe. The straight pick 3807 shown in FIG. 38*b* can be replaced by a hooked pick so that the hydraulic arm can also function as a ripper.

Figure 39:
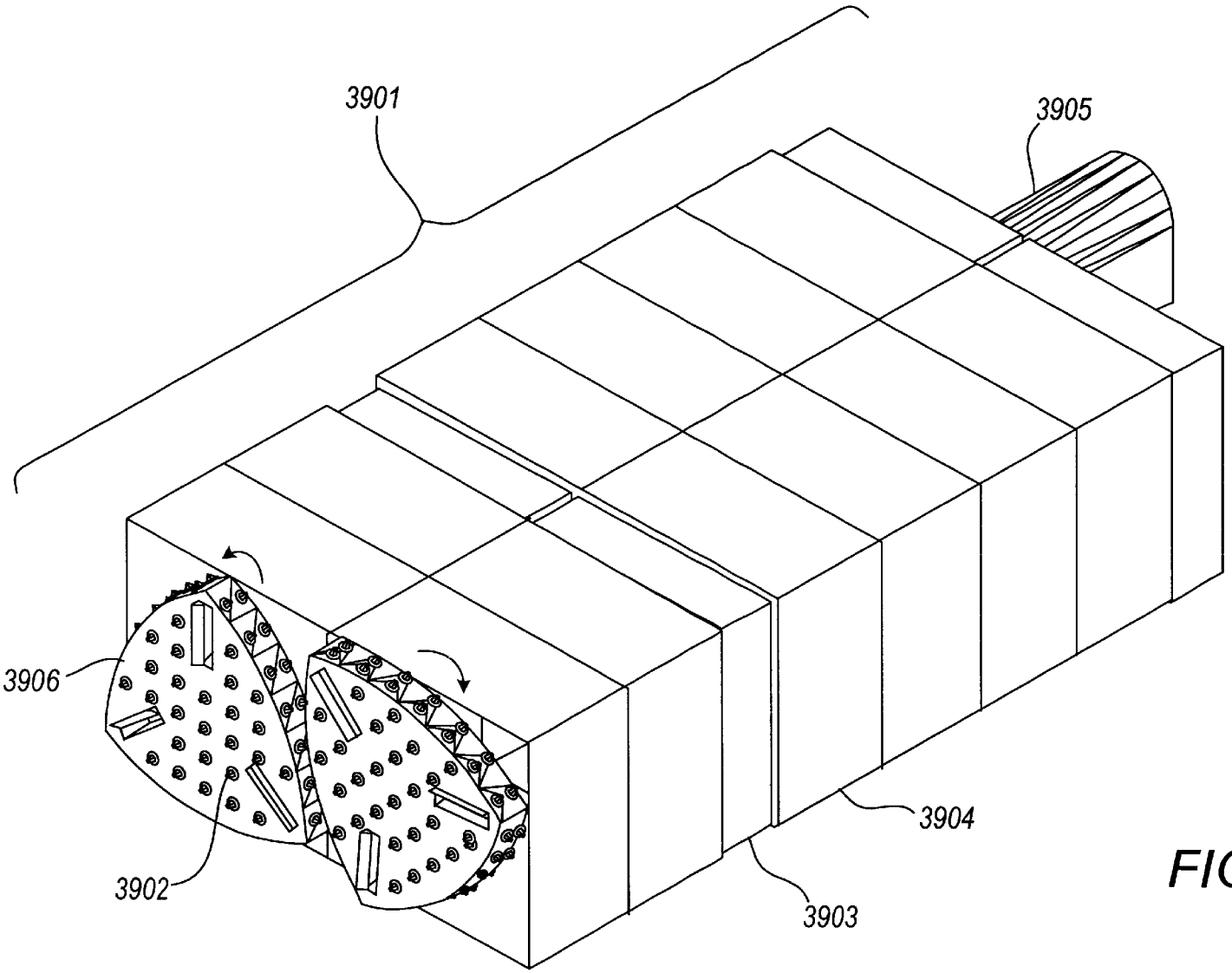
FIG. 39 shows an isometric view of a large multi-segmented excavating machine with two triangular cutter heads that can excavate a rectangular excavation opening and leave a small trailing access tunnel.

FIG. 39 shows an isometric view of a large multi-segmented excavating machine with two triangular cutter heads that can excavate a roughly rectangular excavation opening and leave a small trailing access tunnel. The machine 3901 is comprised of two Reuleaux triangle cutting heads 3902 which allow the machine to excavate and mine a rectangular cross-section. The machine is shown in a segmented embodiment with the $3^{rd}$ segment 3903 from the front fully contracted and the $4^{th}$ segment 3904 from the front fully extended. The smaller cross-section trailing access tunnel tail shield 3905 is shown extending from the rear of the advancing machine 3901. The triangular cutting heads have slightly convex sides 3906. Head rotation occurs in two kinds of motion. The first is a pure rotary motion of the head about its own shaft. The second is a circular motion of the entire cutting head and its shaft about an offset center line. This head geometry and eccentric drive system has been used in coal mining to form a square rather than a circular opening in order to extract a greater fraction of the coal in the coal seams. The heads rotate in opposite directions as indicated to substantially reduce the tendency of the machine to roll.

It is also possible to utilize a single backwards tilted rotary excavation head that can excavate a roughly rectangular excavation opening. Such a concept is described in U.S. Pat. No. 4,486,050 which is incorporated herein by reference.

Utilities Extension

In the present invention, the preferred mode of operation is to form an ore or bitumen slurry at or near the working face and hydrotransport the slurry out of the tunnel, while at the same time hydrotransporting a tailings slurry from the outside into the machine for backfill. It is preferable to maintain a relatively constant flow of slurry because of the increased difficulties of stopping and starting high-volume, relatively dense slurries. A preferred means to extend slurry lines is by the use of telescoping sections of pipeline as illustrated in FIG. 40. For example, in case of an outgoing oil sand slurry, a slurry may be formed in the cutter head or in muck chamber which is connected to a large surge tank by a fixed pipeline. The surge chamber is attached to the last fixed pipe section in the access tunnel by a series of specially designed telescoping pipe sections. As the mining machine advances, one of the telescoping sections extends until fully extended. Then the next section extends and so on until all or nearly all the sections are fully extended.

An example of a telescoping slurry pipeline section is shown in FIG. 40. FIG. 40*a* shows the end 4000 of a section 4001 of telescoping pipeline in retracted position. The inner segment 4002 is slightly smaller in diameter than the outer segment 4004. The inner surface 4005 of the outer segment 4004 is sealed against the outer surface 4006 of the inner segment 4002 by a circumferential wiper made from rubber or some other soft sealing gasket material. This sealing technique is similar to that commonly used to seal the bore and cylinder surfaces of a hydraulic cylinder. Each end of the telescoping pipe section has a bolted flange system 4007 or other suitable connection system for attaching adjacent sections together. FIG. 40*a* also shows a flexible end coupling 4003. The telescoping pipeline can therefore bend at joint 4003 when joined to an adjacent section of pipeline. FIG. 40*b* shows 14 sections of collapsed (retracted) telescoping pipe 4009 beside the same 14 sections 4010 fully or nearly fully extended such that the length of the extended sections 4010 is nearly twice the length of the fully retracted sections 4009. FIG. 40*c* shows a close-up of a fully or nearly fully extended section of telescoping slurry pipeline 4015. The seal between the inner segment 4016 and the outer segment 4017 is not shown but is located between the segments at the approximate location shown by 4018. The wiper seal would be attached to the inner segment 4016 and move with the inner segment 4016 while forming a seal against the inner surface of the outer segment 4017 by moving along the inner surface of the outer segment. Flexible flanged joints 4020 and 4021 are also shown in this view. The range of preferred lengths of telescoping sections in fully retracted position is approximately 2 meters to 6 meters. When fully extended, the range of preferred lengths of telescoping sections is about 4 to 12 meters. Typically, 10 to 20 sections of telescoping sections would be used in the present invention which would allow the telescoping pipeline to extend a distance of approximately about 50 to 100 meters before stopping to retract the telescoping pipeline.

Figure 41:
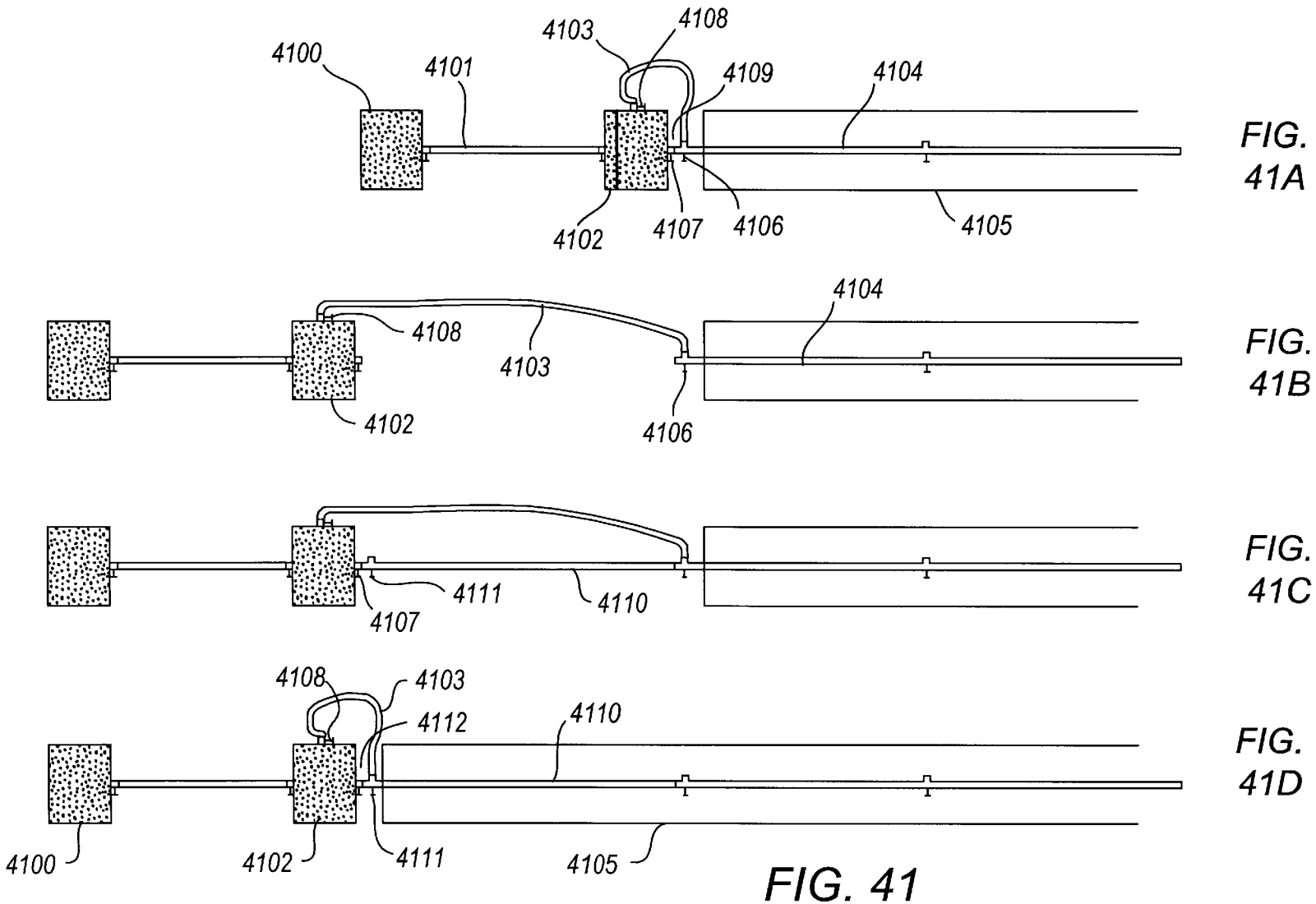
FIG. 41 shows a side schematic view of a slurry pipeline system where a flexible pipeline is used to advance a fixed slurry line section.

A another possible means to extend slurry lines at appropriate intervals is illustrated in FIG. 41. Here a slurry is formed in the cutter head or in muck chamber which is connected to a large surge tank by a fixed pipeline. The surge chamber is initially attached to the fixed pipeline in the access tunnel by a flexible slurry pipeline section which connects to a Y or T joint at the end of the last fixed pipe section in the access tunnel. As the mining machine advances, the flexible pipeline section is extended until there is enough space to attach a new section of fixed pipeline. Once the new section of fixed pipeline is installed, valves switch the flow of slurry from the flexible line to the newly installed fixed pipeline section. A valve in the surge tank switches the flow into the flexible line off while nearly simultaneously switching the flow into the newly installed fixed section of pipeline. This method may be employed whether there is or is not a routine maintenance shutdown at regular intervals. In FIG. 41*a*, a cutter head/muck chamber 4100 produces a slurry mixture which is fed via a fixed pipeline section 4101 to a slurry surge chamber 4102. The cutter head/muck chamber 4100, the fixed pipeline section 4101 and the surge chamber 4102 are contained within the forward-most section of the TBM mining machine (not shown). In FIG. 41*a*, the slurry is shown flowing from the surge chamber 4102 through a flexible pipeline section 4103 into a long series of connected fixed pipeline sections 4104 which have been previously installed and are now located in the trailing access tunnel 4105. A switch valve 4106 has switched the flow of slurry from the surge chamber exit valve 4107 to the surge chamber exit valve 4108. In FIG. 41*a*, the connection 4109 is broken so that the front section of the TBM mining machine can advance while the access tunnel 4105 remains stationary. FIG. 41*b* shows the front section of the mining TBM advanced such that the flexible pipeline section 4103 is fully or nearly fully extended. The slurry flows from the exit valve 4108 of the surge chamber 4102 through the flexible pipeline section 4103 into the switch valve 4106 and then into the long series of connected fixed pipeline sections 4104. As shown in FIG. 41*c*, a new section of fixed pipeline 4110 is installed to connect the exit valve 4107 to a new switch valve 4111. As shown further in FIG. 30*d*, the access tunnel 4105 is extended, the slurry is diverted from exit valve 4108 of the surge chamber 4102 to exit valve 4107 of the surge chamber 4102 so that there is no flow through the flexible section 4103. The downstream end of the flexible section 4103 is now connected to the new switch valve 4111 at the upstream end of the newly installed fixed section 4110. At this time, the slurry can be diverted from the exit valve 4107 of the surge chamber to the exit valve 4108 of the surge chamber so that there is again slurry flow through the flexible section 4103. Once the connection 4112 is broken, the situation is returned to that depicted in FIG. 41*a* and the process of moving the cutterhead/muck chamber 4100 can be repeated.

Use of Access Tunnels

The machine described in the present invention leaves behind a lined access tunnel. When the machine excavates hydrocarbon deposits, it often encounters gas either in the form of free gas contained in structural pockets or in the form of bound gas dissolved in the formation water and hydrocarbon material. When the excavated volume is exposed to significantly lower pressure such as atmospheric pressure, the dissolved gas will begin to come out of solution and flow towards the excavation. The flow rate will be limited by the local permeability. One of the major features of the invention described herein is the formation of a trailing access tunnel behind the excavation/mining machine. After a volume of the hydrocarbon ore body is mined out, there will remain a network of such access tunnels. FIG. 42 shows a side schematic view of a special rock bolt that penetrates the access tunnel wall and can be used to tap gas from the surrounding formation and an isometric schematic illustrating how the rock bolts can be positioned around the access tunnel. A special rock or sand bolt concept for gas drainage is illustrated in FIG. 42*a*. In one configuration, a bolt 4200 is installed through the tunnel liner 4201 into the formation 4202. The bolt 4200 has a passage 4203 which connects an exit port 4204 in the bolt head 4205 to a series of perforations 4206 along the length of the bolt 4200. When the gas formation 4202 is at a higher pressure than the ambient pressure in the tunnel, the gas will flow through the formation 4202, enter the perforations 4206, flows down the passage 4203 and enters a gas collection system 4207 which is connected to the exit port 4204. A value 4208 is set so that the gas can only flow into the collection system 4207. The same bolt is shown in FIG. 42*b* for injecting gases into the formations. A bolt 4250 is installed through the tunnel line 4251 into the formation 4252. The bolt 4250 has a passage 4253 which connects an exit port 4254 in the bolt head 4255 to a series of perforations 4256 along the length of the bolt 4250. When the gas in the tunnel 4257 is at a higher pressure than the pressure in the formation 4252, the gas will flow down the passage 4253, exit the bolt 42250 through the perforations 4256, be injected into the formation 4252. A valve 4258 is set so that the gas can only flow from the tunnel 4257 to the formation 4252. The bolt described above is preferably in the range of 20-mm to 60-mm diameter. The length of the bolt is preferably in the range of 9.1 to 9.75 times the access tunnel diameter or principal dimension. FIG. 42*c* illustrates an example of how gas drainage/injection bolts could be installed in a section of tunnel 4270. Gas bolts 4270*b* may be arranged so that a gas bolt penetrates into both sides of the formation 4271 and into the top of the formation 4272. Gas bolts may be installed in such a pattern at intervals 4273 along the length of the tunnel 4270. Although now shown, gas bolts may also be installed in the floor of the tunnel 4274 to drain or inject gases in the formation below the tunnel. The gas bolt heads can be recessed in the tunnel floor.

TBM Cutters

Figure 43:
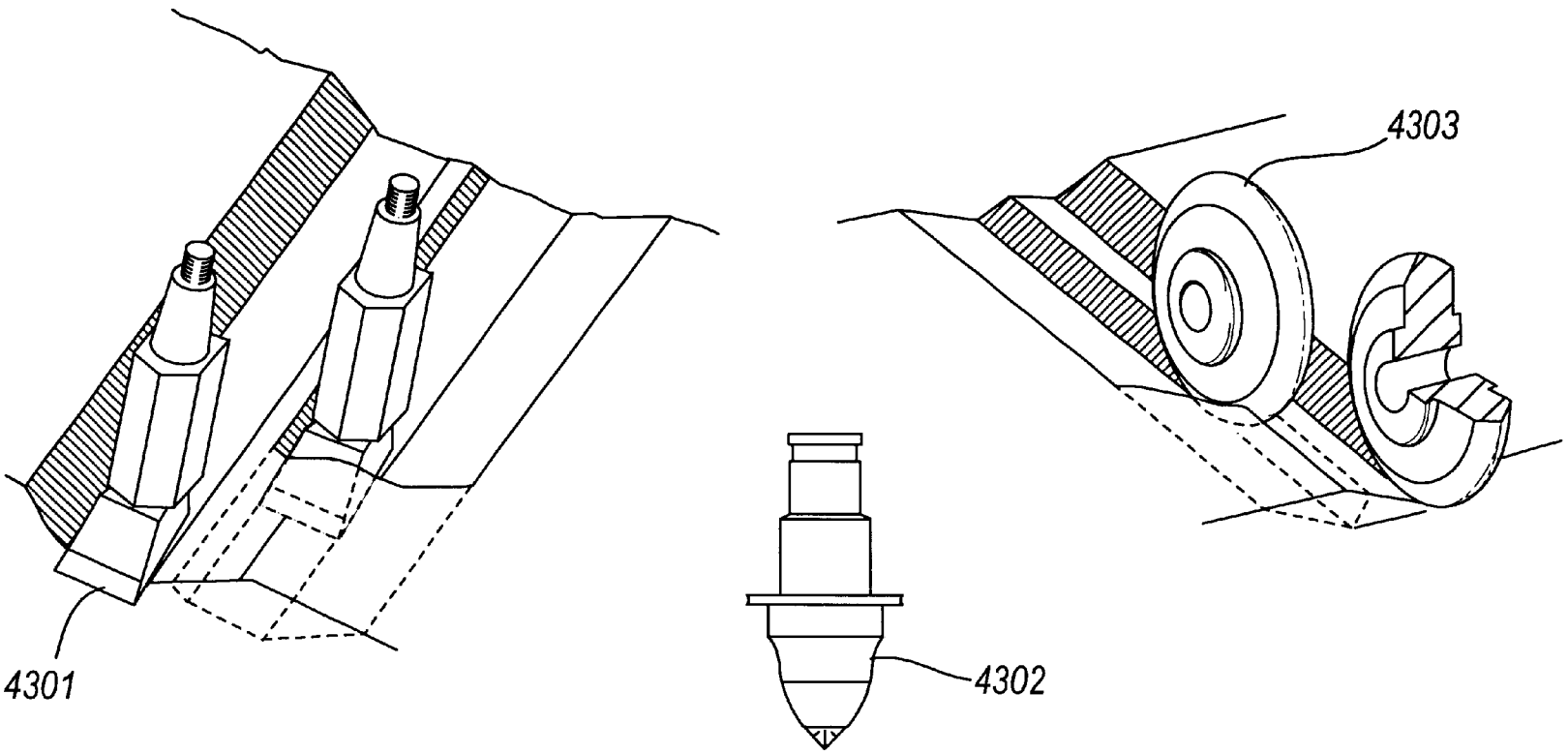
FIG. 43 shows some of the various cutter tools that can be used on TBM cutter heads.

As will be appreciated, any suitable cutter configuration can be used on the tunnel boring machine. For example, FIG. 43 shows examples of possible cutter tools that can be used in a tunnel boring machine configuration preferred for mining in the present invention. Drag bits 4301, picks 4302 and disc cutters 4303 are shown. These tools can be augmented by water jets that can be aimed at or near where the tools contact the rock or compacted soil so as to increase the efficiency of breakage and reduce the wear on the cutting edges.

The foregoing discussion of the invention has been presented for purposes of illustration and description, the foregoing is not intended to limit the invention to the form or forms disclosed herein. Although the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An underground mining method, comprising:

excavating in situ material in an underground excavation with a tunnel boring machine;

backfilling at least a portion of the underground excavation with a particulate material to define a trailing passage, wherein an area of a cross-section of the trailing passage is no more than about 30% of an area of a cross-section of the at least a portion of the excavation before backfilling; and thrusting off of the backfilled particulate material to propel the tunnel boring machine forward.

2. The method of claim 1, wherein the backfilled particulate material was previously excavated by the tunnel boring machine and the backfilled particulate material is unconsolidated after the backfilling step.

3. The method of claim 1, wherein in the excavating step a movable shield is used to provide ground support during excavating and further comprising:

forming a tunnel liner under the movable shield to provide ground support for the trailing passage.

4. The method of claim 1, further comprising:

removing from the underground excavation a first portion of the material excavated by the tunnel boring machine and wherein in the backfilling step a second portion of the material excavated by the tunnel boring machine is used as the particulate material.

5. The method of claim 4, wherein the second portion of the material is not removed from the excavation.

6. The method of claim 1, wherein the in situ material contains hydrocarbons and the in situ overburden material is sedimentary in origin.

7. The method of claim 1, wherein in the backfilling step a form is positioned in the excavation and the backfilling step includes the steps of:

contacting the backfill material with a binder; and placing the binder-containing backfill material around the form.

8. The method of claim 1, wherein the area of the cross-section of the trailing passage is no more than about 20% of the area of the cross-section of the at least a portion of the excavation before backfilling.

9. The method of claim 1, wherein backfilled particulate material is not placed between the body of the tunnel boring machine and the adjacent wall of the underground excavation.

10. An underground mining method, comprising:

removing in situ material from an excavation face in an underground excavation using a tunnel boring machine, the underground excavation having a cross-sectional area near the excavation face and in a direction transverse to a direction of excavation; and forming at least a portion of the removed material into a consolidated liner between the excavation face and a surface opening of the underground excavation to define a trailing tunnel, the trailing tunnel having a cross-sectional area in a direction transverse to a direction of excavation that is no more than about 30% of the cross-sectional area of the underground excavation, wherein the consolidated liner remains stationary after formation.

11. The method of claim 10, wherein the in situ material is at least one of coal, oil shale, oil sands, bauxite, trona, potash, and oil-containing materials and wherein cross-sectional area of the trailing tunnel is no more than about 20% of the cross-sectional area of the underground excavation.

12. The method of claim 10, wherein the forming step includes:

contacting the removed material with a binder to form the consolidated liner and wherein cross-sectional area of the trailing tunnel is no more than about 10% of the cross-sectional area of the underground excavation.

13. The method of claim 10 further comprising:

transporting at least a second portion of the removed material to a processing facility located outside of the excavation; and thrusting off of the consolidated liner to propel the tunnel boring machine forward.

14. The method of claim 13, wherein the transporting step includes the step of forming the at least a second portion of the removed material into a slurry and hydrotransporting the slurry out of the excavation.

15. The method of claim 14, wherein the transporting step includes:

placing at least a portion of the slurry in a surge tank.

16. The method of claim 10, further comprising:

processing at least part of the removed material in the excavation to form the at least a portion of the removed material, the at least a portion of the removed material being waste from the processing step.

17. The method of claim 10, further comprising:

sensing a type of unexcavated material ahead of the excavation face and wherein the sensing is performed using an active acoustic source.

18. The method of claim 10, wherein the removing step includes:

advancing the tunnel boring machine; and extending a telescopic, accordion, or flexible slurry pipeline as the tunnel boring machine advances.

19. An underground mining method, comprising:

(a) removing consolidated in situ material from an excavation face in an underground excavation using a tunnel boring machine, the underground excavation having a cross-sectional area near the excavation face and in a direction transverse to a direction of excavation;

(b) placing at least one of a liner and form between the excavation face and a surface opening of the underground excavation to form a trailing passage, the at least one of the liner and form having an outer periphery that is smaller in size than the excavation and remaining stationary after placement; and (c) placing at least a portion of the removed material between the at least one of the liner and form and a surface of the excavation.

20. The method of claim 19, wherein the at least one of a liner and form is a liner and the liner is self-supporting and consolidated, wherein the liner remains stationary as the tunnel boring machine forming the excavation is propelled forward and, wherein a cross-sectional area of the trailing passage is no more than about 30% of the cross-sectional area of the underground excavation.

21. The method of claim 20, wherein the cross-sectional area is no more than about 10% of the underground excavation cross-sectional area.

22. The method of claim 19, wherein the placing step (c) includes:

forming the removed material into a first slurry;

transporting the first slurry away from the tunnel boring machine;

processing, at a location distant from the tunnel boring machine, the removed material in the first slurry;

forming, at the distant location, the processed removed material into a second slurry; and transporting the second slurry from the distant location to the tunnel boring machine.

23. The method of claim 22, wherein only a first portion of the removed material is in the first slurry and the processing step is performed outside of the excavation and a second portion of the removed material is not removed from the excavation.

24. The method of claim 19, further comprising:

propelling the tunnel boring machine forward by thrusting off of the removed material positioned between the at least one of a liner and form and the surface of the excavation.

25. The method of claim 24, wherein the removed material positioned between the at least one of a liner and form and the surface of the excavation is unconsolidated.

26. The method of claim 19, wherein removed material is not placed between the body of the tunnel boring machine and the adjacent surface of the excavation.

27. A continuous underground mining method, comprising:

removing consolidated material from an underground excavation face using a continuous mining machine, the continuous mining machine being located near the excavation face;

placing at least a first portion of the removed material behind the continuous mining machine to form a trailing opening having a cross-sectional area transverse to a direction of excavation that is no more than about 30% of a cross-sectional area of the excavation transverse to the direction of excavation at the location of the continuous mining machine;

removing at least a second portion of the removed material from the underground excavation.

28. The method of claim 27, wherein the at least a first portion of the removed material is contacted with a binder before the placing step.

29. The method of claim 27, wherein the removed material is processed within the continuous mining machine and the at least a first portion of the removed material is waste of the processing step and wherein the second portion of the removed material is transported away from the continuous mining machine to a processing facility.

30. The method of claim 29, wherein the material includes oil sands and the processing includes separating bitumen in the oil sands from the oil sands and wherein the trailing opening is formed by a consolidated liner that remains stationary as the continuous mining machine is propelled forward.

31. The method of claim 27, wherein the continuous mining machine is a tunnel boring machine.

32. The method of claim 31, further comprising:

propelling the tunnel boring machine forward by thrusting off of the removed material placed behind the tunnel boring machine.

33. The method of claim 32, wherein the removed material placed behind the tunnel boring machine is unconsolidated.

34. The method of claim 32, wherein removed material is not placed between the body of the tunnel boring machine and an adjacent surface of the underground excavation.

35. The method of claim 27, further comprising displacing the continuous mining machine in the direction of the excavation by pushing against the at least a first portion of the removed material located behind the continuous mining machine.

36. The method of claim 27, wherein only the second portion of the removed material is removed from the underground excavation while the first portion of the removed material is not removed from the underground excavation.

37. An underground mining method for excavating a hydrocarbon-containing material, comprising:

passing a tunnel boring machine through the in situ hydrocarbon-containing material to form a tunnel;

forming a consolidated liner in the tunnel behind the tunnel boring machine, the consolidated liner defining a trailing passage and remaining at least substantially stationary; and placing a backfill material in the tunnel behind the tunnel boring machine and around the liner to provide ground support for the trailing passage.

38. The method of claim 37, wherein the backfill material is unconsolidated and comprises at least a portion of the excavated hydrocarbon-containing material and wherein the trailing passage has a cross-sectional area that is no more than about 20% of a cross-sectional area of the unlined tunnel.

39. The method of claim 37, wherein the tunnel boring machine has a plurality of segments and further comprising:

displacing a leading segment forward by pushing against a trailing segment.

40. The method of claim 39, further comprising after the displacing step:

pulling the trailing segment forward using the displaced leading segment.

41. The method of claim 37, further comprising:

forming the liner in the tunnel formed by the tunnel boring machine, the liner including material excavated by the tunnel boring machine and being located behind the machine; and displacing the trailing segment forward by pushing against the liner.

42. The method of claim 37, wherein the tunnel boring machine forms, through the hydrocarbon-containing material, a tunnel having a "U"-shape and wherein the tunnel is on one level.

43. The method of claim 42, wherein the tunnel has an approximately rectangular cross-section in a direction transverse to the long axis of the tunnel.

44. The method of claim 42, further comprising:

determining the position of the tunnel boring machine using a global positioning satellite and a fibre optic surveying line that is maintained along the tunnel behind the tunnel boring machine.

45. The method of claim 42, wherein the tunnel boring machine includes at least one cutting head.

46. The method of claim 42, wherein the hydrocarbon-containing material is oil sands and further comprising:

comminuting, in the tunnel, the excavated oil sands with a crusher;

forming, in the tunnel, the comminuted oil sands into a slurry;

hydrotransporting the slurry from the tunnel to a processing facility located at a distance from the tunnel boring machine;

at the processing facility, removing hydrocarbons from the comminuted oil sands forming a hydrocarbon product and a solid waste material;

at the processing facility, forming the solid waste material into a waste slurry; and hydrotransporting the waste slurry from the processing facility to the tunnel boring machine, wherein the backfill material comprises the solid waste material in the waste slurry.

47. The method of claim 46, further comprising:

spraying an excavation face with water during the passing step to form the excavated hydrocarbon-containing material into a slurry;

transporting the slurry through the tunnel boring machine; and when the slurry is in the tunnel boring machine, maintaining the slurry at a pressure from about 0.1 to about 3 atmospheres higher than a formation pressure of the in situ hydrocarbon-containing material.

48. The method of claim 42, further comprising:

forming a tunnel liner in a tunnel behind the tunnel boring machine;

forming perforations in the liner;

sealing at least a section of the tunnel from an ambient atmosphere; and introducing a gas into the at least a sealed section of the tunnel.

49. The method of claim 42, further comprising:

installing a plurality of rock bolts into the hydrocarbon-containing material accessible by the tunnel formed by the tunnel boring machine, wherein each of the rock bolts includes a passage for gases passing into or out of the hydrocarbon-containing material.

50. The method of claim 37, wherein the tunnel boring machine forms, through the hydrocarbon-containing material, a plurality of overlapping "U" shaped tunnels, each of a pair of overlapping "U" shaped tunnels being interconnected by an adit and wherein the tunnel is on one level.

51. The method of claim 37, further comprising:

collecting methane gas in an atmosphere external to the tunnel boring machine; and transporting the methane gas to the surface.

52. The method of claim 37, further comprising:

using fine particulate waste material derived from the hydrocarbon-containing material as a lubricant in the tunnel boring machine.

53. The method of claim 37, wherein the excavating step includes:

forming a first tunnel having a "U"-shaped bearing through the hydrocarbon-containing material; and thereafter forming a second tunnel having a "U"-shaped bearing through the hydrocarbon-containing material, the first tunnel overlapping the second tunnel, wherein an excavation direction used to form the first tunnel is opposite to an excavation direction used to form a corresponding part of the second tunnel and wherein the first and second tunnels are on a common level.

54. The method of claim 37, wherein the passing step includes the steps of:

advancing a first section of the tunnel boring machine forward, wherein the first section is advanced by pushing against an adjacent second section of the tunnel boring machine;

when the first section is advanced relative to the second section a selected distance, pulling, with the first section, the second section forward and pushing, with at least one trailing section, adjacent to the second section, the second section forward;

when the second section is advanced relative to a trailing section the selected distance, pulling with the first and second sections and pushing off the backfill material behind the tunnel boring machine to move the at least one trailing section forward; and in the portion of the excavation formerly occupied by at least one trailing section, placing the liner.

55. The method of claim 54, wherein the liner is placed in the portion of the tunnel as the trailing section is moved forward.

56. The method of claim 37, further comprising:

propelling the tunnel boring machine forward by thrusting off of the backfill material positioned between the liner and an adjacent surface of the excavation.

57. The method of claim 37, wherein backfill material is not placed between the body of the tunnel boring machine and an adjacent surface of the excavation.

58. The method of claim 57, wherein the backfill material positioned between the at least one of a liner and form and the surface of the excavation is unconsolidated.

59. An underground mining method, comprising:

removing in situ material from an excavation face in an underground excavation, the underground excavation having a cross-sectional area near the excavation face and in a direction transverse to a direction of excavation;

sensing a type of unexcavated material ahead of the excavation face and wherein the sensing is performed using an active acoustic source; and forming at least a portion of the removed material into a consolidated liner between the excavation face and a surface opening of the underground excavation to define a trailing tunnel, the trailing tunnel having a cross-sectional area in a direction transverse to a direction of excavation that is less than the cross-sectional area of the underground excavation.

60. An underground mining method for excavating a hydrocarbon-containing material, comprising:

passing a tunneling machine through the in situ hydrocarbon-containing material to form excavated hydrocarbon-containing material;

placing a backfill material behind the tunneling machine to form a tunnel of reduced cross-sectional area; and using mature fine tailings as a lubricant in the tunneling machine.

61. An underground mining method for excavating a hydrocarbon-containing material, comprising:

passing a tunneling machine through the in situ hydrocarbon-containing material to form excavated material, wherein the tunneling machine forms, through the hydrocarbon-containing material, a tunnel having a "U"-shape heading;

forming a tunnel liner in a tunnel behind the tunneling machine;

forming perforations in the liner;

sealing at least a section of the tunnel from an ambient atmosphere;

introducing a gas into the at least a sealed section of the tunnel;

placing a backfill material behind the tunneling machine and around the liner to form a tunnel of reduced cross-sectional area.

62. An underground mining method for excavating a hydrocarbon-containing material, comprising:

passing a tunneling machine through the in situ hydrocarbon-containing material to form excavated material, wherein the tunneling machine forms, through the hydrocarbon-containing material, a tunnel extending in a "U"-shape pattern;

placing a backfill material behind the tunneling machine to form a tunnel of reduced cross-sectional area; and installing a plurality of rock bolts into the hydrocarbon-containing material accessible by the tunnel formed by the tunneling machine, wherein each of the rock bolts includes a passage for gases passing into or out of the hydrocarbon-containing material.

63. An underground mining method for excavating a hydrocarbon-containing material, comprising:

(a) passing a tunneling machine through the in situ hydrocarbon-containing material to form excavated material; and (b) placing a backfill material behind the tunneling machine to form a tunnel of reduced cross-sectional area, wherein the passing step (a) comprises the sub-steps of:

(i) advancing a first section of the tunneling machine forward, wherein the first section is advanced by pushing against an adjacent second section of the tunneling machine;

(ii) when the first section is advanced relative to the second section a selected distance, pulling, with the first section, the second section forward and pushing, with at least one trailing section, adjacent to the second section, the second section forward;

(iii) when the second section is advanced relative to a trailing section the selected distance, pulling with the first and second sections and pushing off the backfill material behind the tunneling machine to move the at least one trailing section forward; and (iv) in the portion of the excavation formerly occupied by at least one trailing section, placing a liner.

64. The method of claim 63, wherein the liner is placed in the portion of the tunnel as the trailing section is moved forward.

65. The method of claim 63, wherein the backfill material comprises material excavated previously by the tunneling machine.

66. The method of claim 65, wherein the in situ hydrocarbon-containing material is consolidated before the passing step.

67. The method of claim 65, wherein the backfill material is unconsolidated after the placing step.

68. The method of claim 65, wherein a cross-section of the tunnel of reduced cross-sectional area is no more than about 20% of a cross-section of the portion of the excavation before backfilling.

69. An underground mining method for excavating a hydrocarbon-containing material, comprising:

passing a tunneling machine through the in situ hydrocarbon-containing material to form excavated hydrocarbon-containing material;

placing a backfill material behind the tunneling machine to form a trailing passage of reduced cross-sectional area; and installing a plurality of rock bolts into the unexcavated hydrocarbon-containing material accessible by the tunnel formed by the tunneling machine, wherein each of the rock bolts includes a passage for gases passing into or out of the hydrocarbon-containing material.

70. The method of claim 69, wherein the backfill material comprises hydrocarbon-containing material excavated previously by the tunneling machine.

71. The method of claim 69, wherein the in situ hydrocarbon-containing material is consolidated before the passing step.

72. The method of claim 69, wherein the backfill material is unconsolidated after the placing step.

73. The method of claim 69, wherein a cross-section of the trailing passage is no more than about 20% of a cross-section of the at least a portion of the excavation before backfilling.

74. An underground mining method for excavating a hydrocarbon-containing material, comprising:

passing a tunneling machine through the in situ hydrocarbon-containing material to form excavated hydrocarbon-containing material;

forming a tunnel liner in a tunnel behind the tunneling machine;

forming perforations in the liner;

sealing at least a section of the tunnel from an ambient atmosphere; and introducing a gas into the at least a sealed section of the tunnel.

75. The method of claim 74, further comprising:

placing a backfill material behind the tunneling machine and around the liner.

76. The method of claim 75, wherein the backfill material comprises material excavated previously by the tunneling machine.

77. The method of claim 75, wherein the in situ hydrocarbon-containing material is consolidated before the passing step.

78. The method of claim 75, wherein the backfill material is unconsolidated after the placing step.

79. The method of claim 75, wherein an area of a cross-section of the lined passage is no more than about 20% of an area of a cross-section of the tunnel.

* * * * *

UNITED STATES PATENT AND TRADEMARK OFFICE

CERTIFICATE OF CORRECTION

PATENT NO. : 6,554,368 B2
DATED : April 29, 2003
INVENTOR(S) : Drake et al.

It is certified that error appears in the above-identified patent and that said Letters Patent is hereby corrected as shown below:

Column 11,
Line 9, please delete “description, the” and substitute -- decription. The -- therefor.

Column 12,
Line 12, please delete “froward” and substitute -- forward -- therefor.

Column 15,
Line 36, please delete “bought” and substitute -- brought -- therefor.

Column 17,
Line 48, please delete “80 C.” and substitute -- 80ºC -- therefor.

Column 19,
Line 59, please delete “mor” and substitute -- more -- therefor.

Column 25,
Line 38, please delete “10 15” and substitute -- 10-15 -- therefor.

Column 31,
Line 19, please delete “turn, The axis” and substitute -- turn, the axis -- thererfor.

Signed and Sealed this

Eighth Day of July, 2003

JAMES E. ROGAN
*Director of the United States Patent and Trademark Office*